US007639966B2

(12) United States Patent
Sato et al.

(10) Patent No.: US 7,639,966 B2
(45) Date of Patent: Dec. 29, 2009

(54) IMAGE FORMING APPARATUS HAVING AN IMAGE SCANNING UNIT

(75) Inventors: Shougo Sato, Seto (JP); Satoru Hattori, Nagoya (JP); Hidenori Hisada, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 226 days.

(21) Appl. No.: 11/563,925

(22) Filed: Nov. 28, 2006

(65) Prior Publication Data

US 2007/0160381 A1 Jul. 12, 2007

(30) Foreign Application Priority Data

Dec. 1, 2005 (JP) ..... P2005-348116
Dec. 1, 2005 (JP) ..... P2005-348117
Dec. 1, 2005 (JP) ..... P2005-348118

(51) Int. Cl.
*G03G 15/00* (2006.01)

(52) U.S. Cl. ..... 399/107

(58) Field of Classification Search ..... 399/111, 399/107, 405, 397, 124, 119, 262
See application file for complete search history.

(56) References Cited

U.S. PATENT DOCUMENTS 4,974,033 A * 11/1990 Yamada et al. ..... 399/124
5,095,334 A * 3/1992 Nukaya ..... 399/111
5,227,841 A * 7/1993 Takahashi et al. ..... 399/111
5,608,501 A 3/1997 Makino
5,842,083 A * 11/1998 Miyamoto et al. ..... 399/107
5,867,755 A 2/1999 Sato
5,953,561 A * 9/1999 Tashiro et al. ..... 399/111
6,041,203 A 3/2000 Suzuki et al.
6,330,410 B1 12/2001 Okabe et al.
6,411,789 B1 6/2002 Okabe et al.
6,470,160 B1 * 10/2002 Murakami ..... 399/124
6,473,579 B1 * 10/2002 Suzuki et al. ..... 399/124
6,546,217 B2 4/2003 Okabe et al.
6,690,903 B2 2/2004 Okabe et al.
6,741,820 B2 5/2004 Nobe et al.
6,873,810 B2 3/2005 Okabe et al.
7,019,870 B2 3/2006 Kameyama et al.
7,035,568 B2 * 4/2006 Sato et al. ..... 399/107
7,194,219 B2 * 3/2007 Sato et al.
7,269,377 B2 * 9/2007 Mori ..... 399/107
2004/0247337 A1 12/2004 Ohama et al.
2005/0129442 A1 6/2005 Matsumoto et al.

(Continued)

FOREIGN PATENT DOCUMENTS

JP 7-181769 7/1995

(Continued)

*Primary Examiner*—Susan S Lee
(74) *Attorney, Agent, or Firm*—Banner & Witcoff, Ltd.

(57) ABSTRACT

When a guide lever is in a toner open position, a space is formed between an upper surface of the guide lever and a lower surface of a flat bed unit as a part of a transport path of a paper. Therefore, the paper is turned forward around in a generally U-shape in the transport path, and passes over a toner cartridge, then is ejected to an ejection tray. So the transport path can be increased in radius of curvature at the U-turn point thereof, and whereby a reliable feed of the paper with a reduced risk of paper jam can be achieved. Further, since a scanning unit is disposed below and adjacent to a process cartridge and the ejection tray so that it can overlap with the process cartridge and the ejection tray, and is disposed adjacent to a feed tray so that it can overlap upwardly with the feed tray, reduction in size of a laser printer can be achieved.

22 Claims, 19 Drawing Sheets

1

U.S. PATENT DOCUMENTS

| | | | | |
|---|---|---|---|---|
| 2005/0135837 | A1 | 6/2005 | Okabe et al. | |
| 2005/0135842 | A1* | 6/2005 | Murakami et al. | 399/262 |
| 2006/0056876 | A1 | 3/2006 | Okabe et al. | |
| 2006/0056877 | A1 | 3/2006 | Okabe et al. | |
| 2006/0056878 | A1 | 3/2006 | Okabe et al. | |
| 2006/0103068 | A1* | 5/2006 | Sekiya | |

FOREIGN PATENT DOCUMENTS

| | | | |
|---|---|---|---|
| JP | 7-225514 | | 8/1995 |
| JP | 7-271274 | | 10/1995 |
| JP | 9-160370 | | 6/1997 |
| JP | 10-247051 | | 9/1998 |
| JP | 10247051 | A * | 9/1998 |
| JP | 2000-267549 | | 9/2000 |
| JP | 2001-089040 | | 4/2001 |
| JP | 2002-244377 | | 8/2002 |
| JP | 2002-247264 | | 8/2002 |
| JP | 2002244377 | A * | 8/2002 |
| JP | 2004-069884 | | 3/2004 |
| JP | 2004-214803 | | 7/2004 |
| JP | 2005-024759 | | 1/2005 |
| JP | 2005-173171 | | 6/2005 |
| JP | 2005-189552 | | 7/2005 |
| JP | 2005-196124 | | 7/2005 |

* cited by examiner

201

IMAGE FORMING APPARATUS HAVING AN IMAGE SCANNING UNIT

CROSS REFERRENCE TO RELATED APPLICATION

This application claims priority benefits on the basis of Japanese Patent Applications No. 2005-348116, No. 2005-348117, and No. 2005-348118 filed on Dec. 1, 2005, the disclosures of which are incorporated herein by reference.

BACKGROUND OF THE INVENTION

1. Field of the Invention

The present invention relates to an image forming apparatus and, particularly to, a laser printer equipped with a flat bed scanner, and the like.

2. Description of the Related Art

An image forming apparatus such as a laser printer in which an image scanning unit for scanning an image on a document, and an image forming section for forming an image on a recording medium based on the data scanned by the image scanning unit are incorporated integrally, is known and commercially produced as a copy machine, a digital complex machine having the functions of facsimile/network telecommunication facility, a printer, etc.

A complex machine in which a scanning unit, a paper ejection tray, a scanner, and a process section, a paper feed cassette are vertically arranged in this order toward the bottom, is proposed as one example of such image forming apparatus, for example in Japanese Unexamined Patent Publication No. 2004-214803 and U.S. Unexamined Patent Publication No. 2004-247337.

A complex machine designed so that paper fed from the paper feed cassette arranged on the lower side thereof passes under a process cartridge and is guided to a fixation unit, and then is ejected to a paper ejection tray arranged on the outside of a casing of the image forming apparatus, is proposed as another image forming apparatus for example in Japanese Unexamined Patent Publication No. 2004-69884, and U.S. Pat. No. 7,035,568.

A facsimile machine in which a paper ejection tray is arranged next to a fixation unit in a horizontal direction and which is designed so that the paper fed from the cassette arranged below passes under the process cartridge and is guided to the fixation unit, and then ejected within a main body casing (a so-called internal paper ejection), is proposed as still another image forming apparatus for example in Japanese Unexamined Patent Publication No. 10-247051.

An image forming apparatus such as a laser printer in which an image scanning unit for scanning an image on a document, and an image forming section for forming an image on a recording medium based on the data scanned by the image scanning unit are incorporated integrally is known, and commercially produced as a copy machine, a digital complex machine having the functions of facsimile/network telecommunication facility, a printer, etc.

An image forming apparatus in which a pivot shaft is provided between the printer section and the scanner at rear end portions thereof so that the scanner can be swingable to the printer section about the pivot shaft, whereby so that an upper surface of the printer section can be opened and closed by the swinging action of the scanner section, is proposed for example in Japanese Unexamined Patent Publication No. 2004-69884 and U.S. Pat. No. 7,035,568).

In this type of image forming apparatus, when the upper surface of the printer section is opened, the process cartridge is removably mounted in the printer section from an upper side of a front surface of a casing toward a lower side of a rear surface of the casing. A paper passes under the process cartridge and is guided to the fixation unit, and after passing through the fixation unit, the paper is ejected to the outside of the casing through a paper ejection port in the front surface of the casing and guided to the paper ejection tray.

SUMMARY OF THE INVENTION

The proposed image forming apparatuses cited above have the following disadvantages: In the complex machine described in Japanese Unexamined Patent Publication No. 2004-214803 and U.S. Unexamined Patent Publication No. 2004-247337, it is hard to reduce (thin) the entire vertical size (thickness) of the apparatus.

In the complex machine described in Japanese Unexamined Patent Publication No. 2004-69884 and U.S. Pat. No. 7,035,568, since the paper ejection tray is provided at the outside of the casing of the complex machine, the entire vertical size of the apparatus can be reduced (thinned), as described above, while on the other hand, the entire horizontal size of the apparatus is increased disadvantageously.

In addition, in the complex machine described in Japanese Unexamined Patent Publication No. 2004-69884 and U.S. Pat. No. 7,035,568, since the fed paper is forced to turn around (U-turn) its own direction midway of the paper transporting direction, and passes under the process cartridge to be provided with a formed image, and then is carried toward the paper ejection tray, a radius of curvature of a transport path at a U-turn point at which the U-turn of the paper takes place is relatively small. As a result of this, the paper is carried to turn in a small radius at the U-turn point. Due to this, the paper after passing the U-turn point tends to curl particularly at its end portion on the downstream side with respect to the paper transporting direction and is liable to be caught by components forming the transport pass, thus to cause a paper jam easily. Besides, since the paper passes under the process cartridge, the paper jammed is removed with difficulty.

In the facsimile machine described in Japanese Unexamined Patent Publication No. 10-247051, since the paper ejection tray is arranged next to the fixation unit in the horizontal direction to allow the internal paper ejection, the entire vertical size and horizontal size of the apparatus can be reduced. However, since the paper passes under the process cartridge, and then is carried to the paper ejection tray, the paper is jammed easily, due to the same reason as the complex machine described in Japanese Unexamined Patent Publication No. 2004-69884 and U.S. Pat. No. 7,035,568.

In the complex machine described in Japanese Unexamined Patent Publication No. 2004-69884 and U.S. Pat. No. 7,035,568, the paper ejection port and the fixation unit are arranged in front of the process cartridge. A developing agent cartridge containing developing agent is removably mounted in the process cartridge and is arranged on the rear side of the casing. This arrangement involves the disadvantage that when a user tries to replace the developing agent cartridge from the front side of the casing where the paper ejection port is formed, the user takes a troublesome work for the replacement, because the developing agent cartridge is located at the far side from the user and also cannot be exposed until the process cartridge is removed.

To obtain improved operability in the mounting/dismounting of the process cartridge, it is desirable that the scanner section is opened from the upper surface of the printer section as minimum as possible to save the labor of opening and closing the scanner section.

In the image forming apparatus described in Japanese Unexamined Patent Publication No. 2004-69884 and U.S. Pat. No. 7,035,568, since the paper is forced to turn around (U-turn) partway along the paper transporting direction and passes under the process cartridge to form the image on the paper and then is carried toward the paper ejection tray, a radius of curvature of the transport path at the U-turn point is relatively small. As a result of this, the paper carried is forced to turn in a small radius at the U-turn point. Due to this, the paper after passing past the U-turn point tends to curl particularly at its end portion on the downstream side with respect to the paper transporting direction and is liable to be caught on the paper pass forming part along the paper pass, thus causing a paper jam easily.

It is an object of the present invention to provide an image forming apparatus that can enable reduction in both vertical size and horizontal size and can well prevent a paper jam and also can clear the paper jam easily even when it occurs.

It is another object of the present invention to provide an image forming apparatus that can enable easy replacement of a developing agent cartridge and can well prevent a paper jam.

These objects of the present invention will be attained by providing an image forming apparatus comprising: a housing; an image scanning unit, arranged above the housing, for scanning image data of document; a process unit arranged in the housing, comprising an image carrier on which an electrostatic latent image is formed, a developing agent carrier for carrying a developing agent used for developing the electrostatic latent image to form a developing agent image, a transfer unit for transferring the developing agent image formed on the image carrier to a recording medium, and a developing agent accommodating member for accommodating the developing agent; an exposure unit, arranged below the image carrier in the housing, for forming the electrostatic latent image by exposing the image carrier; a recording medium feed section, arranged below the process unit in the housing, for accommodating the recording medium; a developing agent cartridge having at least the developing agent accommodating member, which is arranged above the recording medium feed section in the housing and is removably mounted in the housing; a fixation unit, arranged above the recording medium feed section in the housing and disposed on a side horizontally opposite to the developing agent accommodating member with respect to the image carrier, for fixing the developing agent image which is transferred to the recording medium by the process unit, on the recording medium; a recording medium ejection section arranged on an outside of the housing and on a side horizontally opposite to the process unit with respect to the fixation unit in such a manner as to overlap upwardly with the recording medium feed section; and a transport path, formed in the housing, for allowing the recording medium fed from the recording medium feed section to pass over the developing agent cartridge.

In another aspect of the invention, there is provided an image forming apparatus comprising: a housing; a process unit arranged in the housing, comprising an image carrier and on which an electrostatic latent image is formed, a developing agent carrier for carrying a developing agent used for developing the electrostatic latent image to form a developing agent image, and a transfer unit for transferring the developing agent image formed on the image carrier to a recording medium while carrying the recording medium between the image carrier and the transfer unit itself carrier; an image scanning unit, provided on an upper portion of the housing, for scanning an image data of a document, the image scanning unit being swung around one end portion side of an upper end portion of the housing in a direction orthogonal to a transporting direction of the recording medium, in a freely open and close manner toward the housing so that the other end portion side of the image scanning unit can be moved between a close position close to the upper end portion of the housing and a spaced position away from the upper end portion of the housing; a recording medium feed section, arranged below the process unit in the housing, for accommodating the recording medium; a developing agent cartridge, arranged above the recording medium feed section in the housing, for accommodating the developing agent, the developing agent cartridge being removably mounted in the process unit and having, on the other end portion side, a mounting operation member to be operated in mounting and dismounting the developing agent cartridge; a fixation unit, arranged above the recording medium feed section in the housing and disposed on a side horizontally opposite to the developing agent cartridge with respect to the process unit, for fixing the developing agent image which is transferred to the recording medium by the process unit, on the recording medium; a recording medium ejection section, arranged on an outside of the housing on a side horizontally opposite to the process unit with respect to the fixation unit, ejecting the recording medium on the recording medium ejection section; an exposure unit, arranged in the housing, for forming the electrostatic latent image by exposing the image carrier; and a transport path for allowing transport of the recording medium from the recording medium feed section to the recording medium ejection section.

BRIEF DESCRIPTION OF THE DRAWINGS

FIG. 3 (*a*) shows the state that the toner cartridge is mounted in the developing unit, with its outer housing being in a toner open position, and a shutter of the developing unit is in a development open position.

FIG. 3 (*b*) shows the state that the toner cartridge is mounted in the developing unit, with its outer housing being in a toner close position, and the shutter of the developing unit is in a development close position.

FIG. 3 (*c*) is a side sectional view of a principal part of the process cartridge of the laser printer shown in FIG. 1, showing the state of the toner cartridge being dismounted from the developing unit.

FIGS. 4 (*a*) shows the state that the toner cartridge is mounted in the developing unit, with its outer housing being in the toner open position, and the shutter of the developing unit is in the development open position.

FIG. 4 (*b*) shows the state that the toner cartridge is mounted in the developing unit, with its outer housing being in the toner close position, and the shutter of the developing unit is in the development close position.

FIG. 4 (*c*) is a right-side perspective view of the process cartridge of the laser printer shown in FIG. 1 as viewed from above and behind, showing the state of the toner cartridge being dismounted from the developing unit.

FIG. 5 (*b*) is a left-side perspective view of the toner cartridge, as viewed from above and front, with its outer housing being in the toner close position.

FIGS. 14 (*a*) shows the state that the toner cartridge is mounted in developing unit, with its inner housing being in a toner open position, and a shutter of the developing unit is in a development open position.

FIGS. 14 (*b*) shows the state that the toner cartridge is mounted in the developing unit, with its inner housing being in a toner close position, and the shutter of the developing unit is in a development close position.

FIGS. 14 (*c*) is a side sectional view of a principal part of the process cartridge, showing the state of the toner cartridge being dismounted from the developing unit.

FIG. 15 (*a*) shows the state that the toner cartridge is mounted in the developing unit, with its inner housing being in the toner open position, and the shutter of the developing unit is in the development open position.

FIG. 15 (*b*) shows the state that the toner cartridge is mounted in the developing unit, with its inner housing being in the toner close position, and the shutter of the developing unit is in the development close position.

FIG. 15 (*c*) is a right-side perspective view of the process cartridge, as viewed from above and behind, showing the state of the toner cartridge being dismounted from the developing unit.

FIG. 16 (*b*) is a left-side perspective view of the toner cartridge, as viewed from above and front, with its inner housing being in the toner close position.

FIG. 16 (*c*) is a front view of the toner cartridge with its inner housing is in the toner close position.

DETAILED DESCRIPTION OF THE PREFERRED EMBODIMENTS

In the following, certain preferred embodiments of the present invention will be described with reference to the attached drawings.

First Embodiment

1. Overall structure of Laser printer

Figure 1:
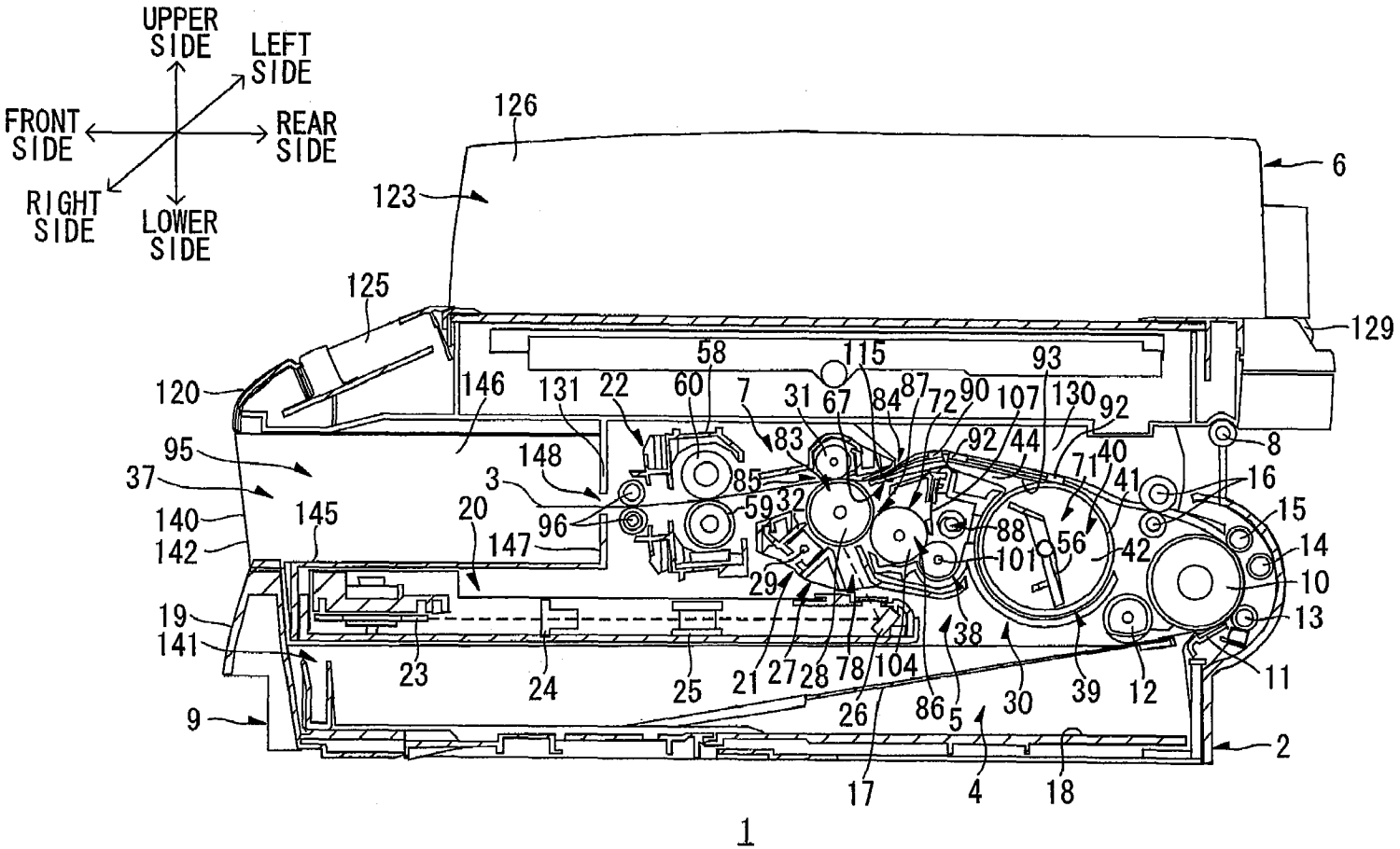
FIG. 1 is a side sectional view of a principal part of a laser printer as a first embodiment of the present invention, showing the state of a flat bed unit bed being in a close position.
Figure 2:
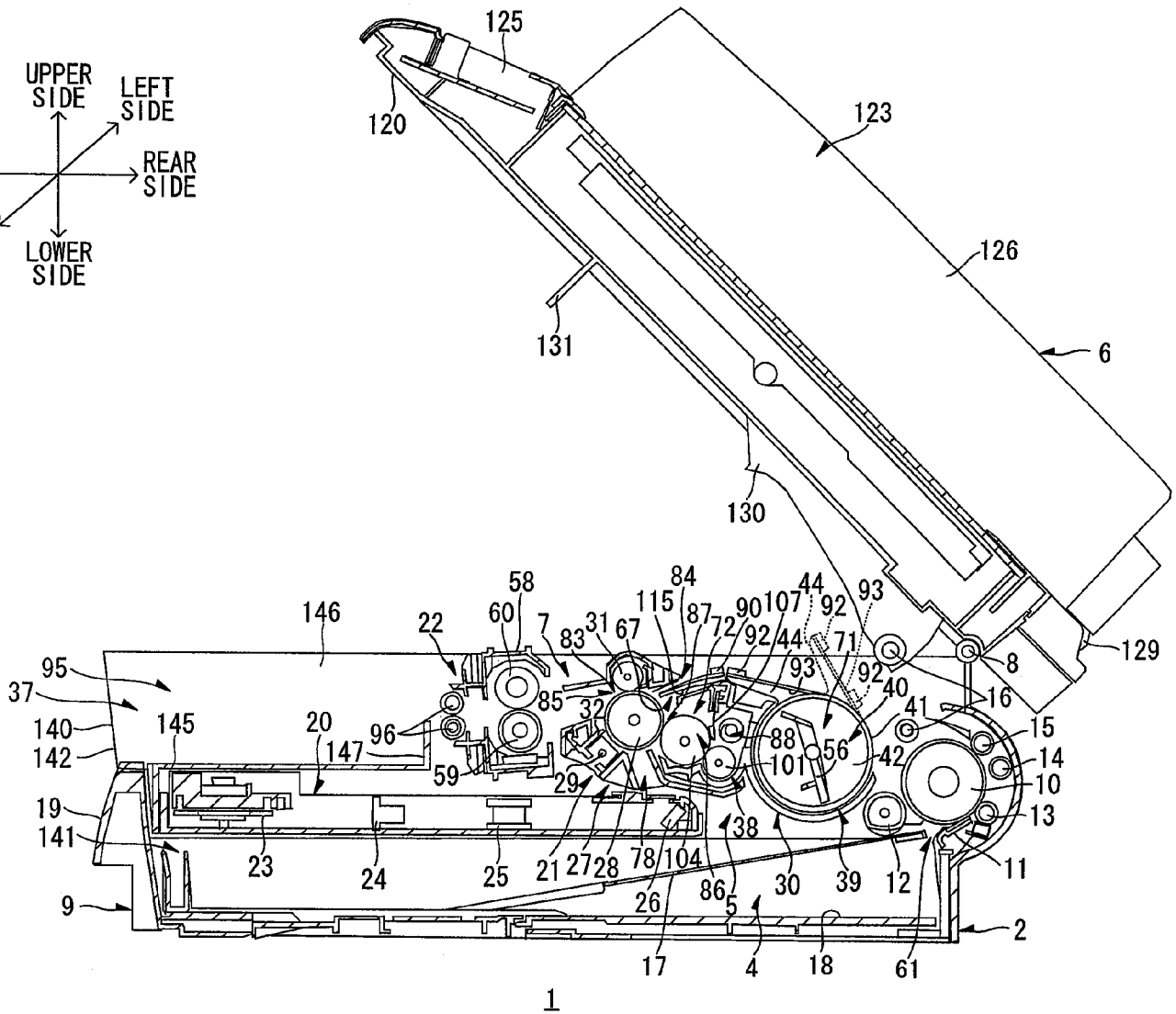
FIG. 2 is a corresponding view to FIG. 1, showing the state of the flat bed unit bed being in an spaced position.

FIGS. 1 and 2 are side sectional views of a principal part of a laser printer as a first embodiment of an image forming apparatus of the present invention. FIG. 1 shows the state of a flat bed unit as the image scanning unit described later, being in a close position, and FIG. 2 shows the state of the flat bed unit being in an spaced position.

The laser printer 1 comprises a main body casing 2 (housing) a feeder section 4, housed in the main body casing 2, for feeding paper 3 (recording medium), an image forming section 5 for forming an image on the fed paper 3, an ejection section 37 (recording medium ejection section) formed in the main body casing 2, and a flat bed unit 6, provided over the main body casing 2, for scanning the image on a document.

In the following description, it is to be noted that the paper left side of FIG. 1 is defined as the front (fore) side and a paper right side of FIG. 1 is defined as a back (rear) side in the state where a toner cartridge 40 (developing agent cartridge) and a process cartridge 21 (process unit) as described later, are mounted in the main body casing 2. Further, the paper front side of FIG. 1 is defined as the right side , and the paper back side of FIG. 1 is defined as the left side.

(1) Main Body Casing

As shown in FIG. 1, main body casing 2 is formed in a box shape having a generally square shape as viewed from top and a generally L-shaped section as viewed from side elevation. A mounting port 7 is formed in a top wall of the main body casing 2. A toner cartridge 40 and a process cartridge 21 described later where the toner cartridge 40 is removably mounted, are mounted and dismounted through the mounting port 7 individually or unitarily. The flat bed unit 6 is mounted so as to open and close the mounting port 7. The flat bed unit 6 is swingably supported by a pivot shaft 8 inserted through a rear end portion thereof along a widthwise direction (a transverse direction).

When the flat bed unit 6 is closed by being swung about the pivot shaft 8 to its close position where a front end portion is positioned close to an upper end portion of the main body casing 2, the mounting port 7 is closed by the flat bed unit 6. As shown in FIG. 2, when the flat bed in it 6 is opened by being swung about the pivot shaft 8 to its spaced position where the front end portion of the flat bed unit 6 is away from the upper end portion of the main body casing 2, the mounting port 7 is opened widely to the front. Therefore, the toner cartridge 40 and the process cartridge 21 can be mounted in and dismounted from the main body casing 2 through the mounting port 7 from the front side.

As shown in FIG. 1, a front side wall 140 is formed in an upper half of main body casing 2 the front side of main body casing 2, while a paper feed tray mounting port 141 is formed in a lower half of the front side of the main body casing 2. The paper feed tray mounting port 141 is formed in a rectangular shape which is elongated in width direction. A paper feed tray 9 (recording medium feed section) described later can be mounted in and dismounted from the main body casing 2 through the paper feed tray mounting port 141 along the anteroposterior direction.

(2) Feeder Section

The feeder section 4 is provided at the bottom of the main body casing 2, including the paper feed tray 9 removably mounted and dismounted along the anteroposterior direction, a separation roller 10 and a separation pad 11 provided above a rear end portion of the paper feed tray 9, and a paper feed roller 12 provided in front of the separation roller 10 (on an upstream side of the paper transporting direction, toward the separation pad 11).

The paper feed tray 9 is formed in a box shape, has an opening at the top thereof, and integrally has a grip 19 on the front side thereof. The grip 19 is formed in an inverted L-shape in section as viewed from side elevation, whose base end portion is connected to an upper end portion of on the front side of the paper feed tray 9, and whose distal end portion is extended downwardly to a generally vertical center position of the paper feed tray 9. The grip 19 covers an upper half of the front side of the paper feed tray 9.

The feeder section 4 includes a paper powder dust removing roller 13 disposed opposite to the separation roller 10 and located above a rear end of the separation pad 11, a first guide roller 14 and a second guide roller 15 which are disposed opposite to the separation roller 10 on the downstream side toward the paper dust removing roller 13 with respect to a paper transporting direction. The first guide roller 14 is disposed on the upstream side toward the second guide roller 15 with respect to the paper transporting direction. The second guide roller 15 is disposed in abutment with the separation roller 10, while the first guide roller 14 is spaced apart from the separation roller 10.

Resistration rollers 16 comprising a pair of rollers are provided above and in front of the separation roller 10.

The paper feed tray 9 is provided, in an interior thereof, with a paper pressing plate 17 for allowing paper 3 to be stacked. The paper pressing plate 17 is swingably supported at a front end portion thereof so that it can be swung between a paper stacked position where the paper pressing plate 17 is extended along a bottom plate 18 of the paper feed tray 9 and its rear end portion is lowered, and a paper feeding position where the paper pressing plate 17 is positioned obliquely and its rear end portion is heightened. When the paper feed tray 9 is dismounted from the main body casing 2 through the paper feed tray mounting port 141, the rear end portion of the paper pressing plate 17 moves downwardly under its own weight, so that the paper pressing plate 17 is put in the paper stacked position. When the paper pressing plate 17 is positioned in the paper stacked position, the paper 3 can be stacked on the paper pressing plate 17.

The paper feed tray 9 is provided with a lever (not shown) for lifting up the rear end portion of the paper pressing plate 17. The lever (not shown) works to swing the paper pressing plate 17 between the paper stacked position and the paper feeding position.

When the lever (not shown) is operated to put the paper pressing plate 17 in the paper feeding position, the paper 3 stacked on the paper pressing plate 17 is pressed against the paper feed roller 12, and paper feeding toward a separation position between the separation roller 10 and the separation pad 11, is started by rotation of the paper feed roller 12.

The paper 3 fed toward the separation position by the paper feed roller 12 is sandwiched between the separation roller 10 and the separation pad 11 by the rotation of the separation roller 10,then separated one by one. The paper 3 fed passes through between the paper dust removing roller 13 and the separation roller 10, where the paper dust is removed from the paper 3. Thereafter, the paper 3 is guided by the first guide roller 14 and the second guide roller 15 and is turned around forward in a generally U-shape, then is carried toward the resistration rollers 16.

As described before, the first guide roller 14 is disposed opposite to and spaced apart from the separation roller 10 at a generally U-shaped turn-around position (at the deepest portion in the U-shape or at the backmost portion in FIG. 1). Therefore, even when the paper 3's downstream side end portion with respect to the transporting direction passing over the paper dust removing roller 13, is carried so as to go off the outer periphery of the separation roller 10, without curving around it, the paper transporting direction is corrected by the first guide roller 14 so that the downstream side end portion of paper 3 can be correctly carried around the separation roller 10.

The resistration rollers 16 resist the paper 3, then carry the paper 3 to a transfer position between a photosensitive drum 28 (image carrier) and a transfer roller 31 (transfer unit) as described later. A toner image on the photosensitive drum 28 is transferred on the paper 3 at the transfer position.

(3) Image Forming Section

An image forming section 5 includes a scanner 20 (exposure unit), a process cartridge 21, and a fixation unit 22 (fixation unit).

(a) Scanner

The scanner 20 is arranged above the feeder section 4 in the main body casing 2. The scanner 20 is placed adjacent to the paper feed tray 9 so that the scanner 20 can overlap upwardly with the paper feed tray 9 about an area extending from a front end thereof to a portion which is slightly rear toward a center thereof in anteroposterior direction. And the scanner 20 is placed adjacent to a paper ejection tray 95 described later so that the front half portion of the scanner 20 can overlap downwardly with the paper ejection tray 95. The scanner 20 includes a laser source (not shown), a polygonal mirror 23 to be rotationally driven, an fθ lens 24, a lens 25, and a reflector 26, along the front and rear direction. As indicated by a chain line, the laser beam emitted from the laser source based on the image data, is polarized by the polygonal mirror 23 at first, and then passes through the fθ lens 24 and the lens 25 in the order, next a light path of the laser beam is folded obliquely forward and upward by the reflector 26, to irradiate a surface of the photosensitive drum 28 of the process cartridge 21 with the laser beam.

(b) Process Cartridge

Figure 3:
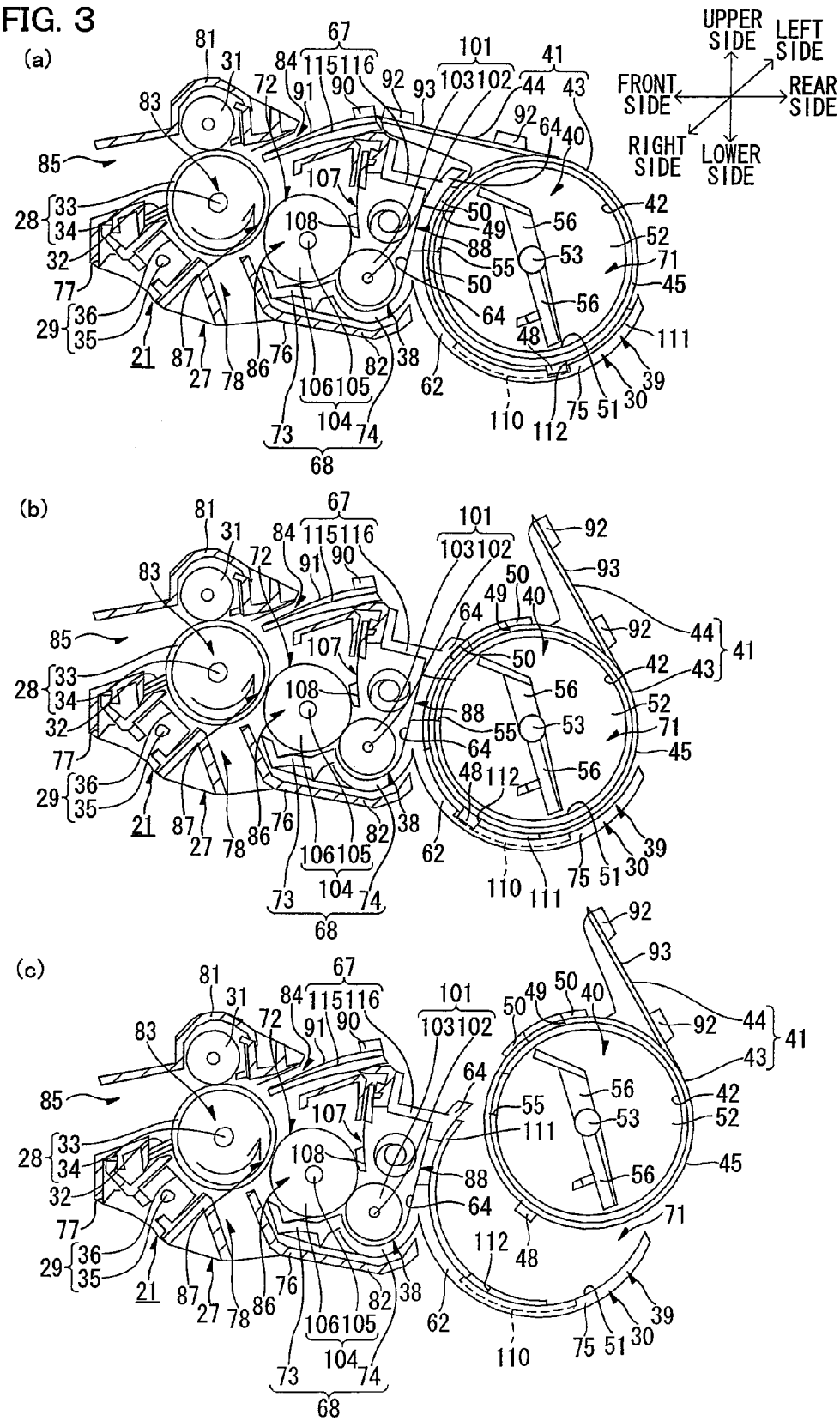
FIGS. 3(*a*) to 3(*c*) are operation diagrams for explaining the operation of mounting/dismounting a toner cartridge in/from a developing unit of a process cartridge.

FIGS. 3 (*a*) to 3 (*c*) are side sectioned views of a principal part of the process cartridge of the laser printer shown in FIG. 1, and FIGS. 3(*a*) to 3(*c*) show the mounting/dismounting of the toner cartridge in/from the developing unit of the process cartridge.

Figure 4:
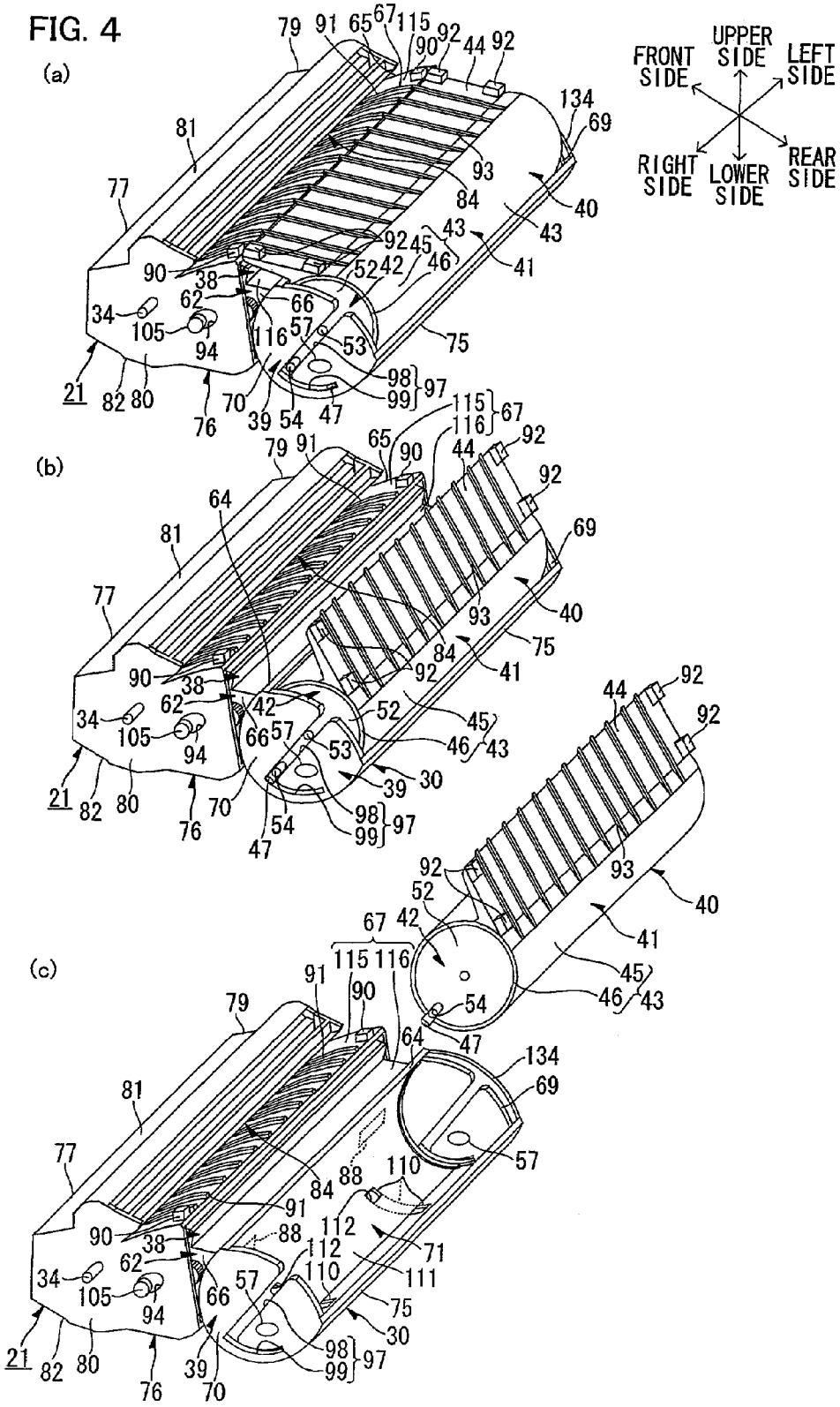
FIGS. 4 (*a*) to 4(*c*) are operation diagrams, corresponding to FIGS. 3(*a*)-3(*c*), for explaining the operation of mounting/dismounting the toner cartridge in/from the developing unit of the process cartridge.

FIGS. 4 (*a*) to 4(*c*) are right-side perspective views of the process cartridge of the laser printer shown in FIG. 1 as viewed from above and behind, and FIGS. 4(*a*) to 4(*c*) correspond to FIGS. 3(*a*) to 3(*c*), show the mounting/dismounting of the toner cartridge in/from the developing unit of the process cartridge.

Figure 5:
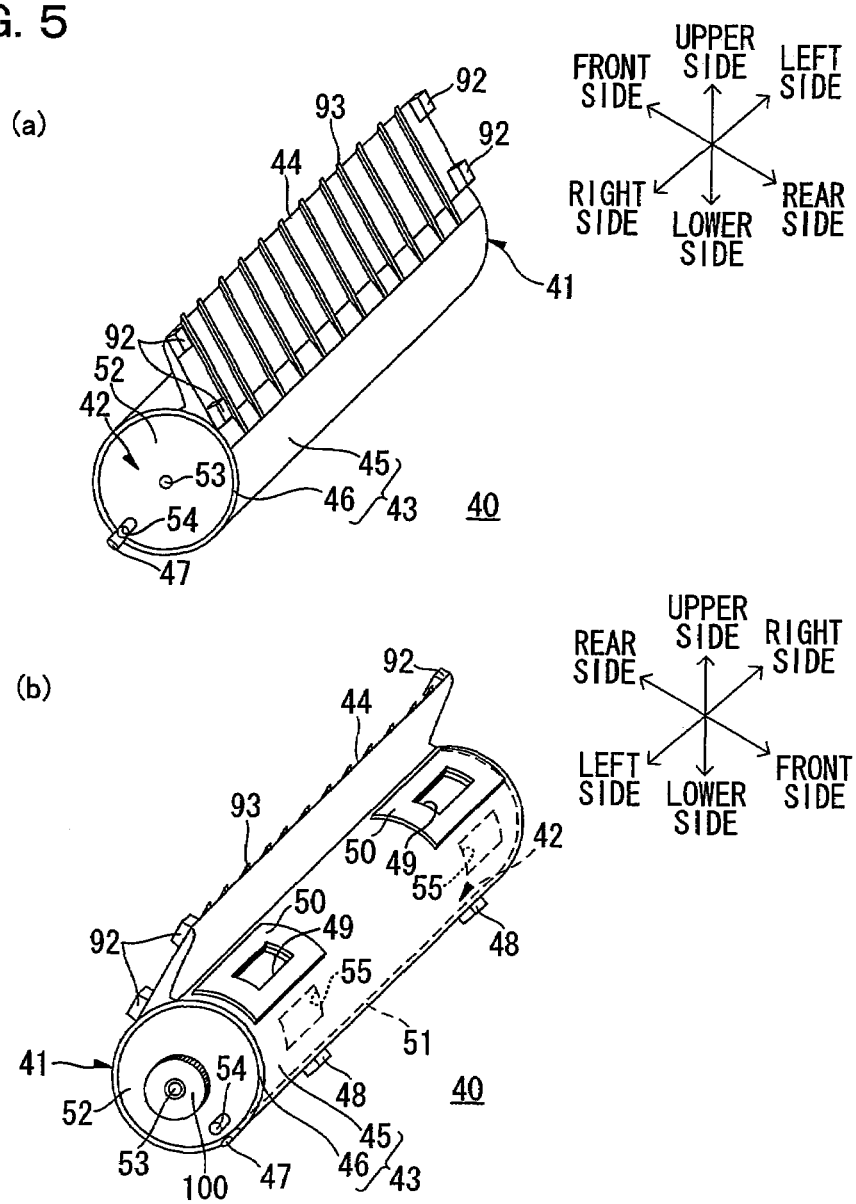
FIG. 5 (*a*) is a right-side perspective view of the toner cartridge, as viewed from above and behind, its outer housing being in the toner close position.

FIG. 5(*a*) is a right-side perspective view of the toner cartridge, as viewed from above and behind, with its outer housing being in the toner close position described later, and FIG. 5(*b*) is a left-side perspective view of the toner cartridge, as viewed from above and front, with its outer housing being in the toner close position.

Figure 6:
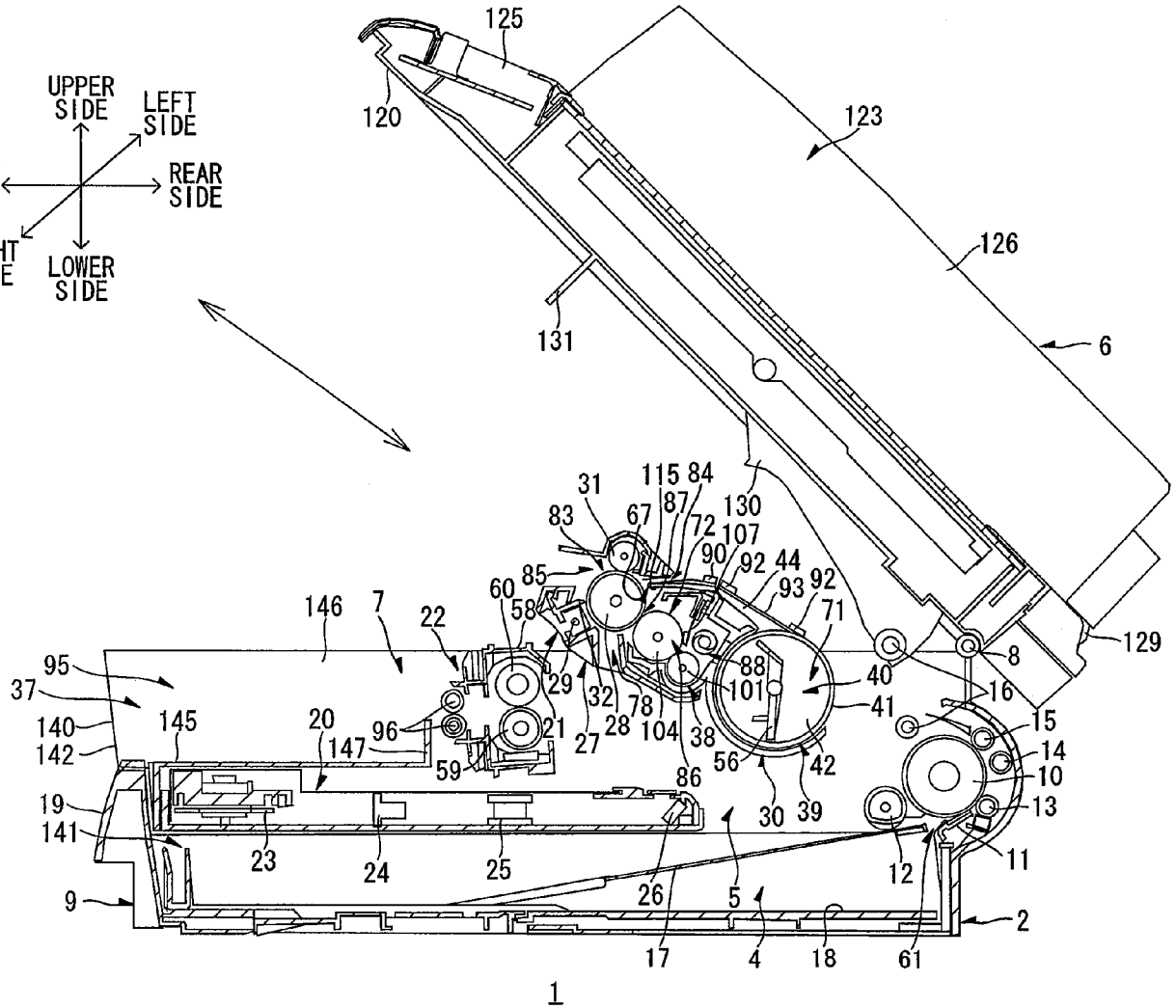
FIG. 6, corresponds to FIG. 2, and shows the state of the process cartridge being mounted/dismounted in/from the laser printer.

FIG. 6 corresponds to FIG. 2, and shows the state of the process cartridge being mounted/dismounted in/from the laser printer.

As shown in FIG. 1, the process cartridge 21 is arranged adjacent to the scanner 20 in the main body casing 2 so that its front half portion can overlap upwardly with the scanner 20, and arranged adjacent to the paper feed tray 9 so that its rear half portion can overlap upwardly with the paper feed tray 9.

As shown in FIG. 6, the process cartridge 2l is removably mounted in the main body casing 2. As shown with the allow in FIG. 6 the direction of the process cartridge 21 being mounted in the main body casing 2 (the mounting direction) corresponds to an obliquely backward and downward direction, and the direction of the process cartridge 21 being dismounted from the main body casing 2 (the dismounting direction) corresponds to an obliquely forward and upward direction.

As shown in FIGS. 3(*a*) to 3(*c*), the process cartridge 21 includes a drum unit 27 and a developing unit 30 unitarily and further includes a toner cartridge 40 removably mounted in the process cartridge 21.

(b-1) Drum Unit

The drum unit 27 includes a drum housing 76, the photosensitive drum 28 provided in the drum housing 76, a scorotron charger 29, a transfer roller 31, and a cleaning brush 32.

The drum housing 76 is formed in a box shape elongated in a widthwise direction and has an opening at a rear side thereof, the drum housing 76 integrally comprises a drum front wall 77, a drum left side wall 79 (see FIGS. 4 (*a*) to 4 (*c*)), a drum right side wall 80 (see FIGS. 4(*a*) to 4 (*c*)), a drum top wall 81, and a drum bottom wall 82.

As shown in FIGS. 4 (*a*) to 4 (*c*), the drum left side wall 79 and the drum right side wall 80 are disposed opposite to and spaced apart from each other in the widthwise direction. Each of the drum left side wall 79 and the drum right side wall 80 has an elliptical hole 94 which is elliptical as viewed from side elevation and formed at the position which is slightly rear from the center position thereof in anteroposterior direction and at the vertical center position thereof.

The drum bottom wall 82 is extended between a lower edge of the drum left side wall 79 and a lower edge of the drum right side wall 80. The drum front wall 77 is extended between a front edge of the drum left side wall 79 and a front edge of the drum right side wall 80. The drum top wall 81 is extended between an upper edge of the drum left side wall 79 and an upper edge of the drum right side wall 80.

As shown in FIGS. 3 (*a*) to 3 (*c*), the drum bottom wall 82 has a laser entrance 78, formed midway in anteroposterior direction, for irradiating the photosensitive drum 28 with the laser beam emitted from the scanner 20. A first passing port 84 is opened between a rear edge of the drum top wall 81 and a front edge of a development top wall 67 of the developing unit 30 described later, and a second passing port 85 is opened at an upper end of the drum front wall 77. The first passing port 84 and the second passing port 85 are both formed in a widthwise elongated rectangular shape.

In the drum housing 76, a zone defined by the drum front wall 77, and the front halves of the drum left side wall 79 and, drum right side wall 80 and drum bottom wall 82, serves as a drum accommodating section 83 for accommodating the photosensitive drum 28, the scorotron charger 29, the transfer roller 31, and the cleaning brush 32. The drum accommodating section 83 is formed in a cylindrical shape opened at the front and rear sides.

A zone defined by the rear halves of the drum left side wall 79, drum right side wall 80, and drum bottom wall 82, serves as a development placing section 86 for the developing unit 30 to be placed therein. The development placing section 86 is formed in an U-shaped closed-end frame opened at the top, as viewed in section from the front side.

The drum accommodating section 83 and the development placing section 86 communicate with each other.

The photosensitive drum 28 includes in a cylindrical shaped, a drum body 33 whose outermost surface layer is formed by a positive chargeable photosensitive layer of polycarbonate and the like, and a metal drum shaft 34 arranged in an axis of the drum body 33 and extending along an axial direction of the drum body 33. The drum shaft 34 is supported at both axial ends thereof between the drum left side wall 79 and the drum right side wall 80 of the drum housing 76 (see. FIGS. 4 (*a*) to 4 (*c*)), and the drum body 33 is supported rotatably relative to the drum shaft 34. Therefore, the photosensitive drum 28 is incorporated in the drum housing 76 so that it can freely rotate around the drum shaft 34. The photosensitive drum 28 is rotationally driven by a driving force input from a motor (not shown).

The scorotron charger 29 is supported on the drum bottom wall 82 of the drum housing 76 at the obliquely forward and downward of the photosensitive drum 28 and is disposed opposite to and spaced apart from the photosensitive drum 28 not to contact therewith. The scorotron charger 29 includes a discharge wire 35 disposed opposite to and spaced apart from the photosensitive drum 28, and a grid 36, disposed between the discharge wire 35 and the photosensitive drum 28, for controlling quantity of electric charge from the discharge wire 35 to the photosensitive drum 28.

In the scorotron charger 29, a bias voltage is applied to the grid 36, while at the same time, a high voltage is applied to the discharge wire 35, whereby corona discharge is generated from the discharge wire 35 to allow a surface of the photosensitive drum 28 to be uniformly charged positively.

The transfer roller 31 in the drum housing 76 is disposed above and vertically opposite to the photosensitive drum 28 and is put in contact with the photosensitive drum 28 to form a nip between the transfer roller 31 and the photosensitive drum 28. This nip forms a transfer position between the photosensitive drum 28 and the transfer roller 31.

The transfer roller 31 includes a metal roller shaft supported rotatably between the drum left side wall 79 and the drum right side wall 80 of the drum housing 76, and a rubber roller of conductive rubber material for covering the metal roller shaft. In the transfer, a transfer bias is applied to the transfer roller 31. The transfer roller 31 is rotationally driven by a driving force input from a motor (not shown).

The cleaning brush 32 is disposed on the drum front wall 77 of the drum housing 76. The cleaning brush 32 opposes to and contacts with the photosensitive drum 28 at a location on the obliquely forward and downward side of the photosensitive drum 28 and on the obliquely forward and upward side of the scorotron charger 29 (on the upstream side from the scorotron charger 29 with respect to the rotational direction of the photosensitive drum 28 (see an arrow of FIGS. 3 (*a*) to 3(*c*)).

(b-2) Developing Unit

The developing unit 30 is provided integrally with the drum unit 27 in the development placing section 86 of the drum housing 76.

The developing unit 30 includes a development housing 62, a feed roller 101, a developer roller 104 (developing agent carrier), and a layer-thickness regulating blade 107 which are arranged in the development housing 62.

The development housing 62 integrally includes a front housing 38 formed in a widthwise elongated box shape opened at the front side, and a rear housing 39 formed in a cylindrical shape opened at the top.

The front housing 38 integrally comprises a development rear wall 64, a development left side wall 65 (see FIGS. 4 (*a*) to 4 (*c*)), a development right side wall 66 (See FIGS. 4 (*a*) to 4 (*c*)), a development top wall 67, and a development bottom wall 68.

The development left side wall 65 and the development right side wall 66 are formed in a generally rectangular shape, as viewed from side elevation, and are disposed opposite to and spaced from each other in the widthwise direction.

The development bottom wall 68 is extended between a lower edge of the development left side wall 65 and a lower edge of the development right side wall 66 and integrally includes a first bottom wall 73 and a second bottom wall 74 which are arranged in this order from the front to the rear.

The first bottom wall 73 is located in the front side of the development bottom wall 68 and is formed in a generally rectangular shape as viewed from top, extending from the rear to the front in a generally hook shape in section as viewed from side elevation.

The second bottom wall 74 extends continuously from a rear edge of the first bottom wall 73 and is formed in a generally semicircular arc shape in section, as viewed from side elevation, along the feed roller 101.

The development top wall 67 is extended between an upper edge of the development left side wall 65 and an upper edge of the development right side wall 66 and integrally includes a first top wall 115 and a second top wall 116.

The first top wall 115 is located in the front side of the development top wall 67 and is extended obliquely rearwards to the rear side.

The paper 3 passes over the development top wall 67. As shown in FIGS. 4 (*a*) to 4 (*c*), the first top wall 115 has first guide lugs 90 on the rear side of an upper surface facing the carried paper 3 at both widthwise ends, respectively. The first guide lugs 90 are formed in a generally rectangular parallelepiped shape and project in a thickness direction of the paper 3, or to an upward direction.

There are provided a plurality of first guide ribs 91 equally spaced along the widthwise direction between the two guide lugs 90 opposing each other in the widthwise direction. The first guide rids 91 are ridges projecting upward and extending along the anteroposterior direction, or the paper transporting direction.

The first guide lugs 90 project from the upper surface of the first top wall 115 to a larger extent than the first guide ribs 91, and the difference is larger than a thickness of the paper 3.

As shown in FIGS. 3 (*a*) to 3 (*c*), the second top wall 116 is formed in a generally L-shape in section, as viewed from right side, extending downward from a rear edge of the first top wall 115, then bending, and extending rearward, and then connected to an upper edge of the development rear wall 64.

The development rear wall 64 is extended between a rear edge of the development left side wall 65 and a rear edge of the development right side wall 66. A lower edge end of the development rear wall 64 is connected to a rear edge of the second bottom wall 74.

An insertion opening 87 formed on the front side of the front housing 38 is defined by front edges of the development top wall 67, the development left side wall 65, the development right side wall 66, and the development bottom wall 68. The insertion opening 87 is formed in a widthwise elongated rectangular shape.

The rear housing 39 is integrally formed by a left side wall 69, a right side wall 70, and a curved wall 75.

As shown in FIG. 4(*c*), the left side wall 69 and the right side wall 70 are disposed opposite to each other in the widthwise direction and are formed in a generally gibbous moon shape as viewed from side elevation.

The left side wall 69 and the right side wall 70 respectively have guide grooves 97 formed to penetrate the left side wall 69 and the right side wall 70 in the thickness direction. Each guide groove 97 is formed in a sickle-like shape in section, as viewed from side elevation, integrally comprising a linear groove portion 98 extending obliquely forward and downward from an upper edge of the left side wall 69 and the right side wall 70 at an anteroposterior center thereof respectively, and a curved groove portion 99 extending continuously rearward from a lower end of the linear groove portion 98 along a periphery of the curved wall 75.

A plate 134, having the same shape as the left side wall 69 as viewed from side elevation, is provided on the left side of the left side wall 69 at an widthwise spaced location. No guide groove 97 is formed in this plate 134.

The curved wall 75 is extended between the left side wall 69 and the right sidewall 70 around their outer peripheries except their upper edges and is formed in a generally semicircular arc shape in section as viewed from side elevation. The curved wall 75 has a pair of circumferential grooves 110 formed in an upper surface thereof at locations inwardly about one-quarter of a widthwise dimension of the curved wall 75 from both widthwise ends thereof. The circumferential grooves 110 are concaved in a region extending from a position midway between an anteroposterior center and a front end of the curved wall 75 to a position midway between that center and a rear end thereof, and extend along a circumferential direction of the curved wall 75. The circumferential grooves 110 are formed in a rectangular shape as viewed from top.

As shown in FIGS. 3 (*a*) to 3 (*c*), in the front housing 38, a zone defined by the development rear wall 64, the development left side wall 65, the development right side wall 66, the development top wall 67, and the development bottom wall 68 serves as a developing chamber 72 for housing the feed roller 101, the developer roller 104, and the layer-thickness regulating blade 107.

In the rear housing 39, a zone defined by the left side wall 69, the right side wall 70, and the curved wall 75 serves as a toner cartridge accommodation chamber 71 for accommodating the toner cartridge 40. The toner cartridge accommodation chamber 71 is formed in a closed-end frame shape opened at the top.

The front housing 38 and the rear housing 39 are joined to each other via the rear surface of the development rear wall 64 and the front surface of the curved wall 75. Introduction ports 88 are formed in a joined portion of the development rear wall 64 and the curved wall 75 at both widthwise end portions thereof, and penetrate the joining portion in the thickness direction. The introduction ports 88 are formed in a widthwise elongated rectangular shape. The toner cartridge accommodation chamber 71 and the developing chamber 72 communicate with each other via the introduction ports 88.

The toner cartridge accommodation chamber 71 is provided in an interior thereof with a shutter 111.

The shutter 111 is formed by a thin plate of generally semicircular arc shape in section, as viewed from side elevation, smaller in circular arc than generally semicircular arc shape of the curved wall 75. As shown in FIGS. 4 (*a*) to 4 (*b*), the shutter 111 has first penetrate holes 112 having a rectangular shape as viewed from top and penetrating the shutter 111 in the thickness direction. The first penetrate holes 112 are formed in a rear portion of the shutter 111 at locations inwardly about one-quarter of a widthwise dimension of the shutter 111 from both widthwise ends thereof.

The shutter 111 is supported on the upper surface of the curved wall 75 in the interior of the toner cartridge accommodation chamber 71 so that it can be freely slid along the generally semicircular arc of the upper surface of the curved wall 75. The first penetrate holes 112 always oppose to the circumferential grooves 110 formed in the curved wall 75, respectively. The shutter 111 is movable between the development close position where the introduction ports 88 are both closed and the development open position where the introduction ports 88 are opened. Differently from the opening and closing mechanism on the toner cartridge side, the shutter 111 must withstand the repeat use. From this viewpoint, the shutter 111 is preferably formed of a thin metal plate, a plated steel plate, alumina or the like.

As shown in FIGS. 3 (*a*) to 3 (*c*), the feed roller 101 is disposed in front of the introduction ports 88. The feed roller 101 includes a feed roller shaft 102 formed of metal, and a sponge roller 103 formed of conductive foam material for covering the feed roller shaft 102. The feed roller shaft 102 is rotatably supported at both axial ends thereof between the development left side wall 65 and the development right side wall 66 at anteroposterior position thereof corresponding to the second bottom wall 74. The feedroller 101 is rotationally driven by a driving force from a motor (not shown) being input to the feed roller shaft 102.

The developer roller 104 is disposed in front of the feed roller 101 in the state where it contacts with the feed roller 101 so that the developer roller 104 and the feed roller 101 can be compressed with each other. The developer roller 104 includes a developer roller shaft 105 formed of metal, and a rubber roller 106 formed of conductive rubber material for covering the developer roller shaft 105.

The developer roller shaft 105 is rotatably supported at both axial ends thereof between the development left side wall 65 and the development right side wall 66 at anteroposterior positions thereof corresponding to the first bottom wall 73. The rubber roller 106 is formed of conductive urethane rubber or silicone rubber including carbon fine particles and is covered with a coating layer formed of resin excellent in wear and abrasion resistance such as urethane rubber containing fluorine or polyimide. The developer roller 104 is rotationally driven by a driving force from a motor (not shown) being input to the developer roller shaft 105. As shown in FIGS. 4 (*a*) to 4 (*c*), in the developing process, developing bias is applied to the developer roller 104 via one widthwise end portion of the developer roller shaft 105 which is exposed via the elliptical holes 94 formed in the drum left side wall 79 and the drum right side wall 80.

As shown in FIGS. 3 (*a*) to 3 (*c*), the layer-thickness regulating blade 107 is provided with a pressing portion 108 of generally semicircular shape in section. The pressing portion 108 is formed of insulative or conductive silicon rubber or urethane rubber and is provided at a distal end of a blade body formed of a metal plate spring material. The blade body of the layer-thickness regulating blade 107 is supported at a base end thereof to the development top wall 67 at a location above the developer roller 104, so that the pressing portion 108 is press-contacted with the developer roller 104 by an elastic force of the blade body.

(b-3) Toner Cartridge

The toner cartridge 40 is removably mounted in the toner cartridge accommodation chamber 71 of the development housing 62. Therefore, the toner cartridge 40 can be mounted in and dismounted from the main body casing 2 by mounting and dismounting the process cartridge 21 in and from the main body casing 2 through the mounting port 7 in the state where the toner cartridge 40 is mounted in the process cartridge 21. Further, the toner cartridge 40 separately can be mounted in and dismounted from the process cartridge 21 mounted in the main body casing 2, through the mounting port 7.

As shown in FIG. 5(*a*), the toner cartridge 40 is formed in a generally inverted 9 shape, as viewed from right side, including an outer housing 41 and an inner housing 42 both of which are formed of semi-transparent resin.

The outer housing 41 is formed in a generally inverted 9 shape, as viewed from right side of the toner cartridge 40, and integrally includes a cylindrical portion 43, and a guide lever 44 (first guide member).

The cylindrical portion 43 is in the shape of a widthwise elongated and hollow cylinder, including a cylindrical external wall 45, and a pair of ring- shaped outside side walls 46 defined as both widthwise end surfaces of the cylindrical external wall 45 by thickness of the cylindrical external wall 45. Columnar external lugs 47 are respectively formed on the outside side walls 46 at circumferential and widthwise corresponding portions thereof, to project widthwise outward.

The guide lever 44 has a widthwise dimension equal to that of the cylindrical external wall 45 and is in the shape of a widthwise elongated, generally rectangular, flat plate. The guide lever 44 projects tangentially from one circumferential portion of the cylindrical external wall 45. In detail, a base end portion of the guide lever 44 on the cylindrical external wall 45 is positioned on the opposite side to the external lugs 47 on the cylindrical portion 43 with respect to a center axis of the cylindrical portion 43. A distal end portion of the guide lever 44 projects counterclockwise, when the cylindrical portion 43 is viewed from right side.

When paper 3 is carried in the image forming operation of the laser printer 1, the paper 3 passes over the upper surface of the guide lever 44 which is the opposite side to the lower surface of the guide lever 44 opposing to the cylindrical external wall 45 of the cylindrical portion 43. Guide lugs 92 (space keeping members) are respectively provided on the upper surface of the guide lever 44 at the both widthwise end portions thereof on the base end portion and on the distal end portion.

The second guide lugs 92 are formed in a generally rectangular parallelepiped shape having the same size as the first guide lugs 90. The second guide lugs 92 extend on the guide lever 44 in a direction away from the cylindrical external wall 45, or in the thickness direction of the paper 3 passing over the upper surface of the guide lever 44 in the image forming operation.

There are provided a plurality of second guide ribs 93 equally spaced in the widthwise direction between the second guide lugs 92 opposing to each other in the widthwise direction. The second guide lugs 92 are ridges projecting in a direction away from the cylindrical external wall 45 and also extending in a direction from the base end portion toward the distal end portion of the guide lever 44, or along the paper transporting direction in the image forming operation. The second guide ribs 93 project from the upper surface of the guide lever 44 to equal extent to the first guide ribs 91 projecting from the upper surface of the first top wall 115.

Further, the second guide ribs 93 project from the upper surface of the guide lever 44 to smaller extent than the second guide lugs 92 projecting from the upper surface of the guide lever 44, and the difference there between is larger than the thickness of the paper 3.

The cylindrical external wall 45 has first radial lugs 48 projecting radially outwardly. The first radial lugs 48 are respectively formed at locations substantially circumferentially corresponding to the position of the external lugs 47 and inwardly about one-quarter of a widthwise dimension of the cylindrical external wall 45 from both widthwise ends thereof, as shown in FIG. 5(*b*).

Also, the cylindrical external wall 45 has first vents 49 penetrating there through it in the thickness direction, which are respectively formed in both widthwise end portions of the cylindrical external wall 45 at locations adjacent to the base end portion of the guide lever 44 with respect to the clockwise direction of the cylindrical portion 43 as viewed from left side.

The first vents 49 are formed in a rectangular shape as viewed from radially outside.

Also, the cylindrical external wall 45 has second radial lugs 50 which are formed thereon along edges of the first vents 49 and project radially outwardly. The second radial lugs 50 are formed in a rectangular frame-like shape as viewed from radially outside and are formed of elastic material such as rubber or sponge and the like.

The inner housing 42 is formed in the shape of a widthwise elongated hollow cylinder having a smaller diameter than the cylindrical portion 43 of the outer housing 41, and integrally includes a cylinder-like cylindrical internal wall 51 (see FIGS. 3 (*a*) to 3(*c*)), and a pair of disc-like inside side walls 52 for closing both widthwise side surfaces of the cylindrical internal wall 51. An agitator rotating shaft 53 is extended between the inside side walls 52 opposing to each other in the widthwise direction, at circle centers thereof, as shown in FIGS. 3 (*a*) to 3 (*c*). The agitator rotating shaft 53 is rotatably supported on the inside side walls 52. An agitator 56 is provided on the agitator rotating shaft 53. As shown in FIG. 5(*b*), the left side portion of the agitator rotating shaft 53 projects outwardly from the left inside side wall 52 in the widthwise direction, and an agitator gear 100 is provided on the projected portion of the agitator rotating shaft 53. The agitator 56 is rotated by a driving force from a motor (not shown) being input to the agitator gear 100 provided on the agitator rotating shaft 53.

The inside side walls 52 have cylinder-like internal lugs 54 provided at locations on the radially outer side from the agitator rotating shaft 53. The internal lugs 54 project outwardly in the widthwise direction and oppose to each other in the widthwise direction.

The cylindrical internal wall 51 has, in a portion of the circumferential surface thereof, second vents 55 penetrating therethrough it in the thickness direction. The second vents 55 are formed in both widthwise end portions of the cylindrical internal wall 51 thereof. The second vents 55 are formed in a rectangular shape having substantially the same size as the first vents 49 as viewed from radially outside.

The inner housing 42 is fitted in the outer housing 41. Slide packings (not shown) is interposed between both widthwise ends of an outside surface of the cylindrical internal wall 51 and both widthwise ends an inside surface of the cylindrical external wall 45 respectively. Therefore, the outer housing 41 and the inner housing 42 can be freely slid circumferentially relative to each other. Also, the slide packings (not shown) permit an interior of the inner housing 42 to be kept air-tight and liquid-tight to exterior.

In this toner cartridge 40, The outer housing 41 is movable to the toner close position. At the toner close position, the outer housing 41 permits the interior of the inner housing 42 to be sealed hermetically by closing the second vents 55 of the inner housing 42 with the cylindrical external wall 45 except regions where the first vents 49 are formed At the toner close position, the external lugs 47 and the internal lugs 54 are in the same straight line drawn radially outwardly from the agitator rotating shaft 53. On the other hand, the outer housing 41 is movable to the toner open position. At the toner open position, the outer housing 41 permits the interior of the inner housing 42 to be opened by making the first vents 49 and the second vents 55 oppose to each other. At the toner open position, where the external lugs 47, the internal lugs 54, and the agitator rotating shaft 53 are positioned to make a certain angle, as viewed from side elevation.

The inner housing 42 contains toner comprising one positively-charged nonmagnetic component as developing agent. Polymerized toner produced by allowing polymerizable monomer (including, for example, styrene monomer such as styrene etc, and acrylic monomer such as acrylic acid, alkyl (C1-C4) acrylate and alkyl (C1-C4) methacrylate etc) to be copolymerized by suspension polymerization or the like, is used as the toner. The polymerized toner is generally spherical in shape and is so excellent in fluidity that high-definition images can be formed.

Colorant such as carbon black etc, and wax etc are mixed in the toner. In order to improve the fluidity of the toner, additive material, such as silica etc, is also added to the toner. A mean particle diameter of the toner is about 6 micro meter to about 10 micro meter.

As shown in FIGS. 4 (*a*) to 4(*c*), the development left side wall 65 and the development right side wall 66 of the development housing 62 are respectively provided with toner detection windows 57 for detecting a remaining amount of toner accommodated in the toner cartridge 40 at locations corresponding to the toner cartridge 40 when the toner cartridge 40 is accommodated in the toner cartridge accommodation chamber 71.

The main body casing 2 is provided with a toner empty sensor (not shown) including a light emitting element and a light receiving element. The light emitting element (not shown) is disposed at the outside of one of the toner detection windows 57, and the light receiving element (not shown) is disposed at the outside of the other toner detection window 57. A detection beam is output from the light emitting element, then is input into the toner cartridge 40 through the one toner detection window 57. Next, the detection beam is output from the toner cartridge 40 through the other toner detection window 57, then is detected by the light receiving element. Thus, the toner empty sensor judges the remaining amount of toner according to how frequently the detection beam is detected.

When the remaining amount of toner accommodated in the toner cartridge 40 becomes low, a toner-empty warning is displayed in an operation panel (not shown) and the like in accordance with the judgment of the toner empty sensor.

(b-4) Mounting/Dismounting of the Toner Cartridge in/from the Process Cartridge (b-4-i) Mounting of the Toner Cartridge In the laser printer 1, the flat bed unit 6 is opened by being turned around the pivot shaft 8 to open the mounting port 7 of the main body casing 2, as shown in FIG. 2. Then, the process cartridge 21 is exposed from the mounting port 7 and the toner cartridge accommodation chamber 71 of the developer unit 30 is opened toward the upper side.

Then, as shown in FIG. 4 (*c*), the guide lever 44 of the toner cartridge 40 where the outer housing 41 is in the toner close position, is gripped. Then, the toner cartridge 40 is began to be mounted, from above, in obliquely forward and downward direction, in the state where the guide lever 44 is positioned above the cylindrical portion 43. In this way, the toner cartridge 40 is accommodated in the toner accommodation chamber 71. At this time, the external lugs 47 and the internal lugs 54 provided at both widthwise ends portions of the toner cartridge 40 are respectively guided by the linear groove portions 98 of the guide grooves 97, as shown in FIG. 4(*b*).

When the external lugs 47 moving downward along the linear groove portions 98 following the downward movement of the toner cartridge 40 in the toner cartridge accommodation chamber 71, are brought into abutment with the lower end portions of the linear groove portions 98 respectively, the mounting of the toner cartridge 40 in the toner cartridge accommodation chamber 71 is completed. In the toner cartridge 40 accommodated in the toner accommodation chamber 71, the guide lever 44 of the outer housing 41 which is in the toner close position, is positioned so that the distal end portion of the lever 44 is above an upper edge of the main body casing 2 (this position of the guide lever 44 is hereinafter referred to as the second position), as indicated by a broken line of FIG. 2. In detail, distal end of the guide lever 44 which is in the toner close position, is positioned within a semicircular-arc region, as viewed from side elevation, formed as a swinging track of the flat bed unit 6 swinging between its spaced position and its close position.

At this time, as shown in FIG. 4 (*b*), the internal lugs 54 at locations on the radially inner side of the external lugs 47 (or on the agitator rotation shaft 53 side) in the toner cartridge 40, are vertically in the middle of the linear groove portions 98 and do not reach the lower end portions of the linear groove portions 98. Thus, the pivoting of the inner housing 42 is limited. On the other hand, the external lugs 47 abutted with the lower ends of the linear groove portions 98 are respectively opposed to the curved groove portions 99 extending continuously from the linear groove portions 98. Thus, the pivoting of the outer housing 41 is allowed within the range where the external lugs 47 is movable to the curved groove portions 99.

In addition, the shutter 111 arranged in the interior of the above-described toner cartridge accommodation chamber 71, is in the development close position. When the toner cartridge 40 is mounted in the toner cartridge accommodation chamber 71, the first radial lugs 48 of the outer housing 41 penetrates the first penetrate holes 112 of the shutter 111 and are fitted in the circumferential grooves 110 of the curved wall 75, respectively, as shown in FIG. 3(*b*). At the same time as this, lower edges of the second radial lugs 50 of the outer housing 41 are held on the upper edges of the shutter 111, respectively.

Then, when the guide lever 44 is turned around the agitator rotating shaft 53 in the counterclockwise direction, as viewed from right side, the outer housing 41 is moved relative to the inner housing 42 and is shifted from the toner close position to the toner open position, while at the same time, the shutter 111 is pressed by the first radial lugs 48 penetrating the first penetrate holes 112 and is shifted from the development close position to the development open position.

In detail of the outer housing 41, following the pivoting of the guide lever 44, the cylindrical portion 43 provided with the guide lever 44 is also pivoted in the pivoting direction of the guide lever 44 (in the counterclockwise direction, as viewed from right side, described above). Following this movement, as shown in FIG. 4 (*a*), the external lugs 47 which are in abutment with the lower edges of the linear groove portions 98, are guided to pivot in the pivoting direction of the guide lever 44 respectively by the curved groove portions 99 extending continuously from the lower edges of the linear groove portions 98.

When the external lugs 47 are respectively brought into abutment with the other edges of the curved groove portions 99 on the opposite side to one ends thereof extending continuously from the lower edges of the linear groove portions 98, the pivoting of the outer housing 41 or the pivoting of the guide lever 44 and the cylindrical portion 43, is limited. Then, the movement of the outer housing 41 relative to the inner housing 42 from the toner close position to the toner open position, is completed. At this time, the distal edge of the guide lever 44 limited in pivoting, is opposed to the rear edge of the first top wall 115 of the development top wall 67 of the developing unit 30 anteroposteriorly, therefore, the guide lever 44 continues with the first top wall 115 so that the guide lever 44 and the first top wall 115, are abutted with each other slightly upward, as viewed in section from side elevation (this position of the guide lever 44 is hereinafter referred to as the first position).

Also, as shown in FIG. 1, a space is formed between the upper surfaces of the first top wall 115 and guide lever 44 which are continuous with each other, and a lower surface of a paper carrier guide 130 (second guide member) described later of the flat bed unit 6 which is in the close position. This space is defined by the height from the edges of the second guide lugs 92 on the downstream side of the projecting direction to the edges of the second guide ribs 93 on the downstream side of the projecting direction, the width between the widthwise inner edges of the second guide lugs 92 (see FIG. 4(*a*)), the upper surfaces of the guide lever 44 and first top wall 115 which are continuous with each other, and a part of the outer periphery of the cylindrical external wall 45 near the base end portion of the guide lever 44 (an area of the cylindrical external wall 45 opposing to lower surface of the paper carrier guide 130 in FIG. 1). This space forms a part of the transport path of the paper 3, in this space the paper 3 is carried in the image forming operation. At this time, the second guide ribs 93 are disposed to project toward the first top wall 115 and the front ends of the second guide rids 93 are configured put onto the rear end portions of the first guide ribs 91 to allow the paper 3 to be well carried.

As shown in FIG. 2, when the outer housing 41 is in the toner close position, the distal end portion of the guide lever 44 is positioned above the upper edge of the main body casing 2. On the other hand, when the outer housing 41 is moved to the toner open position, the distal end portion of the guide lever 44 is accommodated in the main body casing 2.

Then, following the pivoting of the guide lever 44 and outer housing 41, the first radial lugs 48 which respectively penetrates the first penetrate holes 112 of the shutter 111 and are in engagement with the circumferential grooves 110, as shown in FIG. 3(*a*), are guided by the circumferential grooves 110 to pivot in the pivoting direction of the guide lever 44. The first radial lugs 48 are respectively brought into abutment into the rear edges of the circumferential grooves 110, when the external lugs 47 are respectively brought into abutment with the above-mentioned other edges of the curved groove portions 99.

Also, the shutter 111 which is in the state where the lower edges of the second radial lugs 50 of the outer diameter 41 hold on the upper edge of the shutter 111 and the first radial lugs 48 of the outer housing 41 penetrate the first penetrate holes 112 in the shutter 111 respectively, is also pivoted in the pivoting direction of the guide lever 44 according to that the upper edge of the shutter 111 is pressed by the lower edges of the second radial lugs 50 as well as by the first radial lugs 48 at the first penetrate holes 112. Thus, at the same time when the shift of the outer housing 41 from the toner close position to the toner open position is completed, the shift of the shutter 111 from the development close position to the development open position is also completed.

In the toner cartridge accommodation chamber 71 where the shutter 111 is in the development open position and the toner cartridge 40 where the outer housing 41 is in the toner open position, the introduction ports 88 of the toner cartridge accommodation chamber 71 are respectively opposed to the first vents 49 and the second vents 55 of the toner cartridge 40 which are in the opposed relation to each other. Therefore, the interior of the inner housing 42 of the toner cartridge 40 and the interior of the developing chamber 72 of the developing unit 30 communicate with each other through the introduction ports 88, the first vents 49, and the second ports 55.

Also, the second radial lugs 50 are brought into abutment with the introduction ports 88 respectively to close around the introduction ports 88, so that the introduction ports 88 and the first vents 49 are shielded to prevent leaking of the toner to the exterior.

As described above, the outer housing 41 is pivoted from the toner close position to the toner open position, where as the inner housing 42 is circumferentially slidable relative to the outer housing 41. Also, the internal lugs 54 are respectively vertically in the middle of the linear groove portions 98 and do not reach the lower end portions of the linear groove portions 98, and are not opposed to the curved groove portions 99. Thus, the inner housing 42 is restrained from pivoting together with the outer housing 41 following the pivoting of the guide lever 44.

(b-4-ii) Dismounting of the Toner Cartridge

When the guide lever 44 is operated to pivot in the clockwise direction, as viewed from right side, in the state where the shutter 111 is in the development open position and the outer housing 41 is in the toner open position with respect to the inner housing 42, the outer housing 41 is shifted relative to the inner housing 42 from the toner open position to the toner close position. At the same time the shutter 111 is shifted from the development open position to the development close position by being pressed by the first radial lugs 48 respectively penetrating the first penetrate holes 112. Since the second top wall 116 is concaved with a step to form a space between the second top wall 116 and the guide lever 44, the guide lever 44 can be operated easily by inserting a finger in the space.

In detail, in the outer housing 41 following the pivoting of the guide lever 44, the cylindrical portion 43 provided with the guide lever 44 thereon is also pivoted in the pivoting direction of the guide lever 44 (in the clockwise direction described above), as shown in FIG. 4 (*b*). Along with this, the external lugs 47 respectively abutting with the above-described other edges of the curved groove portions 99 (see FIG. 4(*a*)) are also guided by the curved groove portions 99 to pivot in the pivoting direction of the guide lever 44.

When the external lugs 47 reach the lower end portions of the linear groove portions 98 continuous with one end portions of the curved groove portions 99 respectively, the pivoting of the outer housing 41, or the pivoting of the guide lever 44 and the cylindrical portion 43, is restricted, so that the shift of the outer housing 41 from the toner open position to the toner close position relative to the inner housing 42 is completed.

Then, following the pivoting of the guide lever 44 and the cylindrical portion 43, the first radial lugs 48 penetrating the first penetrate holes 112 of the shutter 111 and fitted in the circumferential grooves 110 are respectively also guided by the circumferential grooves 110 to pivot in the pivoting direction of the guide lever 44, as shown in FIG. 3(*b*). At the same time when the external lugs 47 reach the lower end portions of the linear groove portions 98 continuous with one end portions of the curved groove portions 99, respectively the first radial lugs 48 are brought into abutment with the front edges of the circumferential grooves 110 respectively.

The shutter 111, where the first penetrate holes 112 are penetrated respectively by the first radial lugs 48 of the outer housing 41, is also pivoted in the pivoting direction of the guide lever 44. Therefore, at the same time when the shift of the outer housing 41 from the toner open position to the toner close position is completed, the shift of the shutter 111 from the development open position to the development close position is also completed.

After the completion of the shift of the outer housing 41 from the toner open position to the toner close position and the shift of the shutter 111 from the development open position to the development close position, the toner cartridge 40 is dismounted from the toner cartridge accommodation chamber 71 to an obliquely rearward and upward direction, as shown in FIG. 3(*c*). Then, the first radial lugs 48 are respectively spaced away from the first penetrate holes 112 of the shutter 111 and the circumferential grooves 110 of the curved wall 75 respectively, also the second radial lugs 50 of the outer housing 41 are spaced away from the shutter 111 respectively.

Then, as shown in FIG. 4(*c*), the toner cartridge 40 is raised up with its external lugs 47 and internal lugs 54 guided by the linear groove portions 98 of the guide grooves 97 respectively. When the external lugs 47 and the internal lugs 54 are released from the linear groove portions 98 respectively, the dismounting of the toner cartridge 40 from the toner cartridge accommodation chamber 71 is completed.

(b-5) Developing /Transferring Operation

When an image is formed by the laser printer 1 after the toner cartridge 40 is accommodated in the toner cartridge accommodation chamber 71, as described above (b-4-i), the driving force from the motor (not shown) is input to the agitator rotating shaft 53 through the agitator gear 100. Then, the agitator rotating shaft 53 is rotated in the clock wise direction as viewed in right side, so that the agitator 56 is moved around the agitator rotation shaft 53 circumferentially in the inside of the inner housing 42, as shown in FIG. 3(*a*). Then, the toner accommodated in the toner cartridge 40 is agitated by the agitator 56 and is discharged into the developing chamber 72 via the first vents 49, the second vents 55, and the introduction ports 88.

The toner discharged from the introduction ports 88 into the developing chamber 72 is fed onto the developer roller 104 by the rotation of the feed roller 101, during which the toner is positively by friction charged between the feed roller 101 and the developer roller 104. Following the rotation of the developer roller 104, the toner fed onto the developer roller 104 goes between the pressing portion 108 of the layer-thickness regulating blade 107 and the rubber roller 106 of the developer roller 104 and is carried on the developer roller 104 in the form of a thin layer having a uniform thickness.

Along with the rotation of the photosensitive drum 28, a surface of the photosensitive drum 28 is positively charged uniformly by the scorotron charger 29, at first. Then, the surface of the photosensitive drum 28 is exposed to light from the scanner 20 by high-speed scanning using laser beam, to form thereon an electrostatic latent image corresponding to an image to be formed on the paper 3.

Then, when the toner carried on the developer roller 104 and positively charged is opposed to and brought into contact with the photosensitive drum 28 by the rotation of the developer roller 104, the toner is fed to the electrostatic latent image formed on the surface of the photosensitive drum 28, in other words, the toner is fed to the exposed part of the uniformly-positively-charged surface of the photosensitive drum 28, which is exposed to the laser beam and drops in electric potential. As a result, the electrostatic latent image on the surface of the photosensitive drum 28 is converted to a visible image and the visible toner image created by the reversal developing process is carried on the surface of the photosensitive drum 28.

Thereafter, the toner image carried on the surface of the photosensitive drum 28 is sent by the registration roller 16. During the time when the paper 3 which enters the drum housing 76 from the first passing port 84 passes the transfer position between the photosensitive drum 28 and the transfer roller 31, the toner image is transferred to the paper 3 by the transfer bias applied to the transfer roller 31.

As shown in FIG. 1, the paper 3 is turned forward around the separation roller 10 in a generally U-shape and then is moved onto the toner cartridge 40. After passing through the space between the upper surface of the first top wall 115 of the developing unit 30 and the guide lever 44 which is in the toner open position, and the lower surface of the flat bed unit 6, the paper 3 enters the first passing port 84 of the drum portion 27 and reaches the transfer position.

Then, the paper 3 onto which the toner image was transferred is ejected from the second passing port 85 to the exterior of the drum housing 76 and thereafter is sent to the fixation unit 22. The paper 3 is carried generally horizontally from the transfer position to the fixation unit 22.

The remaining toner left on the photosensitive drum 28 after transfer is collected by the developer roller 104.

(c) Fixation Unit

The fixation unit 22 is arranged to be adjacent to and above the scanner 20 and also arranged in front of the process cartridge 21. The fixation unit 22 comprises a fixation frame 58, a heating roller 59, a pressing roller 60, and a paper ejection roller 96. The heating roller 59, the pressing roller 60, and the paper ejection roller 96 are provided in the fixation frame 58.

The heating roller 59 includes a metal pipe whose surface is coated with a fluorine resin, and a halogen lamp, inserted in the metal pipe, for heating. The heating roller 59 is rotationally driven by a driving force input from a motor (not shown).

The pressing roller 60 is disposed opposite to and above the heating roller 59 to press it. The pressing roller 60 includes a metal roller shaft, and a rubber roller formed of rubber material and covering the roller shaft. The pressing roller 60 is driven following the rotational drive of the pressing roller 59.

The paper ejection rollers 96 comprises a pair of rollers and are disposed on the downstream side of the paper transporting direction with respect to the heating roller 59 and the pressing roller 60.

The toner image transferred on the paper 3 at the transfer position is thermally fixated at the fixation unit 22 during the time when the paper 3 passes through between the heating roller 59 and the pressing roller 60. The paper 3 on which the toner image was fixated is carried toward the paper ejection tray 95 by the paper ejection rollers 96 through an ejection port 148. The paper 3 is sent horizontally from the fixation unit 22 to the ejection port 148.

(4) Ejection Section

Figure 7:
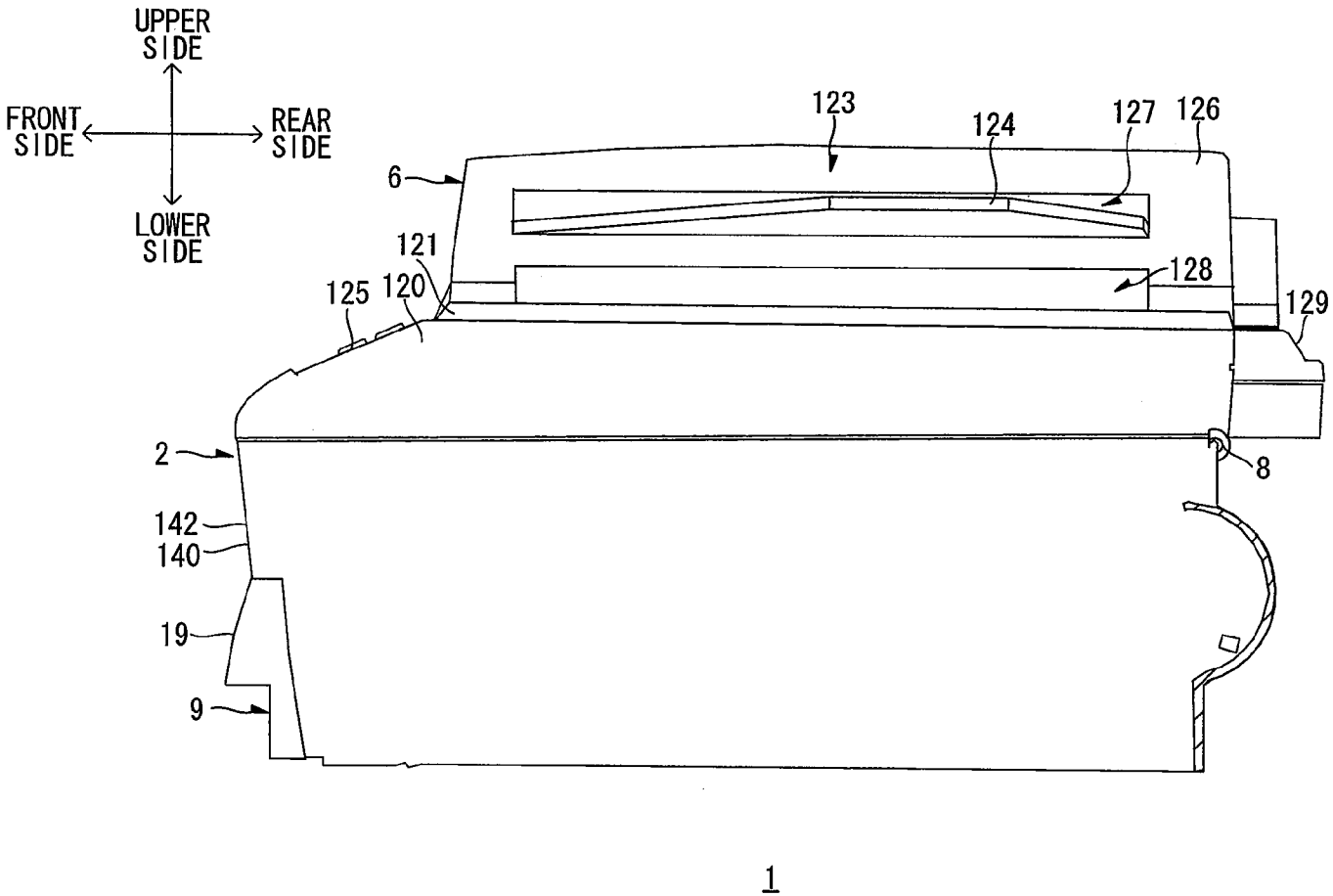
FIG. 7 is a right side view of the laser printer shown in FIG. 1.
Figure 8:
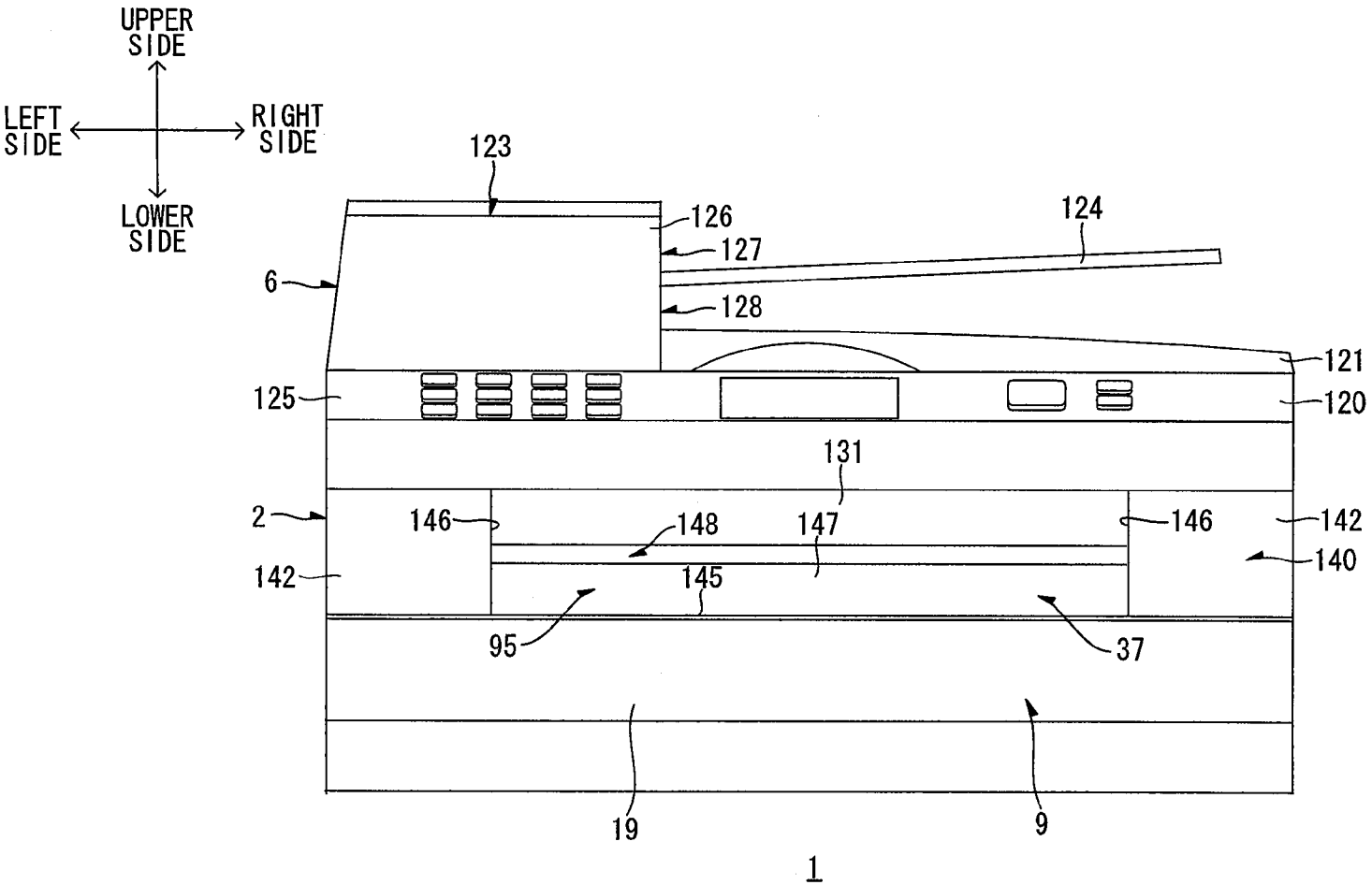
FIG. 8 is a front view of the laser printer shown in FIG. 1.

FIG. 7 is a right side view of the laser printer shown in FIG. 1, and FIG. 8 is a front view of the laser printer shown in FIG. 1.

The ejection section 37 includes the paper ejection tray 95 and the ejection port 148 on the front side of the main body casing 2.

As shown in FIG. 8, the front side wall 140 of the main body casing 2 is provided on both ends thereof with a pair of front end walls 142. The front side wall 140 has the paper ejection tray 95 concaved rearwards thereof in a region thereof sandwiched widthwise between the pair of front end walls 142, as shown in FIG. 1. The paper ejection tray 95 is disposed to overlap upwardly with a front half portion of the paper feed tray 9 and the scanner 20.

In detail, as shown in FIG. 8, the paper ejection tray 95 has an ejection bottom wall 145, a pair of ejection side walls 146, and an ejection rear wall 147 (ejection wall). The ejection bottom wall 145 is formed in a generally rectangular plate form, as viewed from top, extending rearwards continuously from a lower edge of the front side wall 140 at the portion thereof which is widthwise sandwiched between the pair of front end walls 142.

The pair of ejection side walls 146 are extended upwards from both widthwise edge of the ejection bottom wall 145 to oppose to each other. Upper edges of the ejection side walls 146 are flush with upper edge of the front side walls 140.

The ejection rear wall 147 is formed in a rectangular plate form, as viewed from front, extends upwards continuously from a rear edge of the ejection bottom wall 145 and is extended between generally lower half portions of the ejection side walls 146. The ejection rear wall 147 is placed adjacent to and in front of the fixation unit 22, as shown in FIG. 1. Therefore, an upper edge of the ejection rear wall 147 is at a generally vertical center of the ejection side wall 146.

When the flat bed unit 6 is closed and the mounting port 7 in the main body casing 2 is closed, the paper ejection tray 95 is closed on the top side by the lower surface of the flat bed unit 6, while is opened on the front side. When the flat bed unit 6 is opened and the mounting port 7 is opened, the paper ejection tray 95 is opened on the top side as well, as shown in FIG. 2.

The flat bed unit 6 has a scanner-side ejection rear wall 131 formed on a lower surface of a document mounting table 120 described later at a generally anteroposterior center and a widthwise center there of, extending downwardly from the lower surface of the document mounting table 120. The scanner-side ejection rear wall 131 is formed in a rectangular form, as viewed from front, having the same size as the ejection rear wall 147 of the main body casing 2, as shown in FIG. 8. When the flat bed unit 6 is closed and the mounting port 7 of the main body casing 2 is closed, the lower edge of the scanner-side ejection rear wall 131 is opposed to the upper edge of the ejection rear wall 147 at a vertically spaced interval, as shown in FIG. 1. The interval is larger than the thickness of the paper 3 and serves as the ejection port 148 for allowing the fixation unit 22 and the paper ejection tray 95 to communicate with each other.

The paper 3 thermally fixated in the fixation unit 22 is ejected onto the ejection bottom wall 145 of the paper ejection tray 95 through the ejection port 148 by the paper ejection rollers 96.

(5) Flat Bed Unit (a) Overall structure of the flat bed unit

Figure 9:
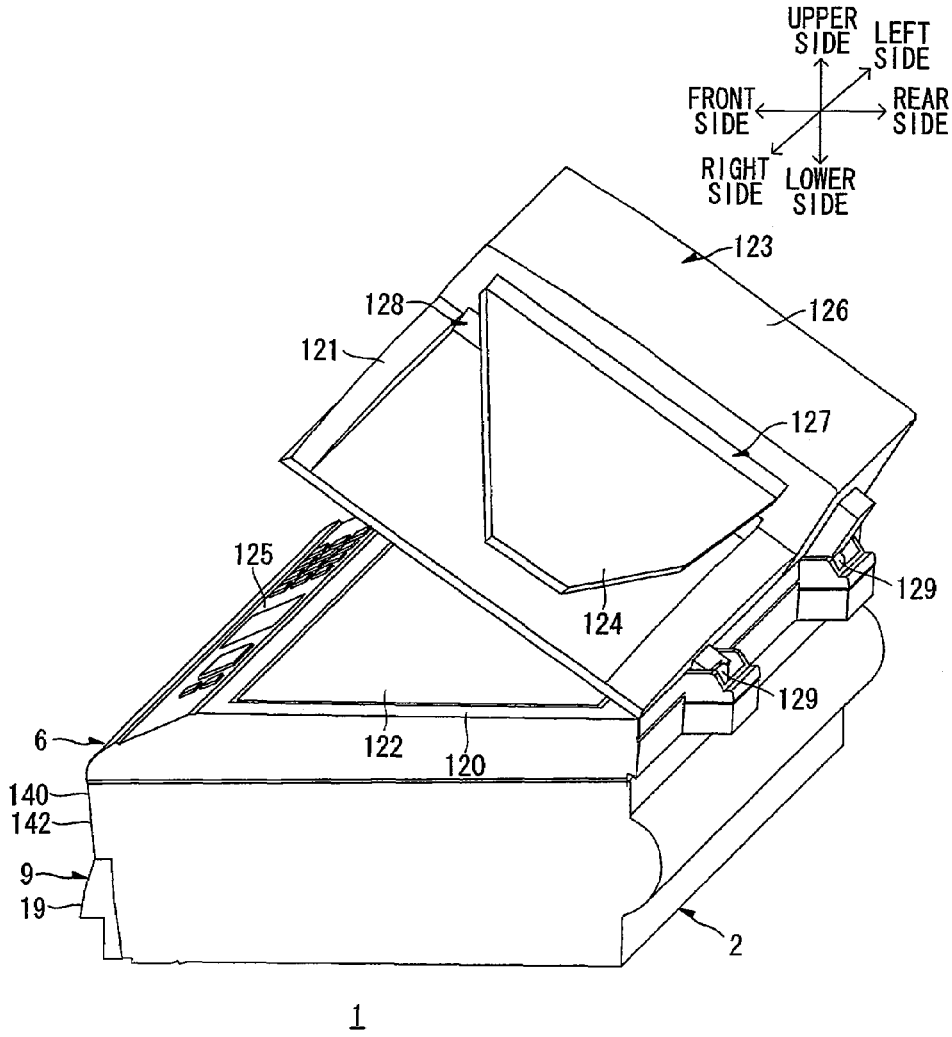
FIG. 9 is a right-side perspective view of the laser printer shown in FIG. 1, as viewed from above and behind, showing the state of a front end portion of a document holding cover being lifted up to open a glass surface of a document mounting table.

FIG. 9 is a right-side perspective view of the laser printer shown in FIG. 1, as viewed from above and behind, and shows the state where a front end portion of a document holding cover is lifted up to open a glass surface of the document mounting table.

The flat bed unit 6 is in a generally square form, as viewed from top, and includes the document mounting table 120, and a document holding cover 121 supported on the document mounting table 120 in a freely open/close manner, as shown in FIG. 9.

The document mounting table 120 is formed in generally rectangular thick plate, as viewed from top. The document mounting table 120 has a glass surface 122 formed on an upper surface thereof for putting a document thereon, an operation panel 125 formed on a front end portion thereof, and the above-mentioned scanner-side ejection rear wall 131 (see FIG. 2) and the paper carrier guide 130 (see FIG. 2) both of which are formed on a lower surface thereof.

The glass surface 122 is formed by embedding a sheet of glass in the document mounting table 120 so that the upper surface of the document mounting table 120 is flat. The glass surface 122 is in a rectangular form, as viewed from top, whose anteroposterior dimension extends along the anteroposterior direction of the document mounting table 120.

The document mounting table 120 has a CCD sensor (not shown) for scanning the document and a scan motor (not shown) for moving the CCD sensor for the scanning in the state of facing the glass surface 112.

The CCD sensor (not shown) is supported to be movable in a transverse direction on the inner side (under side) of the glass surface 122 and is normally on standby at the left end of the glass surface 122. In the usual scanning of the document, the CCD sensor is moved for the scanning from the left side to the right side in the state of facing the glass surface 112 by the scan motor (not shown).

The operation panel 125 is arranged on the front end portion of the flat bed unit 6 and includes a liquid crystal panel for indicating an operational state of the laser printer 1 and the like, and key-buttons and the like which a user can operate for setting various conditions.

The paper carrier guide 130 is formed to be elongated in the transverse direction and is also formed to be gently concaved upward so that when the flat bed unit 6 is closed and the mounting port 7 at the top of the main body casing 2 is closed, the paper carrier guide 130 can extend along the upper surface of the first top wall 115 and the guide lever 44 in a spaced relation, as shown in FIG. 1.

One of the pair of registration rollers 16 above-mentioned is freely rotatably supported by the paper carrier guide 130 at the rear and lower end portion thereof.

The document holding cover 121 is formed in a thin rectangular plate having the same shape as the document mounting table 120, as shown in FIG. 9. The document holding cover 121 is provided on the left end portion of its upper surface, with an ADF (automatic document feeder) 123 (feed unit) for automatically reading the document. The ADF 123 includes a casing 126, a document feed roller (not shown), a document feed motor (not shown), and a document detection sensor (not shown). The casing 126 is formed in a box elongated in the anteroposterior direction and has the document feed roller (not shown) and the document feed motor (not shown) built therein, and a standby document tray 124 arranged on the right side wall at a vertical center portion thereof, as shown in FIG. 8. The stand by document tray 124 is in the form of a thin plate of a generally trapezoidal form as viewed from top (see FIG. 9). The standby document tray 124 is supported by the ADF 123 with its bottom portion of the general trapezoid as a base end portion, and its distal end portion extended rightwards in a generally horizontal direction. The standby document tray 124 can permit documents to be set in a stacked relation.

The right side wall of the casing 126 has a document intake port 127 formed on an upper side of the standby document tray 124 for taking the document in an interior of the casing 126, and a document ejection port 128 formed on a lower side of the standby document tray 124 for ejecting the document from the casing 126, as shown in FIG. 7. The document intake port 127 and the document ejection port 128 are both formed in a rectangular shape elongated in the anteroposterior direction.

The document holding cover 121 is swingably supported at a rear end portion thereof by a rear end portion of the document mounting table 120 via hinges 129, as shown in FIG. 9.

A front end portion of the document holding cover 121 is swung vertically around the hinges 129 at the rear end portion. When a front end portion of the document holding cover 121 is lifted up, the glass surface 122 of the document mounting table 120 is exposed. On the other hand, when the front end portion of the document holding cover 121 is lifted down, the glass surface 122 of the document mounting table 120 is covered. Thus, the glass surface 122 of the document mounting table 120 is covered by the document holding cover 121 in a freely opened and closed manner.

(b) Normal Scanning of the Document by the Flat Bed Unit

In the flat bed unit 6, the front end portion of the document holding cover 121 is lifted up and the document is set on the glass surface 122. Then, the front end portion of the document holding cover 121 is lifted down and the command is entered with the buttons on the operation panel 125. Then, the CCD sensor (not shown) is moved from the left side toward the right side, in the state of facing the document put on the glass surface 122, to scan the image data of the document.

After completion of the scanning of the document, the front end portion of the document holding cover 121 is lifted up again and the document is taken away from the glass surface 122. After the completion of the scanning, the CCD sensor (not shown) is automatically moved back to the left end of the glass surface 122 by the scan motor (not shown) and is held in a standby state there.

(c) Automatic Scanning of the Document by the Flat Bed Unit

In the automatic scanning of the document by the ADF 123, when the document put on the standby document tray 124 is detected by the document detection sensor (not shown), the CCD sensor (not shown) is fixed at an automatic document scanning position, not shown, differently from the normal scanning of the document described above. Then, when a user enters a command with the buttons on the operation panel 125, the document feed motor (not shown) is driven to rotate the document feed roller (not shown) by the driving force from the motor. Following the rotation of the document feed roller (not shown), the document is moved leftwards and is taken in the interior of the casing 126 via the document intake port 127. When the document taken in passes through the document carrying path (not shown) and is brought into a position opposing to the CCD sensor (not shown), image data of the document is scanned by the scanning of the CCD sensor (not shown). Thereafter, the document is moved rightwards from the document ejection port 128 and ejected onto an upper surface of the document holding cover 121.

(d) Image Formation Based on Image Data of the Scanned Document

As shown in FIG. 1, in the image forming section 5, the image data is created based on the above-mentioned image data of the document scanned by the CCD sensor (not shown) and the image is formed on the paper 3, as described above.

2. Operation and Effect

As described above, in this laser printer 1, the paper 3 is fed from the paper feed tray 9, then turned forward around the separation roller 10 in a generally U-shape, and then moved above the toner cartridge 40. Then, after passing through the space, which is formed between the upper surface of the first top wall 115 of the developing unit 30 and the upper surface of the guide lever 44 being continuous with the first top wall 115 in the toner open position, and the lower surface of the flat bed unit 6, and which serves as a part of the transport path, and through the transfer position of the process cartridge 21, the fixation unit 22 and the ejection port 148, the paper 3 is ejected onto the paper ejection tray 95.

Thus, the transport path of the paper 3 can be formed to sandwich the toner cartridge 40 vertically between an upper part and a lower part of the transport path. Further, the transport path can be increased in radius of curvature at the U-turn point. These can provide a reliable transport of the paper 3 with a reduced risk of paper jam. Further, since the paper 3 is carried over the process cartridge 21, when a paper jam occurs, the paper 3 can be easily removed.

The guide lever 44 can permit smooth transport of the paper 3 passing over the toner cartridge 40.

In addition, since the guide lever 44 forms a part of the transport path, as described above, the guide lever 44 can serves also as a part of the components forming the transport path. Thus, as compared with a transport path formed by a separate component, the number of components forming the transport path can be reduced, and as such can allow reduction in size of the laser printer 1.

Further, since the scanner 20 is disposed adjacent to and below a front half portion of the process cartridge 21 in an underlapped relation in the transport path of the paper 3 forming the U-turn portion described above, a vertical space between the process cartridge 21 and the paper feed tray 9 can be utilized effectively. Particularly since the toner cartridge 40 is not overlapped with the scanner 20, the vertical space can be reduced, while the toner accommodating capacity of the toner cartridge 40 can be increased.

This can allow reduction in vertical size of the laser printer 1, and as such can allow reduction in overall size of the laser printer 1.

Also, the paper ejection tray 95 of the ejection portion 37 is disposed to overlap upwardly with the paper feed tray 9 so that the internal ejection of the paper 3 can be achieved. This can allow reduction in anteroposterior dimension of the laser printer 1, and as such can also allow reduction in overall size of the laser printer 1.

Further, the paper 3 is reliably ejected onto the ejection bottom wall 145 of the paper ejection tray 95 via the ejection port 148 formed in the ejection rear wall 147 disposed adjacent to and in front of the fixation unit 22. Hence, reliable carriage of the paper 3 to the paper ejection tray 95 can be achieved.

The ejection rear wall 147 is disposed adjacent to and in front of the fixation unit 22. In other words, the ejection rear wall 147 is positioned midway of the paper feed tray 9 in the anteroposterior direction. This arrangement enables the paper ejection tray 95, which is formed by the ejection rear wall 147, the ejection bottom wall 145 extending forwardly continuously from the ejection rear wall 147, and a pair of ejection side walls 146, to be placed to overlap upwardly with the paper feed tray 9, thus reduction in overall size of the laser printer 1 can be achieved.

The paper ejection tray 95 is in the form of a space closed on the left, right, top and bottom sides thereof defined by the pair of ejection side walls 146, and the lower surface of the flat bed unit 6 in the close position, and the ejection bottom wall 145. This configuration can ensure that the paper 3 ejected from the ejection port 148 of the ejection rear wall 147 can be reliably stacked up on the paper ejection tray 95. Further, this configuration can contribute to increase in overall rigidity of the laser printer 1. Accordingly, when the flat bed unit 6 on the top side of the laser printer 1 is in operation, undesirable vibration of the entire laser printer 1 can be prevented.

Also, since the paper feed tray 9 is in the form of a box opening at the top, the paper 3 can be stacked up on it.

Accordingly, the convenience of the laser printer 1 can be enhanced.

The scanner 20 is placed adjacent to the paper feed tray 9 so that it can overlap upwardly with an area of the paper feed tray 9 extending from a front end portion thereof to a portion on a slightly far side from an anteroposterior center thereof and, also is placed adjacent to the paper ejection tray 95 so that its front half portion can overlap downwardly with the paper ejection tray 95. This arrangement can allow reduction in anteroposterior dimension of the laser printer 1.

This can also allow reduction in overall size of the laser printer 1.

Also, the paper ejection tray 95 is configured to be concaved rearwards in a region sandwiched widthwise between the pair of front end walls 142, of the front side wall 140 of the main body casing 2. This can achieves that a user can take the paper 3 ejected on the paper ejection tray 95 from the front side of the main body casing 2. Also, when the user stands at the front side of the main body casing 2 at which the paper ejection tray 95 is formed and moves the flat bed unit 6 to a spaced position, the mounting port 7 is opened to the front side widely. The user can mount and dismount the toner cartridge 40 in and from the main body casing 2 through the mounting port 7 by inserting the toner cartridge 40 to the obliquely backward and downward direction (mounting direction) and pulling it out to the obliquely forward and upward direction (dismounting direction).

Thus, the user can stand at the same position not only when the user takes the ejected paper 3 from the main body casing 2 but also when the user replaces the old toner cartridge 40 with the new one, thereby providing improved operability of the laser printer 1.

Just like the paper ejection tray 95 formed on the front side of the main body casing 2, the paper feed tray mounting port 141 is also formed on the front side of the main body casing 2.

Thus, the user can mount and dismount the paper feed tray 9 in and from the main body casing 2 through the paper feed tray mounting port 141 in the anteroposterior direction without changing standing position from the front side of the main body casing 2, thereby convenience of the laser printer 1 is enhanced.

When the guide lever 44 is in the toner open position, the guide lever 44 takes the first position at which the guide lever 44 is continuous with the first top wall 115 and serves as a part of the transport path extending along the transport path of the paper 3. This can bring the transport path into completion to achieve reliable and smooth transport of the paper 3 along the transport path.

On the other hand, when the guide lever 44 is in the toner close position, the guide lever 44 takes the second position at which the guide lever 44 is discontinuous with the first top wall 115 and intersects with the transport path. This can bring the transport path into incompletion to surely stop the transport of the paper 3.

Thus, a reliable transport of the paper 3 can be obtained.

The second guide lugs 92 are provided on the upper surface of the guide lever 44 in such a manner as to project in the thickness direction of the paper 3 carried over the upper surface of the guide lever 44. These second guide lugs 92 can surely form a space which forms a part of the transport path of the paper 3 between the upper surface of the guide lever 44 and the lower surface of the flat bed unit 6.

Therefore, since the paper 3 passes through the space, a smooth transport of the paper 3 can be achieved.

Also, there are provided a plurality of second guide ribs 93 equally spaced along the widthwise direction, comprising ridges which are provided between the second guide lugs 92 opposing to each other in the widthwise direction and are projected in the same direction as the second guide lugs 92 and are extended in a direction along the paper transporting direction in the image forming operation.

Due to these second guide ribs 93, the paper 3 can be carried with reduced friction.

In addition, the second guide ribs 93 are formed to project from the upper surface of the guide lever 44 to a smaller extent than the second guide lugs 92 projecting from the upper surface of the guide lever 44, and the difference therebetween is larger than the thickness of the paper 3.

As a result, the space which forms a part of the transport path above-mentioned of the paper 3 is reliably secured between the edge of the second guide lugs 92 on the downstream side of the projecting direction, to the edge of the second guide ribs 93 on the downstream side of the projecting direction. Thus, a reliable transport of the paper 3 along the second guide ribs 93 can be achieved.

Also, the flat bed unit 6 is provided, on its lower surface, with the paper carrier guide 130, and the above-said space which forms a part of the transport path of the paper 3 is formed between the upper surface of the top wall 115 and the upper surface of the guide lever 44, and the lower surface of the paper carrier guide 130.

Thus, a smooth transport of the paper 3 can be provided by the paper carrier guide 130.

Also, only the above-mentioned space exists between the upper surface of the top wall 115 and the upper surface of the guide lever 44, and the lower surface of the paper carrier guide 130, and no component is interposed therebetween.

This can achieve reduction in vertical size of the laser printer 1 to achieve reduction in overall size of the laser printer 1.

The paper 3 is turned forward around the separation roller 10 in a generally U-shape, followed by the image formation, and then is ejected to the paper ejection tray 95 formed on the front side of the main body casing 2, as described above. On the other hand, in the flat bed unit 6, the document, after scanned by ADF 123 to obtain the image data, is carried rightwards from the document ejection port 128 and ejected onto the upper surface of the document holding cover 121.

Thus, the document carrying direction and the paper transporting direction are orthogonalized when vertically projected on the same plane. This can achieve reduction in size of the laser printer 1 with respect to the paper transporting direction, as compared with the case of both directions being oriented to the same direction. When the operation panel 125 is provided in the space then formed, the user can operate the operation panel 125 without changing standing position from the side of the main body casing 2 on the downstream side of the paper ejection direction (i.e., the front side), thereby convenience of the laser printer 1 is significantly enhanced.

This can achieve the result of reduction in size of the laser printer 1.

Both the main body casing 2 and the flat bed unit 6 are configured in a generally square form as viewed from top. This enables the dimension of the laser printer 1 extending in the document carrying direction or the transverse direction, and the dimension of the same extending in the paper transporting direction or the anteroposterior direction to be substantially equal to each other and to be reduced.

This enables the laser printer 1 to be configured in a generally square form, as viewed from top to minimize the footprint thereof, thus enabling miniaturization of the laser printer 1.

Further, in this laser printer 1, the paper 3 is fed from the paper feed tray 9, then turned forward around the separation roller 10 in a generally U-shape, and then moved over the toner cartridge 40. Then, after passing the space, which is formed between the upper surface of the first top wall 115 of the developing unit 30, the upper surface of the guide lever 44 being continuous with the first top wall 115 in the toner open position, and a part of the outer periphery of the cylindrical external wall 45 adjacent to the base end portion of the guide lever 44, and the lower surface of the flat bed unit 6, which serves as a part of the transport path, the paper 3 is ejected onto the paper ejection tray 95.

This enables the transport path of the paper 3 to increase in radius of curvature at the U-turn point, and can achieve a reliable feed of the paper 3 with a reduced risk of paper jam. Further, since the paper 3 is carried over the process cartridge 21, when a paper jam occurs, the paper 3 can be easily removed.

The guide lever 44, when taking the toner open position, forms a part of the transport path. Thus, the guide lever 44 can also serve as a part of the components forming the transport path. Hence, as compared with a transport path formed by separate components, the number of components forming the transport path can be reduced, and this can allow reduction in size of the laser printer 1.

Also, this guide lever 44 can operate to facilitate the replacement of the toner cartridge.

Further, since the guide lever 44 also serves as a gripped portion to be gripped when the toner cartridge 40 is mounted and dismounted in and from the laser printer 1, the toner cartridge 40 can be replaced with further ease by gripping the guide lever 44.

When the guide lever 44 takes the toner open position, the first vents 49 of the outer housing 41 and the second vents 55 of the inner housing 42 oppose to each other respectively to open the interior of the inner housing 42 of the toner cartridge 40 containing the toner, while at the same time, the guide lever 44 forms a part of the above-mentioned transport path of the paper 3 and thereby the transport path is brought into completion. Thus, a reliable ejection of the toner from the each first vent 49 and a reliable transport of the paper 3 can be achieved.

On the other hand, when the guide lever 44 takes the toner close position, the second vents 55 are closed by the cylindrical external wall 45, except an area thereof where the first vents 49 are formed, to seal the interior of the inner housing 42, while at the same time, the guide lever 44 comes to be discontinuous with the first top wall 115 to prevent the formation of part of the transport path of the paper 3, so that the transport path of the paper 3 is not completed. Thus, the transport of the paper 3 and the ejection of the toner can be reliably stopped.

This can produce the result that operation reliability of the laser printer 1 can be improved.

Also, when the guide lever 44 takes the toner open position, the first vents 49 and the second vents 55 opposed to each other respectively to open the interior of the inner housing 42 containing the toner, while at the same time, the shutter 111 is shifted to the development open position to open the introduction ports 88 formed in the development housing 62 of the developing unit 30. As a result of this, the interior of the inner housing 42 and the interior of the developing chamber 72 of the developing unit 30 communicate with each other through the introduction ports 88, the first vents 49, and the second vents 55.

Thus, a reliable ejection of the toner from the interior of the inner housing 42 of the toner cartridge 40 and a reliable introduction of the toner into the interior of the developing chamber 72 of the developing unit 30 can be achieved.

On the other hand, when the guide lever 44 takes the toner close position, the second vents 55 are closed by the cylindrical external wall 45, except an area thereof where the first vents 49 are formed, while at the same time, the introduction ports 88 are closed by the shutter 111.

Thus, the ejection of the toner from the interior of the inner housing 42 and the introduction of the toner into the interior of the developing chamber 72 can be reliably prevented, and this can reliably prevent leakage of the toner.

As a result of this, the toner cartridge 40 can be taken out, while preventing the leakage of the toner therefrom. Also, leakage of the toner from the interior of the developing chamber 72 of the development housing 62 after dismounting the toner cartridge 40, can be prevented.

When the guide lever 44 is in the toner open position, the guide lever 44 takes the first position (above-mentioned) at which the guide lever 44 is continuous with the first top wall 115 and thereby forms the above-mentioned part of the transport path along the transport path of the paper 3. This can bring the transport path into completion to achieve reliable and smooth transport of the paper 3 along the transport path.

On the other hand, when the guide lever 44 is pivoted around the agitator rotating shaft 53 and is in the toner close position, the guide lever 44 takes the second position at which the guide lever 44 is discontinuous with the first top wall 115 and intersects with the transport path. As a result of this, the transport path is brought into incompletion to surely stop the transport of the paper 3.

Thus, when the guide lever 44 is in the toner open position, the completion of the transport path and the opening of the introduction ports 88, the first vents 49 and the second vents 55 can be synchronized with each other to ensure a reliable image forming. On the other hand, when the guide lever 44 is in the toner close position, the incompletion of the transport path and the closing of the introduction ports 88, the first vents 49 and the second vents 55 can be synchronized with each other to provide a reliable mount and dismount of the toner cartridge 40.

This can produce the result that operation reliability of the laser printer 1 can be further improved.

The guide lever 44 in the toner open position faces the flat bed unit 6 in its closed position, and the space between the upper surface of the guide lever 44 and the lower surface of the flat bed unit 6, forms a part of the transport path, as described above. This can provide the result that when the paper 3 carried is jammed in the transport path, the jammed paper 3 can be removed easily by moving the flat bed unit 6 to the spaced position to open the mounting port 7 and expose the jammed paper 3 from the mounting port 7.

The guide lever 44 is exposed from the mounting port 7 by the movement of the flat bed unit 6 to the spaced position. This can produce the advantage that when the toner cartridge 40 is dismounted from the main body casing 2, the exposed guide lever 44 can be gripped to take out the toner cartridge 40 from the main body casing 2 with ease.

Thus, an easy clearance of the paper jam and an easy replacement of the toner cartridge 40 can be achieved.

When the guide lever 44 is in the toner close position, the guide lever 44 takes a position where its distal end portion thereof is positioned above the upper edge of the main body casing 2. In detail, the distal end portion of the guide lever 44 which is in the toner close position is positioned within a semicircular-arc region, as viewed from side elevation, formed as a swinging track of the flat bed unit 6 swinging between its spaced position and its close position.

As a result of this, when the flat bed unit 6 is moved to its close position, the lower surface of the flat bed unit 6 is brought into abutment with the distal end portion of the guide lever 44 in the midway of the movement, so that the flat bed unit 6 cannot be moved to its close position.

On the other hand, when the guide lever 44 is in the toner open position, the distal end portion of the guide lever 44 is accommodated in the main body casing 2, so that the flat bed unit 6 can be moved to its close position.

This can provide the advantage that the image forming operation can be initiated without fail after the time when the movement of the guide lever 44 toward the toner open position to open the introduction ports 88, the first vents 49 and the second ports 55, and the movement of the flat bed unit 6 to its close position are completed.

Also, since the user can easily judge whether the guide lever 44 is in the toner close position or in the toner open position from whether the flat bed unit 6 can be closed or not, the operability can be improved.

The second guide lugs 92 are provided on the upper surface of the guide lever 44 in such a manner as to project in the thickness direction of the paper 3 passing over the upper surface of the guide lever 44. These second guide lugs 92 can surely form a space which forms a part of the transport path of the paper 3 between the upper surface of the guide lever 44 and the lower surface of the flat bed unit 6.

Therefore, since the paper 3 can pass through the space, a smooth transport of the paper 3 can be achieved.

Also, when the pivoting of the toner cartridge 40 is insufficient, so that the guide lever 44 is displaced from the first position, such a displacement can be corrected by pressing the second guide lugs 92.

Also, there are provided a plurality of second guide ribs 93 equally spaced along the widthwise direction, comprising ridges which are provided between the second guide lugs 92 opposing to each other in the widthwise direction and are projected in the same direction as the second guide lugs 92 and extended in a direction along the paper transporting direction in the image forming operation.

Due to these second guide ribs 93, the paper 3 can be carried with reduced friction.

In addition, the second guide ribs 93 are formed to project from the upper surface of the guide lever 44 to a smaller extent than the second guide lugs 92 projecting from the upper surface of the guide lever 44, and the difference therebetween is larger than the thickness of the paper 3.

So, this can surely form the space which forms a part of the above-mentioned transport path of the paper 3 between the edge of the second guide lugs 92 on the downstream side of the projecting direction and the edge of the second guide ribs 93 on the downstream side of the projecting direction. Thus, a reliable transport of the paper 3 along the second guide ribs 93 can be achieved.

Second Embodiment

Figure 10:
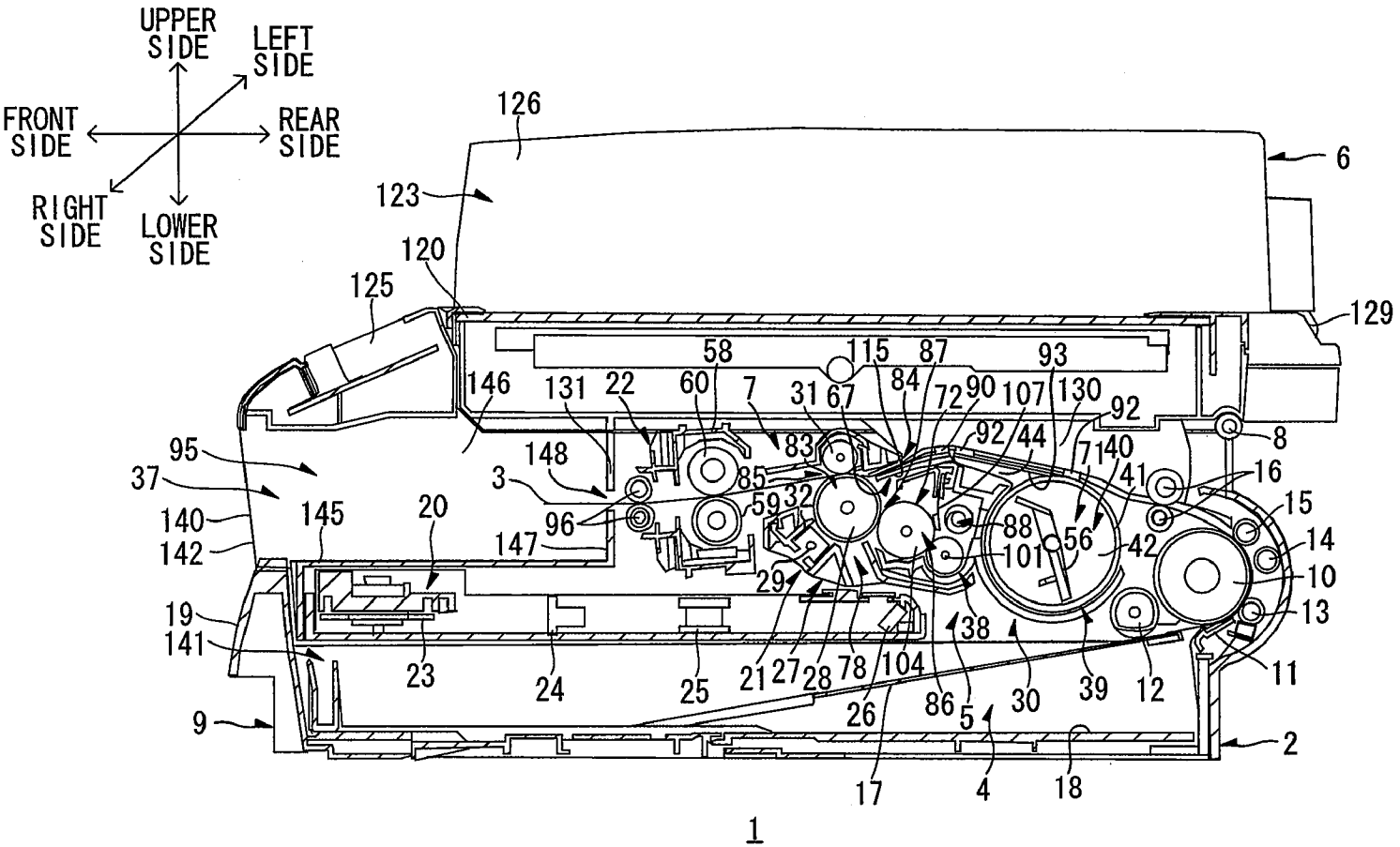
FIG. 10 shows an aspect of FIG. 1 to which a second embodiment is applied.
Figure 11:
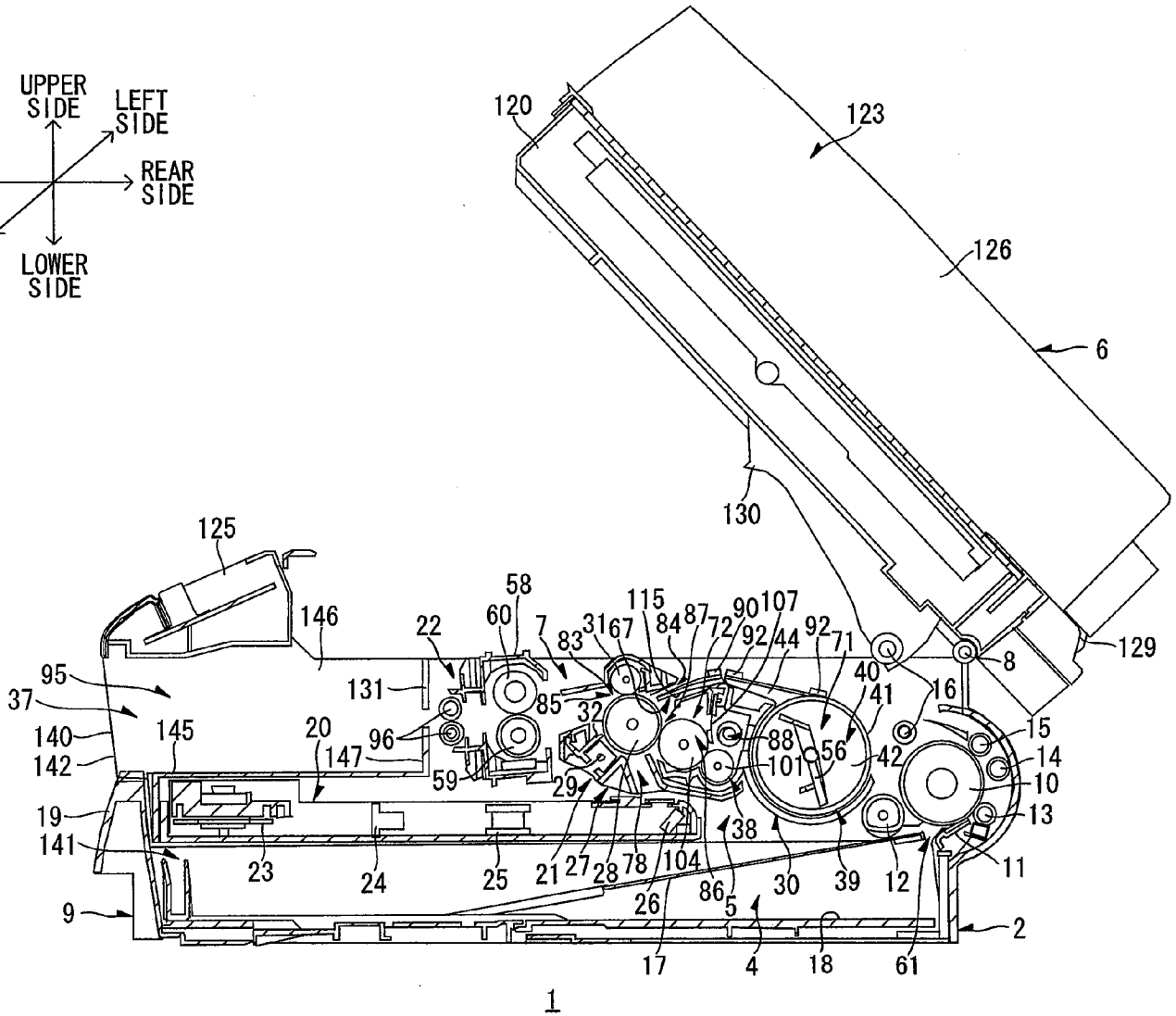
FIG. 11 shows an aspect of FIG. 2 to which the second embodiment is applied.

Although the operation panel 125 is arranged on the document mounting table 120 in the first embodiment, it may be arranged on the main body casing 2. FIGS. 10 and 11 show a laser printer wherein the operation panel is arranged on the main body casing. FIG. 10 shows the state of a scanning unit of such a laser printer being closed, and FIG. 11 shows the state of the scanning unit being opened. In FIGS. 10 and 11, the same numerals are referred to members corresponding to those described above, and the description thereon is not given here.

As shown in FIGS. 10 and 11, the operation panel 125 is integrally provided to the main body casing 2 in such a manner that a front edge of the operation panel 125 is continuous with an upper edge of a frontal side wall 140 of the main body casing 2. This can provide a reduced weight of the flat bed unit 6 which is opened and closed when the toner cartridge 40 and the process cartridge 21 are mounted and dismounted in and from the main body casing 2, thus providing improved operability of the flat bed unit 6. Also, by fixing the operation panel 125 to the main body casing 2, the connection of the wiring to the operation panel 125 can be facilitated and undesirable noise generation and the like can be prevented, thus providing improved reliability of the operation panel 125.

In the first and second embodiments, the process cartridge 21 integrally includes the drum unit 27 and the developing unit 30, and the process cartridge 21 is removably mounted and dismounted in and from the main body casing 2. In addition to this, in the image forming apparatus of the present invention, for example, the drum unit 27 may be formed as a drum cartridge including the photosensitive drum 28, the scorotron charger 29, the transfer roller 31, and the cleaning brush 32 so that such a drum cartridge can be removably mounted and dismounted in and from the main body casing 2. Likewise, the developing unit 30 may be formed as a developing cartridge including the toner cartridge accommodation chamber 71, the developer roller 104, the feed roller 101, and the layer-thickness regulating blade 107 so that such a developing cartridge can be removably mounted and dismounted in and from the main body casing 2. In addition, it may take the form of a developing cartridge integrally including the toner cartridge 40 as a developing agent accommodation member and the developing unit 30. Further, it may take the form of a process cartridge integrally including the drum unit 27, the developing unit 30, and the developing agent accommodation member.

Although the paper feed tray 9 is removably mounted in the main body casing 2 in the first and second embodiments, the paper feed tray 9 may be integrally formed with the main body casing 2. In this variant, the front side wall is not formed in the paper feed tray 9, and the paper 3 is received in the paper feed tray 9 through the paper feed tray mounting port 141.

Although the paper ejection tray 95 is integrally formed with the main body casing 2, the paper ejection tray 95 may take the removable form, as is the case with the paper feed tray 9.

Third Embodiment

1. Overall Structure of Laser Printer

Figure 12:
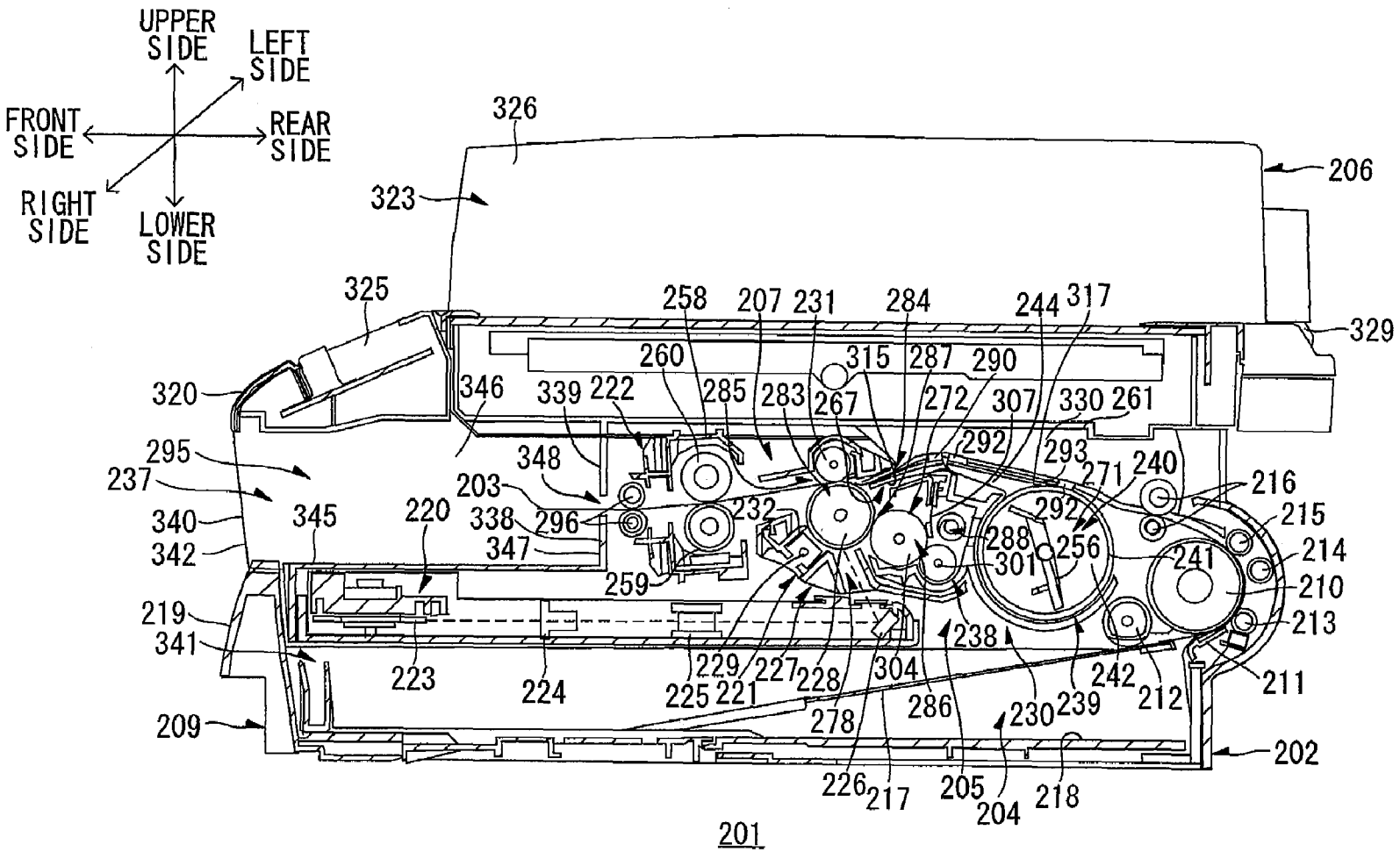
FIG. 12 is a side sectional view of a principal part of a laser printer as a third embodiment of the present invention about an image forming apparatus, showing the state of a flat bed unit being in a close position.
Figure 13:
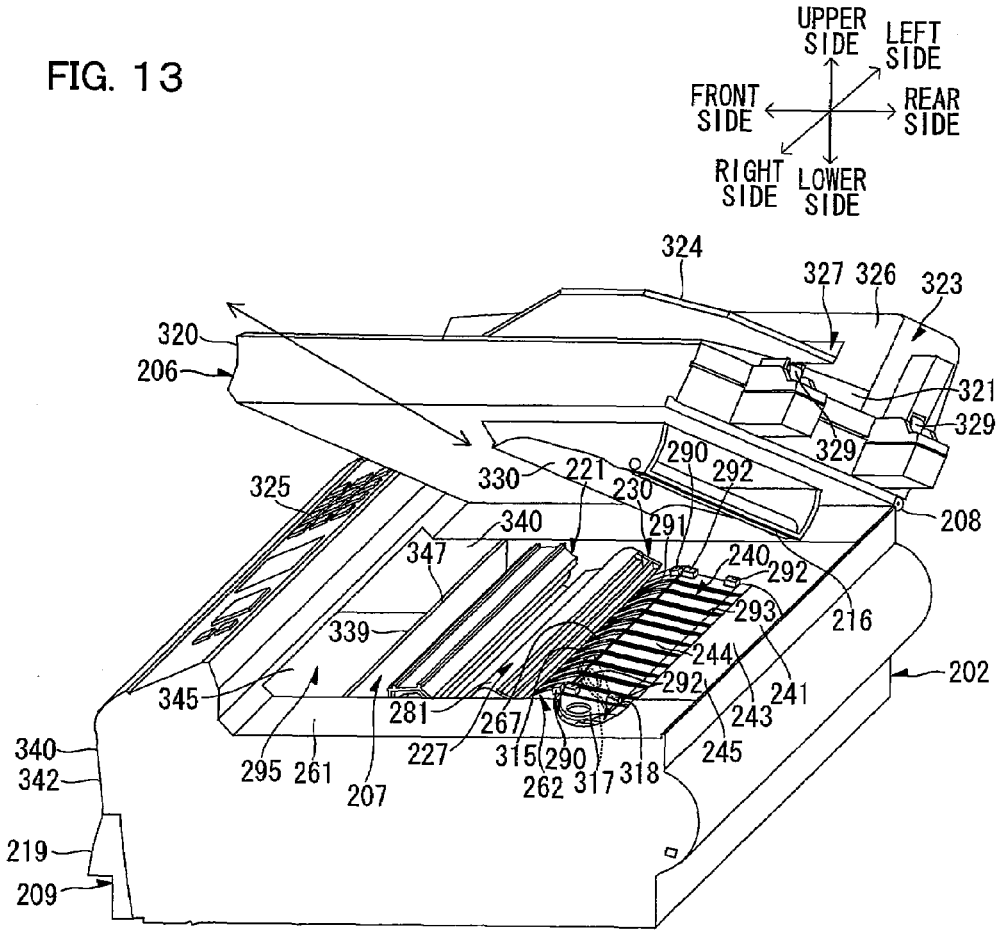
FIG. 13 is a right-side perspective view of the laser printer shown in FIG. 12, as viewed from above and behind, showing the state of the flat bed unit bed being in an spaced position.

FIG. 12 is a sectional side view of a principal part of a laser printer which is a third embodiment of an image forming apparatus of the present invention, and shows the state where a flat bed unit (image scanning unit) described later is in a closed position. FIG. 13 is a right-side perspective view of the laser printer shown in FIG. 2, as viewed from above and behind, showing the state of the flat bed unit being in a spaced position.

The laser printer 201 comprises a main body casing 202 (housing), a feeder section 204, housed in the main body casing 202, for feeding paper 3 (recording medium), an image forming section 205 for forming an image on the fed paper 203, an ejection section 237 (recording medium ejection section) formed in the main body casing 202, and a flat bed unit 206, provided over the main body casing 202, for scanning the image on a document.

In the following description, it is to be noted that the paper left side of FIG. 12 is defined as the front (fore) side and a paper right side of FIG. 12 is defined as a back (rear) in the state where a toner cartridge 240, (a developing agent cartridge) and a process cartridge 221 (process unit) as described later, are mounted in the main body casing 202. Further, with respect to the thickness of the paper, the paper front side of FIG. 12 is defined as the right side, and the paper back side of FIG. 12 is defined as the left side.

(1)Main Body Casing

The main body casing 202 is shaped in a box form having an L-shaped section as viewed from side elevation, as shown in FIG. 12. The main body casing 202 has an upper wall 261 in a generally rectangular frame shape, as viewed from top, on a top surface thereof as shown in FIG. 13. The upper wall 261 has a mounting port 207 through which a toner cartridge 240 and a process cartridge 221 described later removably mounted with the toner cartridge 240 thereon, are mounted and dismounted individually or unitarily. The mounting port 207 is in a generally square shape, as viewed from top. The flat bed unit 206 is mounted to open and close the mounting port 207. The flat bed unit 206 is swingably supported by a pivot shaft 208 extending therethrough at a left end portion thereof along an anteroposterior direction.

When the flat bed unit 206 is closed by being swung about the pivot shaft 208 to its close position where a right end portion of the flat bed unit 206 is positioned close to an upper wall 261 of the main body casing 202, the mounting port 207 is closed by the flat bed unit 206. When the flat bed in it 206 is opened by being swung about the pivot shaft 208 to its spaced position where the right end portion of the flat bed unit 206 is spaced away from the upper wall 261 of the main body casing 202, the mounting port 207 is opened obliquely upward right. Therefore, the toner cartridge 240 and the process cartridge 221 can be mounted in and dismounted from the main body casing 2 through the mounting port 207 from obliquely upward right.

The upper wall 261 has a notch 318 formed at a portion on the right side thereof opposing to a mounting grip 317, (mounting operation member), of the toner cartridge 240 which is in the toner open position described later. The notch 318 is formed by concaving rightwards an inside surface on the right side portion of the upper wall 261 in such a manner as to be continuous with the mounting port 207. This notch 318 forms a space with respect to the mounting grip 317 of the toner cartridge 240 in the toner open position, and is formed in a generally semicircular shape as viewed from top corresponding to a ring-shaped (described later) mounting grip 317.

The upper wall 261 is provided at a front portion thereof with an operation panel 325 including a liquid crystal panel for indicating an operational state of the laser printer 201 and the like, and key-buttons and the like which a user can operate for setting various conditions.

As shown in FIG. 12, a front side wall 340 is formed in an upper half of the front side of the main body casing 202, while a paper feed tray mounting port 341 is formed in a lower half of the front side of the main body casing 202. The paper feed tray mounting port 341 is formed in rectangular shape which is elongated in width direction. A paper feed tray 209 (recording medium feed section) described later can be mounted in and dismounted from the main body casing 202 through the paper feed tray mounting port 341 along the anteroposterior direction.

(2) Feeder Section

The feeder section 204 is provided at the bottom of the main body casing 202, including the paper feed tray 209 removably mounted and dismounted along the anteroposterior direction, a separation roller 210 and a separation pad 211 provided above a rear end portion of the paper feed tray 209, and a paper feed roller 212 provided in front of the separation roller 210 (on an upstream side of the paper transporting direction, toward the separation pad 211).

The paper feed tray 209 is formed in a box shape, has an opening at the top thereof, and integrally has an grip 219 on the front side thereof. The grip 219 is formed in an inverted L-shape in section as viewed from side elevation, whose base end portion is connected to an upper end portion on the front side of the paper feed tray 209 and whose distal end portion is extended downwardly to a generally vertical center position of the paper feed tray 209. The grip 219 covers an upper half of the front side of the paper feed tray 209.

The feeder section 204 includes a paper dust removing roller 213 disposed opposite to the separation roller 210 and located above a rear end of the separation pad 211, a first guide roller 214 and a second guide roller 215 which are disposed opposite to the separation roller 210 on the downstream side toward the paper dust removing roller 213 with respect to a paper transporting direction. The first guide roller 214 is disposed on the upstream side toward the second guide roller 215 with respect to the paper transporting direction. The second guide roller 215 is disposed in abutment with the separation roller 210, while the first guide roller 214 is spaced apart from the separation roller 210.

A resistration rollers 216 comprising a pair of rollers are provided above and in front of the separation roller 210.

The paper feed tray 209 is provided, in an interior thereof, with a paper pressing plate 217 for allowing paper 203 to be stacked. The paper pressing plate 217 is swingably supported at a front end portion thereof so that it can be swung between a paper stacked position where the paper pressing plate 217 is extended along a bottom plate 218 of the paper feed tray 209 and its rear end portion is lowered, and a paper feeding position where the paper pressing plate 217 is positioned obliquely and its rear end portion is heightened. When the paper feed tray 209 is dismounted from the main body casing 202 through the paper feed tray mounting port 341, the rear end portion of the paper pressing plate 217 moves downwardly under its own weight, so that the paper pressing plate 217 is put in the paper stacked position. When the paper pressing plate 217 is positioned in the paper stacked position, the paper 203 can be stacked on the paper pressing plate 217.

The paper feed tray 209 is provided with a lever (not shown) for lifting up the rear end portion of the paper pressing plate 217. The lever (not shown) works to swing the paper pressing plate 217 between the paper stacked position and the paper feeding position.

When the lever (not shown) is operated to put the paper pressing plate 217 in the paper feeding position, the paper 203 stacked on the paper pressing plate 217 is pressed against the paper feed roller 212, and paper feeding toward a separation position between the separation roller 210 and the separation pad 211, is started by rotation of the paper feed roller 212.

The paper 203 fed toward the separation position by the paper feed roller 212, is sandwiched between the separation roller 210 and the separation pad 211 by the rotation of the separation roller 210, then separated one by one. The paper 203 fed passes through between the paper dust removing roller 213 and the separation roller 210, where the paper dust is removed from the paper 203. Thereafter, the paper 203 is guided by the first guide roller 214 and the second guide roller 215 and is turned around forward in a generally U-shape, then is carried toward the resistration rollers 216.

As described above, the first guide roller 214 is disposed opposite to and spaced apart from the separation roller 210 at a generally U-shaped turn-around position (at the deepest portion in the U-shape or at the backmost portion in FIG. 12). Therefore, even when the paper 203's downstream side end portion with respect to the transporting direction passing over the paper dust removing roller 213, is carried so as to go off the outer periphery of the separation roller 210, without curving around it, the paper transporting direction is corrected by the first guide roller 214 so that the downstream side end portion of the paper 203 can be correctly carried around the separation roller 210.

The resistration rollers 216 resist the paper 203, then carry the paper 203 to a transfer position between a photosensitive drum 228 (image carrier) and a transfer roller 231 (transfer unit) as described later. A toner image on the photosensitive drum 228 is transferred on the paper 203 at the transfer position.

(3) Image Forming Section

An image forming section 205 includes a scanner 220 (exposure unit), a process cartridge 221, and a fixation unit 222 (fixation unit).

(a) Scanner

The scanner 220 is arranged above the feeder section 204 in the main body casing 202. The scanner 220 is placed adjacent to the paper feed tray 209 so that the scanner 220 can overlap upwardly with the paper feed tray 209 about an area extending from a front end thereof to a portion which is slightly rear toward a center thereof in anteroposterior direction. And the scanner 220 is placed adjacent to a paper ejection tray 295 described later so that the front half portion of the scanner 220 can overlap downwardly with the paper ejection tray 295. The scanner 220 includes a laser source (not shown), a polygonal mirror 223 to be rotationally driven, an fθ lens 224, a lens 225, and a reflector 226, along the frond and rear direction. As indicated by a chain line, the laser beam emitted from the laser source based on the image data, is polarized by the polygonal mirror 223, at first, and then passes through the fθ lens 224 and the lens 225 in this order, next a light path of the laser beam is folded obliquely forward and upward by the reflector 226, to irradiate a surface of the photosensitive drum 228 of the process cartridge 221 with the laser beam.

(b) Process Cartridge

Figure 14:
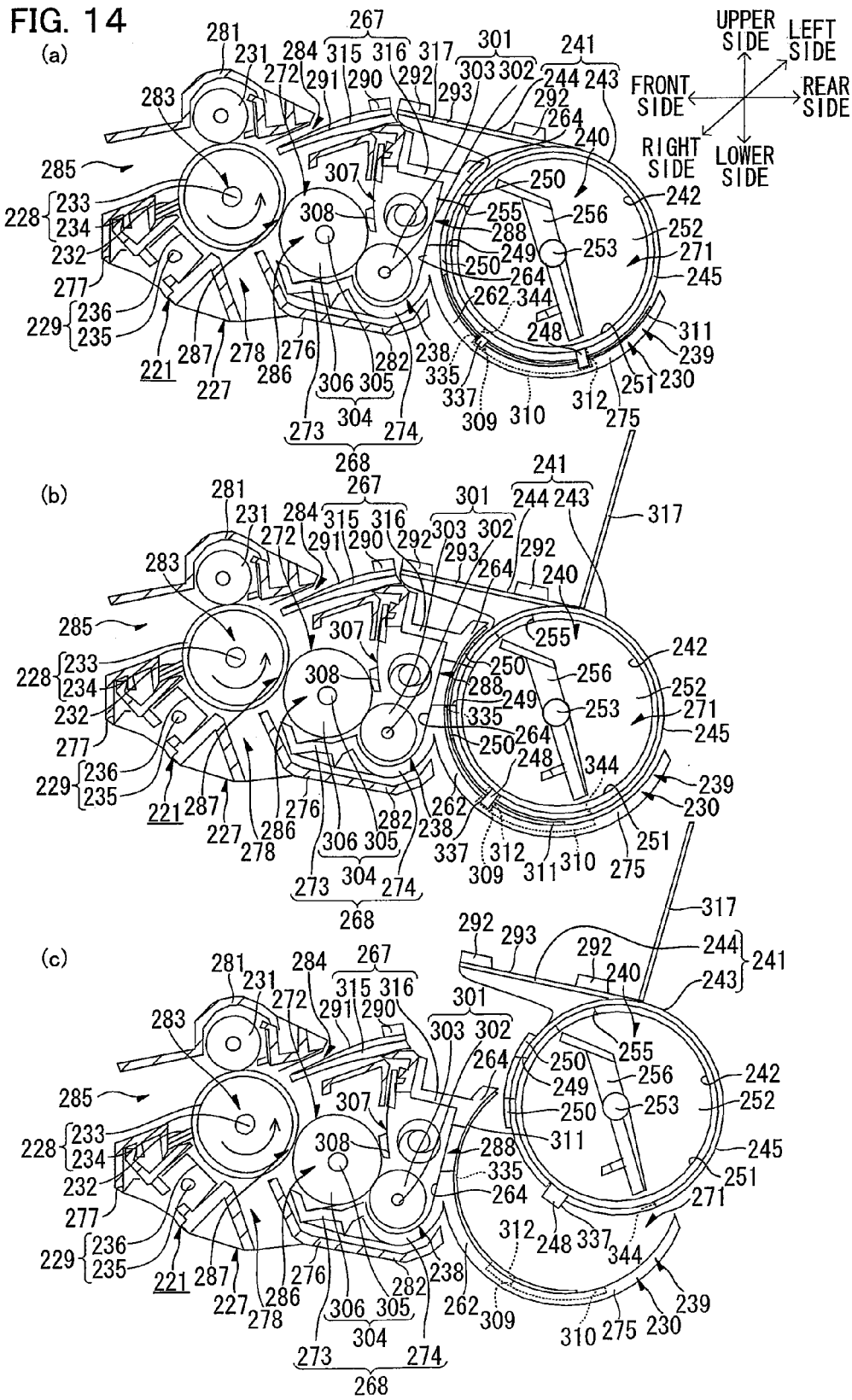
FIGS. 14(*a*) to 14(*c*) are operation diagrams for explaining the operation of mounting/dismounting a toner cartridge in/from a developing unit of a process cartridge.

FIGS. 14 (*a*) to 14 (*c*) are sectional side views of a principal part of the process cartridge of the laser printer shown in FIG. 12, and FIGS. 14(*a*) to 14(*c*) show the mounting/dismounting of the toner cartridge in/from the developing unit of the process cartridge.

Figure 15:
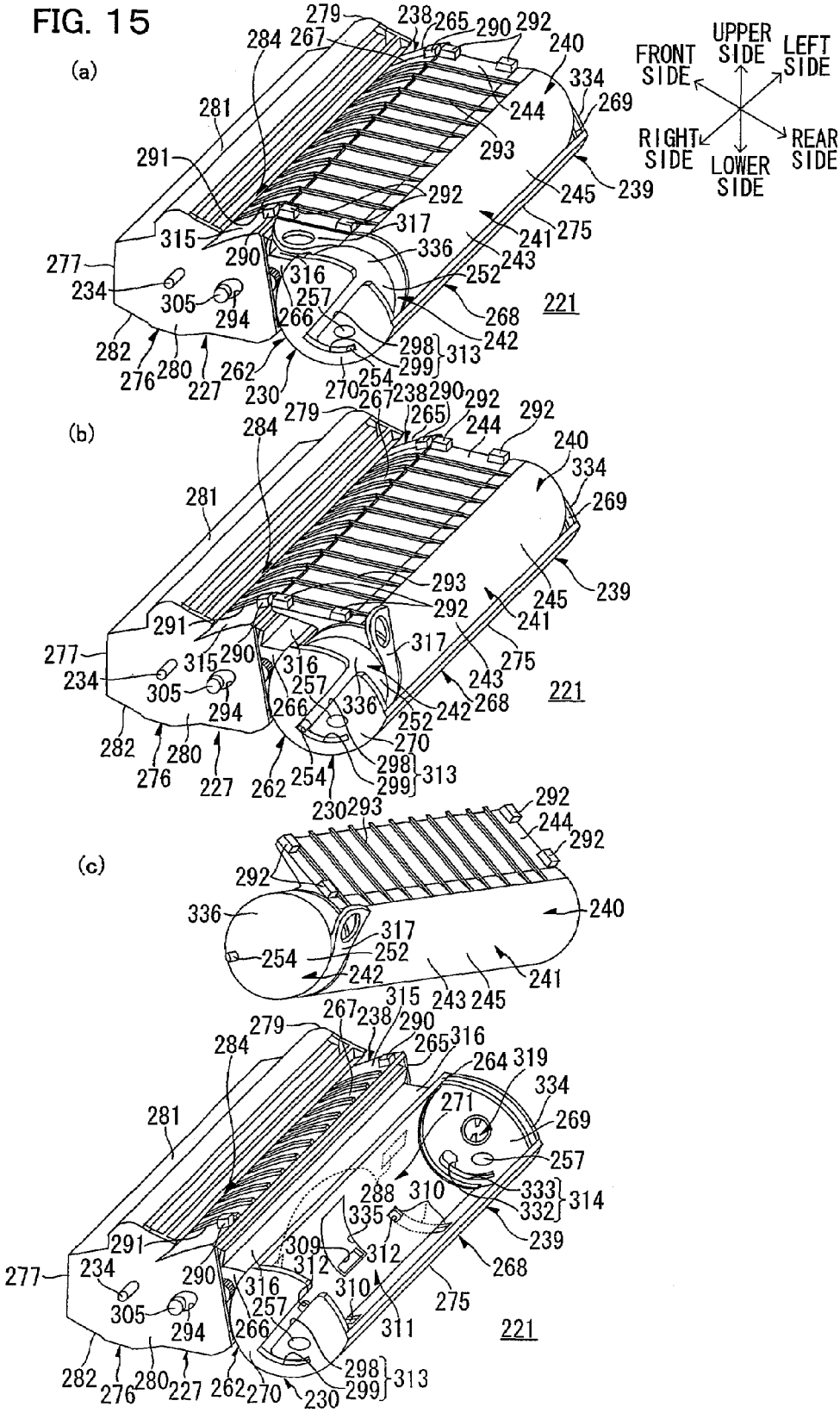
FIGS. 15(*a*) to 15 (*c*) are operation diagrams, corresponding to FIGS. 14(*a*)-14(*c*), for explaining the operation of mounting/dismounting the toner cartridge in/from the developing unit of the process cartridge.

FIGS. 15 (*a*) to 15 (*c*) are right-side perspective views of the process cartridge of the laser printer shown in FIG. 12 as viewed from above and behind, and FIGS. 15(*a*) to FIG. 15(*c*) correspond to FIGS. 14(*a*) to 14(*c*), show the mounting/dismounting of the toner cartridge in/from the developing unit of the process cartridge.

Figure 16:
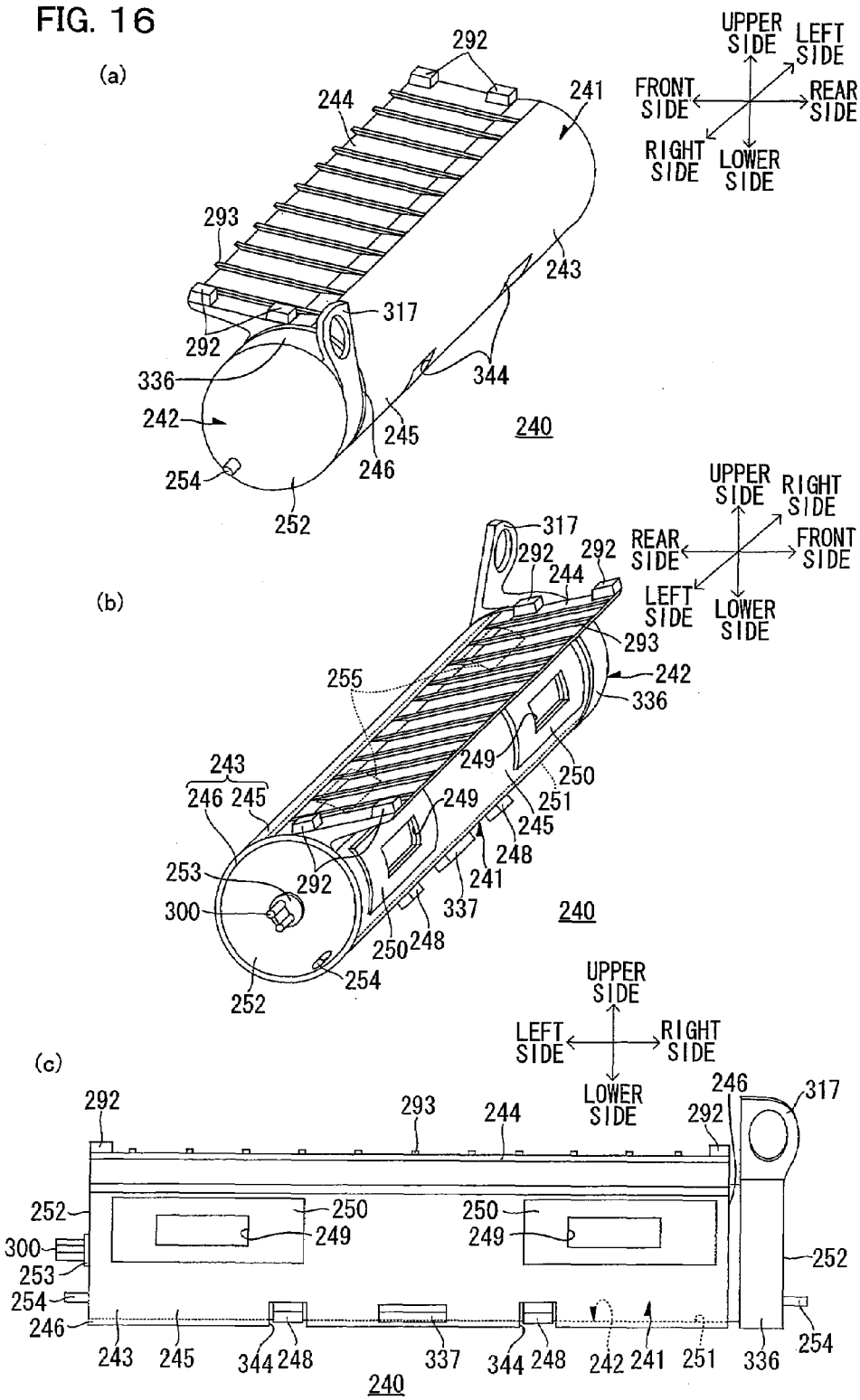
FIG. 16 (*a*) is a right-side perspective view of the toner cartridge, as viewed from above and behind, with its inner housing being in the toner close position.

FIG. 16 (*a*) is a right-side perspective view of the toner cartridge, as viewed from above and behind, with its inner housing being in the toner close position described later, and FIG. 16(*b*) is a left-side perspective view of the toner cartridge, as viewed from above and front, with its inner housing being in the toner close position. FIG. 16(*c*) is a front view of the toner cartridge in the state of its inner housing being in the toner close position.

As shown in FIG. 12, the process cartridge 221 is arranged adjacent to the scanner 220 in the main body casing 202 so that its front half portion can overlap upwardly with the scanner 220, and arranged adjacent to the paper feed tray 209 so that its rear half portion can overlap upwardly with the paper feed tray 209.

The process cartridge 221 is removably mounted in the main body casing 202, as shown in FIG. 13. The direction of the process cartridge 221 being mounted in the main body casing 202 (the mounting direction) corresponds to an obliquely downward and leftward direction, and the direction of the process cartridge 221 being dismounted from the main body casing 202 (the dismounting direction) corresponds to an obliquely upward and rightward direction as indicated by an arrow in FIG. 13.

As shown in FIGS. 14 (*a*) to 14 (*c*), the process cartridge 221 includes a drum unit 227 and a developing unit 230 unitarily, and further includes a toner cartridge 240 removably mounted in the process cartridge 221.

(b-1) Drum Unit

The drum unit 227 includes a drum housing 276, the photosensitive drum 228 provided in the drum housing 276, a scorotron charger 229, a transfer roller 231, and a cleaning brush 232.

The drum housing 276 is formed in a box shape elongated in a widthwise direction and has an opening at a rear side thereof. The drum housing 276 integrally comprises a drum front wall 277, a drum left side wall 279 (see FIGS. 15 (*a*) to 15(*c*)), a drum right side wall 280 (see FIGS. 15 (*a*) to 14(*c*)), a drum top wall 281, and a drum bottom wall 282.

As shown in FIGS. 15 (*a*) to 15(*c*), the drum left side wall 279 and the drum right side wall 280 are disposed opposite to and spaced apart from each other in the widthwise direction. Each of the drum left side wall 279 and the drum right side wall 280 has an elliptical hole 294 which is elliptical as viewed from side elevation and formed at the position which is slightly rear from the center position thereof in anteroposterior direction and at the vertical center position thereof.

The drum bottom wall 282 is extended between a lower edge of the drum left side wall 279 and a lower edge of the drum right side wall 280. The drum front wall 277 is extended between a front edge of the drum left side wall 279 and a front end portion of the drum right side wall 280. The drum top wall 281 is extended between an upper a front edge of the drum left side wall 279 and an upper edge of the drum right side wall 280.

As shown in FIG. 14, the drum bottom wall 282 has a laser entrance 278, formed midway in anteroposterior direction, for irradiating the photosensitive drum 228 with the laser beam emitted from the scanner 220. A first passing port 284 is opened between a rear edge of the drum top wall 281 and a front edge of a development top wall 267 of the developing unit 230 described later, and a second passing port 285 is opened at an upper end of the drum front wall 277. The first passing port 284 and the second passing port 285 are both formed in a widthwise elongated rectangular shape.

In the drum housing 276, a zone defined by the drum front wall 277, the front halves of the drum left side wall 279, and drum right side wall 280 and drum bottom wall 282, and the drum top wall 281 serves as a drum according section 283 for accommodating the photosensitive drum 228, the scorotron charger 229, the transfer roller 231 and the cleaning brush 232. The drum accommodating section 283 is formed in a cylindrical shape opened at the front and rear sides.

A zone defined by the rear halves of the drum left side wall 279, drum right side wall 280, and drum bottom wall 282, serves as a development placing section 286 for the developing unit 230 to be placed therein. The development placing section 286 is formed in an U-shaped closed-end frame form opened at the top, as viewed in section from the front side.

The drum accommodating section 283 and the development placing section 286 communicate with each other.

The photosensitive drum 228 includes a cylindrical shaped, drum body 233 whose outermost surface layer is formed by a positive chargeable photosensitive layer of polycarbonate and the like, and a metal drum shaft 234 arranged in an axis of the drum body 233 and extending along an axial direction of the drum body 233. The drum shaft 234 is supported at both axial ends thereof between the drum left side wall 279 and the drum right side wall 280 of the drum housing 276 (see FIGS. 15 (*a*) to 15 (*c*)), and the drum body 233 is supported rotatably relative to the drum shaft 234. Therefore, the photosensitive drum 228 is provided in the drum housing 276, so that it can freely rotate around the drum shaft 234. The photosensitive drum 228 is rotationally driven by a driving force input from a motor (not shown).

The scorotron charger 229 is supported on the drum bottom wall 282 of the drum housing 276 at the obliquely forward and downward of the photosensitive drum 228 and is disposed opposite to and spaced apart from the photosensitive drum 228 not to contact therewith. The scorotron charger 229 includes a discharge wire 235 disposed opposite to and spaced apart from the photosensitive drum 228, and a grid 236, disposed between the discharge wire 235 and the photosensitive drum 228, for controlling quantity of electric charge from the discharge wire 235 to the photosensitive drum 228.

In the scorotron charger 229, a bias voltage is applied to the grid 236, while at the same time, a high voltage is applied to the discharge wire 235, whereby corona discharge is generated from the discharge wire 235 to allow a surface of the photosensitive drum 228 to be uniformly charged positively.

The transfer roller 231 in the drum housing 276 is disposed above and vertically opposite to the photosensitive drum 228 and is put in contact with the photosensitive drum 228 to form a nip between the transfer roller 231 and the photosensitive drum 228. This nip forms a transfer position between the photosensitive drum 28 and the transfer roller 231.

The transfer roller 31 includes a metal roller shaft supported rotatably between the drum left side wall 279 and the drum right side wall 280 of the drum housing 276, and a rubber roller of conductive rubber material for covering the metal roller shaft. In the transfer, a transfer bias is applied to the transfer roller 231. The transfer roller 231 is rotationally driven by a driving force input from a motor (not shown).

The cleaning brush 232 is disposed on the drum front wall 277 of the drum housing 276. The cleaning brush 232 opposes to and contacts with the photosensitive drum 228 at a location on the obliquely forward and downward side of the photosensitive drum 228 and on the obliquely forward and upward side of the scorotron charger 229 (on the upstream side from the scorotron charger 229 with respect to the rotational direction of the photosensitive drum 228 (see an arrow of FIGS. 14(*a*) to 14 (*c*))).

(b-2) Developing Unit

The developing unit 230 is provided integrally with the drum unit 227 in the development placing section 286 of the drum housing 276.

The developing unit 230 includes a development housing 262, a feed roller 301, a developer roller 304 (developing agent carrier), and a layer-thickness regulating blade 307 which are arranged in the development housing 262.

The development housing 262 integrally includes a front housing 238 formed in a widthwise elongated box shape opened at the front side, and a rear housing 239 formed in a cylindrical shape opened at the top.

The front housing 238 integrally comprises a development rear wall 264, a development left side wall 265 (see FIGS. 15 (*a*) to 15 (*c*)), a development right side wall 266 (see FIGS. 15(*a*) to 15 (*c*)), a development top wall 267, and a development bottom wall 268.

The development left side wall 265 and the development right sidewall 266 are formed in a generally rectangular shape, as viewed from side elevation, and are disposed opposite to and spaced from each other in the widthwise direction.

The development bottom wall 268 is extended between a lower edge of the development left side wall 265 and a lower edge of the development right side wall 266 and integrally includes a first bottom wall 273 and a second bottom wall 274 which are arranged in this order from the front to the rear.

The first bottom wall 273 is located in the front side of the development bottom wall 268 and is formed in a generally rectangular shape as viewed from top, extending from the rear to the front in a generally hook shape in section as viewed from side elevation.

The second bottom wall 274 extends continuously from a rear edge of the first bottom wall 273 and is formed in a generally semicircular arc shape in section, as viewed from side elevation, along the feed roller 301.

The development top wall 267 is extended between an upper edge of the development left side wall 265 and an upper edge of the development right side wall 266 and integrally includes a first top wall 315 and a second top wall 316.

The first top wall 315 is located in the front side of the development top wall 267 and is extended obliquely upwards to the rear side.

The paper 203 passes over the development top wall 267. As shown in FIGS. 15 (*a*) to 15 (*c*), the first top wall 315 has first guide lugs 290 on the rear side of an upper surface facing the carried paper 203 at both widthwise ends, respectively. The first guide lugs 290 formed in a generally rectangular parallelepiped shape and project in a thickness direction of the paper 203, or to an upward direction.

There are provided a plurality of first guide ribs 291 equally spaced along the widthwise direction between the two guide lugs 290 opposing each other in the widthwise direction. The first guide ribs 291 are ridges projecting upward and extending along the anteroposterior direction, or the paper transporting direction.

The first guide lugs 290 project from the upper surface of the first top wall 315 to a larger extent than the first guide ribs 291, and the difference is larger than a thickness of the paper 203.

As shown in FIGS. 14(*a*) to 14(*c*), the second top wall 316 is formed in a generally L-shape in section, as viewed from right side, extending downward from a rear edge of the first top wall 315, then bending and extending rearward, and then connected to an upper edge of the development rear wall 264.

The development rear wall 264 is extended between a rear edge of the development left side wall 265 and a rear edge of the development right side wall 266. A lower edge of the development rear wall 264 is connected to a rear edge of the second bottom wall 274.

An insertion opening 287 formed on the front side of the front housing 238 is defined by front edges of the development top wall 267, the development left sidewall 265, the development right side wall 266, and the development bottom wall 268. The insertion opening 287 is formed in a widthwise elongated rectangular shape.

The rear housing 239 is integrally formed by a left side wall 269, a right side wall 270, and a curved wall 275.

As shown in FIG. 15(*c*), the left side wall 269 and the right side wall 270 are disposed opposite to each other in the widthwise direction and are formed in a generally gibbous moon shape as viewed from side elevation.

The right side wall 270 has a right-side guide groove 313 formed to penetrate the right side wall 270 in the thickness direction. The right-side guide groove 313 is formed in a sickle-like shape in section, as viewed from side elevation, and integrally comprising a right-side linear groove portion 298 extending obliquely forward and downward from an upper edge of the right side wall 270 at an anteroposterior center, and a right-side curved groove portion 299 extending continuously rearwards from a lower end of the right-side linear groove portion 298 along a periphery of the curved wall 275.

The left side wall 269 has an agitator gear exposing opening 319 formed at a generally anteroposterior and vertical center position thereof to penetrate the left side wall 269 in the thickness direction and a left-side guide groove 314.

The agitator gear exposing opening 319 is, as viewed from side elevation, in a circular shape corresponding to a shape of a side surface of an agitator gear 300 described later, in which projections project inwardly and opposite to each other.

The left-side guide groove 314 is formed in a sickle-like shape in section, as viewed from side elevation, and integrally comprising a left-side linear groove portion 332 extending downwardly from a position lower than the agitator gear exposing opening 319, and a left-side curved groove portion 333 extending continuously rearwards from a lower end of the left-side linear groove portion 332 along a periphery of the curved wall 275. It should be noted that a length of the vertically extention of the left-side linear groove portion 332 is about a quarter of a length of the vertically extention of the right-side linear groove portion 298.

A plate 334, having the same shape as the left side wall 269 is provided on the left side of the left side wall 269 at a widthwise spaced location. No left-side guide groove 314 is formed in this plate 334.

The curved wall 275 is extended between the left side wall 269 and the right side wall 270 around their outer peripheries except their upper edges and is formed in a corresponding generally semicircular arc shape in section as viewed from side elevation. The curved wall 275 has a pair of circumferential grooves 310 formed in an upper surface thereof at locations inwardly about one-quarter of a widthwise dimension of the curved wall 275 from both widthwise ends thereof. The circumferential grooves 310 are concaved in a region extending from a position midway between an anteroposterior center and a front end of the curved wall 275 to a position midway between that center and a rear end thereof, and extend along a circumferential direction of the curved wall 275. The circumferential grooves 310 are formed in a rectangular shape as viewed from top.

The curved wall 275 has a fixing groove 309 concaved in the thickness direction at a widthwise center position between front end portions of the pair of circumferential grooves 310. The fixing groove 309 is shaped in a rectangular form as viewed from top.

As shown in FIGS. 14 (*a*) to 14 (*c*), in the front housing 238, a zone defined by the development rear wall 264, the development left side wall 265, the development right side wall 266, the development top wall 267, and the development bottom wall 268 serves as a developing chamber 272 for housing the feed roller 301, the developer roller 304, and the layer-thickness regulating blade 307.

In the rear housing 239, a zone defined by the left side wall 269, the right side wall 270, and the curved wall 275 serves as a toner cartridge accommodation chamber 271 for accommodating the toner cartridge 240. The toner cartridge accommodation chamber 271 is formed in a closed-end frame shape opened at the top.

The front housing 238 and the rear housing 239 are joined to each other via the rear surface of the development rear wall 264 and the front surface of the curved wall 275. Introduction ports 288 are formed in a joined portion the development rear wall 264 and the curved wall 275 at both widthwise end portions thereof, and penetrate the joining portion in the thickness direction. The introduction ports 288 are formed in a widthwise elongated rectangular shape. The toner cartridge accommodation chamber 271 and the developing chamber 272 communicate with each other via the introduction ports 288.

The toner cartridge accommodation chamber 271 is provided in an interior thereof with a shutter 311.

The shutter 311 is formed by a thin plate of generally semicircular arc shape in section, as viewed from side elevation, smaller in circular arc than generally semicircular arc form of the curved wall 275. As shown in FIG. 15(*c*), the shutter 311 has first penetrate holes 312 having a rectangular form as viewed from top and penetrating the shutter 311 in the thickness direction. The first penetrate holes 312 are formed in a rear portion of the shutter 311 at locations inwardly about one-quarter of a widthwise dimension of the shutter 311 from both widthwise ends thereof.

The shutter 311 has, at a widthwise center portion thereof, a second penetrate hole 335 of a rectangular shape, as viewed from top, penetrating the shutter 311 in the thickness direction from a front end portion to an anteroposterior center portion thereof.

The shutter 311 is supported on the upper surface of the curved wall 275 in the interior of the toner cartridge accommodation chamber 271 so that it can be freely slid along the generally semicircular arc of the upper surface of the curved wall 275. The first penetrate holes 312 always oppose respectively to the circumferential grooves 310 formed in the curved wall 275, and the second penetrate hole 335 always opposes to the fixing groove 309 formed in the curved wall 275. The shutter 311 is movable between the development close position where the introduction ports 288 are both closed and the development open position where the introduction ports 288 are opened. Different from the opening and closing mechanism on the toner cartridge side, the shutter 311 must withstand the repeat use. From this viewpoint, the shutter 311 is preferably formed of a thin metal plate, a plated steel plate, alumina or the like.

As shown in FIGS. 14(*a*) to 14 (*c*), the feed roller 301 is disposed in front of the introduction ports 288. The feed roller 301 includes a feed roller shaft 302 formed of metal, and a sponge roller 303 formed of conductive foam material for covering the feed roller shaft 302. The feed roller shaft 302 is rotatably supported at both axial ends thereof between the development left side wall 265 and the development right side wall 266 at anteroposterior position thereof corresponding to the second bottom wall 274. The feed roller 301 is rotationally driven by a driving force from a motor (not shown) being input to the feed roller shaft 302.

The developer roller 304 is disposed in front of the feed roller 301 in the state where it contacts with the feed roller 301 so that the developer roller 304 and the feed roller 301 can be compressed with each other. The developer roller 304 includes a developer roller shaft 305 formed of metal, and a rubber roller 306 formed of conductive rubber material for covering the developer roller shaft 305.

The developer roller shaft 305 is rotatably supported at both axial ends thereof between the development left side wall 265 and the development right side wall 266 at anteroposterior positions thereof corresponding to the first bottom wall 273. The rubber roller 306 is formed of conductive urethane rubber or silicone rubber including carbon fine particles and is covered with a coating layer formed of resin excellent in wear and abrasion resistance such as urethane rubber containing fluorine or polyimide. The developer roller 304 is rotationally driven by a driving force from a motor (not shown) being input to the developer roller shaft 305. As shown in FIGS. 15 (*a*) to 15 (*c*), in the developing process, a developer bias is applied to the developer roller 304 via one widthwise end portion of the developer roller shaft 305 which is exposed via the elliptical holes 294 formed in the drum left side wall 279 and the drum right side wall 280.

As shown in FIGS. 14 (*a*) to 14 (*c*), the layer-thickness regulating blade 307 is provided with a pressing portion 308 of generally semicircular shape in section. The pressing portion 308 is formed of insulative or conductive silicon rubber or urethane rubber and is provided at a distal end portion of a blade body formed of a metal plate spring material. The blade body of the layer-thickness regulating blade 307 is supported at a base end portion thereof to the development top wall 267 at a location above the developer roller 304, so that the pressing portion 308 is press-contacted with the developer roller 304 by an elastic force of the blade body.

(b-3) Toner Cartridge

The toner cartridge 240 is removably mounted in the toner cartridge accommodation chamber 271 of the development housing 262. Therefore, the toner cartridge 240 can be mounted in and dismounted from the main body casing 202 by mounting and dismounting the process cartridge 221 in and from the main body casing 202 through the mounting port 207 in the state where the toner cartridge 240 is mounted in the process cartridge 221. Further, the toner cartridge 240 separately can be mounted in and dismounted from the process cartridge 221 mounted in the main body casing 202, through the mounting port 207.

As shown in FIG. 16 (*a*), the toner cartridge 240 is formed in a generally inverted 9 shape, as viewed from right side, including an outer housing 241 and an inner housing 242 both of which are formed of semi-transparent resin.

The outer housing 241 integrally includes a cylindrical portion 243 (case), and a projecting guide 244 (projecting member).

The cylindrical portion 243 is in the shape of a widthwise elongated and hollow cylinder, including a cylindrical external wall 245, and a pair of ring-shaped outside side walls 246 defined as both widthwise end surfaces of the cylindrical external wall 245 by a thickness of the cylindrical external wall 245.

The projecting guide 244 has a widthwise dimension equal to that of the cylindrical external wall 245 and is in the shape of a widthwise elongated generally rectangular flat plate. This projecting guide 244 projects tangentially from one circumferential portion of the cylindrical external wall 245 to which the projecting guide 244 is connected at a base end portion thereof. A distal end portion of the projecting guide 244 projects counterclockwise, when the cylindrical portion 243 is viewed from right side.

When paper 203 is carried in the image forming operation of the laser printer 201, the paper 203 passes over the upper surface of the projecting guide 244 which is the opposite side to the lower surface of the projecting guide 244 opposing to the cylindrical external wall 245 of the cylindrical portion 243. Guide lugs 292 (space keeping members) are respectively provided on the upper surface of the projecting guide 244 at the both widthwise end portions thereof on the base end portion and on the distal end portion.

The second guide lugs 292 are formed in a generally rectangular parallelepiped shape having the same size as the first guide lugs 290. The second guide lugs 292 extend on the projecting guide 244 in a direction away from the cylindrical external wall 245, or in the thickness direction of the paper 203 passing over the upper surface of the projecting guide 244 in the image forming operation.

There are provided a plurality of second guide ribs 293 equally spaced in the widthwise direction between the second guide lugs 292 opposing to each other in the widthwise direction. The second guide lugs 292 are ridges projecting in a direction away from the cylindrical external wall 245 and also extending in a direction from the base end portion toward the distal end portion of the projecting guide 244, or along the paper transporting direction in the image forming operation. The second guide lugs 293 project from the upper surface of the projecting guide 244 to equal extent to the first guide ribs 291 projecting from the upper surface of the development top wall 267.

Further, the second guide ribs 293 project from the upper surface of the projecting guide 244 to smaller extent than the second guide lugs 292 projecting from the upper surface of the projecting guide 244, and the difference therebetween is larger than the thickness of the paper 203.

As shown in FIG. 16(*c*), the cylindrical external wall 245 has a pair of rail grooves 344 formed to penetrate the external wall 245 in a thickness direction thereof. The rail grooves 344 are formed at locations inwardly about one-quarter of a widthwise dimension of the cylindrical external wall 245 from both widthwise ends thereof, to extend circumferentially to a rear side (in the counterclockwise direction as viewed from right side in FIG. 16(*a*)) from a front end portion located at a circumferential position opposite to the distal end portion of the projecting guide 244 with respect to a center axis of the cylindrical portion 243. The rail grooves 344 are each formed in a rectangular form as viewed from top.

A first radial lug 337 of a generally rectangular parallelepiped shape is formed at a widthwise center between front end portions of the rail grooves 344 to project radially outwardly of the cylindrical portion 243.

Also, as shown in FIG. 16(*b*), the cylindrical external wall 245 has first vents 249 penetrating therethrough in the thickness direction, which are respectively formed in both widthwise end portions of the cylindrical external wall 45 at locations adjacent to the base end portion of the guide lever 244 with respect to the clockwise direction of the cylindrical portion 243 as viewed from left side.

The first vents 249 are formed in a rectangular shape as viewed from radially outside.

Also, the cylindrical external wall 245 has second radial lugs 250 which are formed thereon along edges of the first vents 249 and project radially outwardly. The second radial lugs 250 are formed in a rectangular frame-like shape as viewed from radially outside and are formed of elastic material such as rubber or sponge and the like.

The inner housing 242 is formed in the shape of a widthwise elongated, hollow cylinder larger in widthwise length than the outer housing 241 and smaller in diameter than the cylindrical portion 243 of the outer housing 241, and integrally includes a cylindrical internal wall 251 (see FIGS. 14 (*a*) to 14 (*c*)), and a pair of disc-like inside side walls 252 for closing both widthwise side surfaces of the cylindrical internal wall 251. An agitator rotating shaft 253 is extended between the inside side walls 252 opposing to each other with respect to the widthwise direction at circle centers thereof, as shown in FIGS. 14 (*a*) to 14 (*c*). The agitator rotating shaft 253 is rotatably supported on the inside side walls 252. An agitator 256 is provided on the agitator rotating shaft 253. As shown in FIG. 16(*b*), the left side portion of the agitator rotating shaft 253 projects outwardly from the inside side wall 252 in the widthwise direction, and an agitator gear 300 of a generally H-shape as viewed from side elevation is provided on a projected portion of the agitator rotating shaft 253. The agitator 256 is rotated by a driving force from a motor (not shown) being input to the agitator gear 300 provided on the agitator rotating shaft 253.

The inside side walls 252 have cylinder-like internal lugs 254 provided at locations on the radially outer side from the agitator rotating shaft 253. The internal lugs 254 project outwardly in the widthwise direction and to each other in the widthwise direction (see FIG. 16(*c*)).

The cylindrical internal wall 251 has, in a portion of the circumferential surface thereof, second vents 255 penetrating therethrough in the thickness direction. The second vents 55 are formed in both widthwise end portions of the cylindrical internal wall 251 (see FIG. 14 (*a*)). The second vents 255 are formed in a rectangular shape having substantially the same size as the first vents 249 as viewed from radially outside.

The cylindrical internal wall 251 has third radial lugs 248 projecting radially outwardly and being formed at substantially the same circumferential positions as the internal lugs 254, inwardly about one-quarter of a widthwise dimension of the cylindrical internal wall 251 from both widthwise ends thereof, respectively.

The inner housing 242 is fitted in the outer housing 241. Slide packings (not shown) is interposed between both widthwise ends of an outside surface of the cylindrical internal wall 251 and both widthwise ends an inside surface of the cylindrical external wall 245 respectively. Therefore, the inner housing 242 and the outer housing 241 can be freely slid circumferentially relative to each other. Also, the slide packings (not shown) permit an interior of the inner housing 242 to be kept air-tight and liquid-tight to exterior.

The third radial lugs 248 provided on the inner housing 242 penetrate the rail grooves 344 and project raidally outwardly of the cylindrical portion 243, as shown in FIG. 16(*c*). The third radial lugs 248 are circumferentially slidable along the rail grooves 344, following the circumferential sliding motion of the inner housing 242 relative to the outer housing 241.

Also, as shown in FIG. 16(*b*), the inner housing 242 are fitted in the outer housing 241 so that the left-side inside side wall 252 and the left-side outside side wall 246 are flush with each other and also the right end portion of the cylindrical internal wall 251 is exposed from the outer housing 241 to a widthwise outward direction. A mounting grip 317 is integrally provided on the exposed right end portion 336 of the cylindrical internal wall 251 exposed from the outer housing 241 to the widthwise outward direction.

The mounting grip 317 is in a generally ring-shape, as viewed from top, and has a widthwise dimension substantially equal to a width of the exposed right end portion 336. The mounting grip 317 projects tangentially from one circumferential portion of the exposed right end portion 336 connected to a base end portion of the mounting grip 317. On the circumference of the exposed right end portion 336, the base end portion of the mounting guide 317 is positioned on the opposite side to the internal lugs 254 with respect to the agitator rotating shaft 253. A distal end portion of the projecting guide 244 projects counterclockwise, when the inner housing 242 is viewed from right side, as shown in FIG. 16(*a*).

In this toner cartridge 240, the inner housing 242 is movable to the toner close position. At the toner close position, the inner housing 242 permit the interior of the inner housing 242 to be sealed hermetically by closing the first vents 249 of the outer housing 241 with the cylindrical internal wall 251 except regions where the second vents 255 are formed, as shown in FIG. 14(*c*). At the toner close position, as shown in FIG. 16 (*b*), the third radial lugs 248, the internal lugs 254, and the first radial lug 337 are aligned with the same straight line drawn. At this toner close position, the distal end portion of the mounting grip 317 is positioned above the toner cartridge 240 and intersects with the projecting guide 244, as viewed from side elevation (this position of the projecting guide 244 is hereinafter referred to as the second position).

On the other hand, the inner housing 242 is movable to the toner open position. At the toner open position, the inner housing 242 can permit the first vents 249 and the second vents 255 to oppose to each other to open the interior of the inner housing 242, as shown in FIG. 14 (*a*). At the toner open position, the third radial lugs 248, the internal lugs 254, the first radial lug 337, and the agitator rotating shaft 253 are positioned to make a certain angle, as viewed from side elevation. At this toner open position, the mounting grip 317 corresponds in position to the projecting guide 244. In detail, the base end portion of the mounting grip 317 and the base end portion of the projecting guide 244 correspond in level to each other, as viewed from side elevation, and in the projecting direction from each base end portion (this position of the projecting guide 244 is hereinafter referred to as the first position).

The inner housing 242 contains toner comprising one positively-charged nonmagnetic component as developing agent. Polymerized toner produced by allowing polymerizable monomer (including, for example, styrene monomer such as styrene etc, and acrylic monomer such as acrylic acid, alkyl (C1-C4) acrylate and alkyl (C1-C4) methacrylate etc) to be copolymerized by suspension polymerization or the like, is used as the toner. The polymerized toner is generally spherical in shape and is so excellent in fluidity that high-definition images can be formed.

Colorant such as carbon black etc, and wax etc are mixed in the toner. In order to improve the fluidity of the toner, additive material, such as silica etc, is also added to the toner. A mean particle diameter of the toner is about 6 micrometer to about 10 micrometer.

As shown in FIGS. 15 (*a*) to 15 (*c*), the development left side wall 269 and the development right side wall 270 of the development housing 262 are respectively provided with toner detection windows 257 for detecting a remaining amount of toner accommodated in the toner cartridge 240 at locations corresponding to the toner cartridge 240 when the toner cartridge 240 accommodated in the toner cartridge accommodation chamber 271. The toner detection windows 257 are widthwise opposite to each other across the toner cartridge 240.

The main body casing 202 is provided with a toner empty sensor (not shown) including a light emitting element (not shown) and a light receiving element (not shown). The light emitting element (not shown) is disposed at the outside of one of the toner detection windows 257, and the light receiving element (not shown) is disposed at the outside of the other toner detection window 257. A detection beam is output from the light emitting element, then is input into the toner cartridge 240 through the one toner detection window 257. Next, the detection beam is output from the toner cartridge 240 through the other toner detection window 257, then is detected by the light receiving element. Thus, the toner empty sensor judges the remaining amount of toner according to how frequently the detection beam is detected.

When the remaining amount of toner accommodated in the toner cartridge 240 becomes low, a toner-empty warning is displayed in an operation panel (not shown) and the like in accordance with the judgement of the toner empty sensor.

(b-4) Mounting/Dismounting of the Toner Cartridge in/from the Process Cartridge (b-4-i) Mounting of the Toner Cartridge In the laser printer 201, the flat bed unit 206 is opened by being turned around the pivot shaft 208 to expose the mounting port 207 of the main body casing 202, as shown in FIG. 13. Then, the toner cartridge accommodation chamber 271 of the developing unit 230 is opened to an obliquely rightward and upward direction.

As shown in FIG. 15(*c*), the mounting grip 317 of the toner cartridge 240 where the inner housing 242 is in the toner close position, is gripped. Then, the toner cartridge 240 is began to be mounted from above, in obliquely forward and downward direction, in the state where the projecting guide 244 is positioned above the cylindrical portion 243. In this way the toner cartridge 240 is accommodated in the toner accommodation chamber 271.

At this time, the toner cartridge 240 takes a slanted position slanting to the left so that its left end portion is positioned below its right end portion, first.

Then, the internal lug 254 on the left side of the inner housing 242 and the agitator gear 300 are inserted in left-side guide groove 314 of the left side wall 269 and in the agitator gear exposing opening 319, respectively.

The left-side internal lug 254 inserted in the left-side guide groove 314 is guided to the left-side linear groove portion 332. Thereafter, the internal lug 254 on the right side of the inner housing 242 is guided to right-side linear groove portion 298 of the right-side guide groove 313. Then, the toner cartridge 240 is lowered within the toner cartridge accommodation chamber 271.

Following the lowering of the toner cartridge 240 within the toner cartridge accommodation chamber 271, when the right-side internal lug 254 is brought into abutment with a lower end portion of the right-side linear groove portion 298 of the right-side guide groove 313, and the left-side internal lug 254 is brought into abutment with a lower end portion of the left-side linear groove portion 332 of the left-side guide groove 314, the fitting of the toner cartridge 240 into the toner cartridge accommodation chamber 271 is completed.

At this time, as shown in FIG. 14 (*b*), the first radial lug 337 of the outer housing 241 penetrates the second penetrate hole 335 of the shutter 311 and fits into the fixing groove 309 of the curved wall 275. Then, the third radial lugs 248 of the inner housing 242 penetrate the first penetrate holes 221 of the shutter 311 and fit into the circumferential grooves 310 respectively.

Further, in the toner cartridge 240 accommodated in the toner cartridge accommodating chamber 271, the projecting guide 244 is put in the state where its distal edge faces to the rear edge of the first top wall 315 of the development top wall 267 of the developing unit 230 anteroposteriorly, and the projecting guide 244 continues to the first top wall 315, with slightly upward at the abutment position with each other, as viewed in section from side elevation, as shown in FIG. 15(*b*).

A space is formed between the upper surfaces of the first top wall 315 and projecting guide 244 which are continuous with each other, and a lower surface of a paper carrier guide 330, described later, of the flat bed unit 206 which is in the close position, as shown in FIG. 12. This space is defined by the height from the edges of the second guide lugs 292 on the downstream side of the projecting direction to the edges of the second guide ribs 293 on the downstream side of the projecting direction, the width between the widthwise inner edges of the second guide lugs 292 (see FIG. 15(*a*)), and the upper surfaces of the projecting guide 244 and first top wall 315 which are continuous with each other. This space forms a part of the transport path of the paper 203, in this space the paper 203 is carried in the image forming operation.

The toner cartridge 240 accommodated in the toner accommodation chamber 271 is put in the state where a distal end portion of the mounting grip 317 of the inner housing 242 which is in the toner close position is positioned above an upper edge of the upper wall 261 of the main body casing 202, as indicated by a broken line of FIG. 13. In detail, the distal end portion of the projecting guide 244 which is in the toner close position, is positioned with in a semicircular-arc region, as viewed from side elevation, formed as a swinging track of the flat bed unit 206 swinging between its spaced position and its close position.

As shown in FIG. 14(*a*), when the mounting grip 317 is operated to pivot around the agitator rotating shaft 253 in the counterclockwise direction as viewed from right side, the inner housing 242 is moved relative to the outer housing 241 and shifted from the toner close position to the toner open position, while also the shutter 311 is pressed by the third radial lugs 248 penetrating the first penetrate holes 312, and is moved from the development close position to the development open position.

In detail, following the pivoting of the mounting grip 317, the inner housing 242 provided with the mounting grip 317 thereon is also pivoted in the pivoting direction of the mounting grip 317 (in the above-mentioned counterclockwise direction). Following this, the right-side internal lug 254 abutted with the lower end portion of the right-side linear groove portion 298 is guided by the right-side curved groove portion 299 continuous from the lower end portion of the right-side linear groove portion 298 to pivot in the pivoting direction of the mounting grip 317, as shown in FIG. 15 (*a*). At the same time, the left-side internal lug 254 is guided by the left-side curved groove portion 333 to pivot in the pivoting direction of the mounting grip 317.

Then, the right-side internal lug 254 is brought into abutment with other edge of the right-side curved groove portion 299 on the opposite side of one end portion continuous with the lower end portion of the right-side linear groove portion 298. At the same time, the left-side internal lug 254 is brought into abutment with other edge of the left-side curved groove portion 333 on the opposite side of one end portion continuous with the lower end portion of the left-side linear groove portion 332. Thus, the pivoting of the inner housing 242 is restricted, and the movement of the inner housing 242 from the toner close position to the toner close position relative to the outer housing 241, is completed.

As shown in FIG. 14 (*a*), following the pivoting of the mounting grip 317 and the inner housing 242, the third radial lugs 248 which are penetrating the first penetrate holes 312 of the shutter 311 and fitted in the circumferential grooves 310, respectively are also guided by the circumferential groove portions 310 to pivot in the pivoting direction of the mounting grip 317. And when the internal lugs 254 are brought into abutment with the other edges (above-described) of the right-side curved groove portion 299 and left-side curved groove portion 333, the third radial lugs 248 are also brought into abutment with the rear edges of the circumferential groove portions 310 respectively.

Further, the shutter 311 in which the third radial lugs 248 of the inner housing 242 penetrate the first penetrate holes 312 thereof, are also pivoted in the pivoting direction of the mounting grip 317 by being pressed at the first penetrate holes 312 by the third radial lugs 248. Thus, at the same time when the completion of the movement of the inner housing 242 from the toner close position to the toner open position, the movement of the shutter 311 from the development close position of the shutter 311 to the development open position is also completed.

When the shutter 311 in the toner cartridge accommodation chamber 271 takes the development open position and the inner housing 242 of the toner cartridge 240 takes the toner open position, the introduction ports 288 of the toner cartridge accommodation chamber 271 are respectively opposed to the first vents 249 and the second vents 255 of the toner cartridge 240 which communicate to each other. As a result of this, the interior of the toner cartridge 240 and the interior of the developing chamber 272 of the developing unit 230 communicate with each other through the introduction ports 288, the first vents 249, and the second ports 255.

Also, the second radial lugs 250 are brought into abutment with the introduction ports 288 respectively to close around the introduction port 288, so that the introduction ports 288 and the first vents 249 are shielded to prevent leaking of the toner to the exterior.

The inner housing 242 is pivoted from the toner close position to the toner open position, whereas the outer housing 241 is circumferentially slidable relative to the inner housing 242. Since the outer housing 241 is fixed in position by the engagement of the first radial lug 337 to the fixing grooves 309 of the curved wall 275, the outer housing 241 is restricted from pivoting together with the inner housing 242 following the pivoting of the mounting grip 317.

When the inner housing 242 is in the toner close position, the distal end portion of the mounting grip 317 is positioned above the upper edge of the main body casing 202, while on the other hand, when the inner housing 242 is shifted to the toner open position, the distal end portion of the mounting grip 317 is accommodated in the main body casing 202, as shown in FIG. 13.

(b-4-ii) Dismounting of the Toner Cartridge

When the flat bed unit 206 is shifted to the spaced position, the mounting port 207 is opened widely to an obliquely rightward and upward direction. In the mounting port 207 opened, the user inserts the hand in the space between the notch 318 and the mounting grip 317 in the toner open position and grips the mounting grip 317.

When the mounting grip 317 is operated to pivot in the clockwise direction, as viewed from right side, in the state where the shutter 211 is in the development open position and the inner housing 242 is in the toner open position with respect to the outer housing 241, the inner housing 242 is shifted relative to the outer housing 241 from the toner open position to the toner close position, and also the shutter 311 is shifted from the development open position to the development close position by being pressed by the third radial lugs 248 penetrating the first penetrate holes 312.

In detail, following the pivoting of the mounting grip 317, the inner housing 242 provided with the mounting grip 317 thereon is also pivoted in the pivoting direction of the mounting grip 317 (in the clockwise direction described above), as shown in FIG. 15(*b*). A long with this, the internal lugs 254 in abutment with the above-mentioned other edges of the right-side curved groove portion 299 and the left-side curved groove portion 333 are also guided by the right-side curved groove portion 299 and the left-side curved groove portion 333 to pivot in the pivoting direction of the mounting grip 317 respectively.

Then, when the right-side internal lug 254 reaches the lower end portion of the right-side linear groove portion 298 continuous with one end portion of the right-side curved groove portion 299 and, at the same time, the left-side internal lug 254 reaches the lower end portion of the left-side linear groove portion 332 continuous with one en portion d of the left-side curved groove portion 333, the pivoting of the inner housing 242 is restricted, so that the shift of the inner housing 242 from the toner open position to the toner close position relative to the outer housing 241 is completed.

Then, following the pivoting of the mounting grip 317, the third radial lugs 248 which are penetrating the first penetrate holes 312 of the shutter 311 and fitted in the circumferential grooves 310, are also guided by the circumferential grooves 310 to pivot in the pivoting direction of the mounting grip 317, as shown in FIG. 14(*b*). At the same time when the internal lugs 254 reach the lower end portions of the right-side linear groove portion 298 and left-side linear groove portion 332 respectively, the third radial lugs 248 are brought into abutment with the front edge of the circumferential grooves 310.

The shutter 311 having the first penetrate holes 312 which the third radial lugs 248 of the inner housing 242 penetrate, is also pivoted in the pivoting direction of the mounting grip 317. As a result, at the same time when the shift of the inner housing 242 from the toner open position to the toner close position is completed, the shift of the shutter 211 from the development open position to the development close position is also completed.

After the completion of the shift of the inner housing 242 from the toner open position to the toner close position and the shift of the shutter 311 from the development open position to the development close position, the toner cartridge 240 is moved from the toner cartridge accommodation chamber 271 to an obliquely rearward and upward direction, by gripping the mounting grip 317, as shown in FIG. 14(*c*).

At this time, as shown in FIG. 15 (*c*), the right-side internal lug 254 of the inner housing 242 is guided by the right-side linear groove portion 298 of the right-side guide groove 313, to move the right end portion of the toner cartridge 240 upwards. As a result of this, the toner cartridge 240 takes a slanted position in which its left end portion is positioned lower than its right end portion.

After the movement of the right-side interior lug 254, the left-side internal lug 254 of the inner housing 242 is guided by the left-side linear groove portion 332 of the left-side guide groove 314 to move upwards.

At the same time, the third radial lugs 248 are spaced away from the first penetrate holes 312 of the shutter 311 and the circumferential groove portions 310 of the curved wall 275 respectively, and the first radial lug 337 of the outer housing 241 are spaced away from the second penetrate hole 335 of the shutter 311 and the fixing groove 309 of the curved wall 275, as shown in FIG. 14(*c*).

Then, as shown in FIG. 15(*c*), the toner cartridge 240 is moved upwards. Then, after the right-side internal lug 254 of the inner housing 242 is disengaged from the right-side linear groove portion 298, the left-side internal lug 254 of the inner housing 242 is disengaged from the left-side linear groove portion 332 of the left-side guide groove 314 and the agitator gear 300 is also disengaged from the agitator gear exposing opening 319.

Then, the toner cartridge 240 is drawn in the obliquely rightward and upward direction from the mounting port 207 opened widely to the obliquely rightward and upward direction, and the dismounting the toner cartridge 240 from the toner cartridge accommodation chamber 271 is completed, as shown in FIG. 13.

(b-5) Developing/Transferring Operation

When an image is formed by the laser printer 201 after the toner cartridge 240 is accommodated in the toner cartridge accommodation chamber 271, as described above (b-4-i), the driving force from the motor (not shown) is input to the agitator rotating shaft 253. Then, the agitator rotating shaft 253 is rotated in the clockwise direction as viewed in right side, so that the agitator 256 is moved around the agitator rotation shaft 253 circumferentially in the inside of the inner housing 242, as shown in FIG. 14 (*a*). Then, the toner accommodated in the toner cartridge 240 is agitated by the agitator 256 and is discharged into the developing chamber 272 via the first vents 249, the second vents 255, and the introduction ports 288.

The toner discharged from the introduction ports 288 into the developing chamber 272 is fed onto the developer roller 304 by the rotation of the feed roller 301, at this time the toner is positively charged by friction between the feed roller 301 and the developer roller 304. Following the rotation of the developer roller 304, the toner fed onto the developer roller 304 goes between the pressing portion 308 of the layer-thickness regulating blade 307 and the rubber roller 306 of the developer roller 304 and is carried on the developer roller 304 in the form of a thin layer having a uniform thickness.

Along with the rotation of the photosensitive drum 228, a surface of the photosensitive drum 228 is positively charged uniformly by the scorotron charger 229, at first. Then, the surface of the photosensitive drum 228 is exposed to light from the scanner 220 by high-speed scanning using laser beam, to form thereon an electrostatic latent image corresponding to an image to be formed on the paper 203.

Then, when the toner carried on the developer roller 304 and positively charged is opposed to and brought into contact with the photosensitive drum 228 by the rotation of the developer roller 304, the toner is attached to the electrostatic latent image formed on the surface of the photosensitive drum 228, in other words, the toner is fed to the exposed part of the uniformly-positively-charged surface of the photosensitive drum 228 which is exposed to the laser beam and drops in electric potential. As a result, the electrostatic latent image on the surface of the photosensitive drum 228 is converted to a visible image and the visible toner image created by the reversal developing process is carried on the surface of the photosensitive drum 228.

Thereafter, the toner image carried on the surface of the photosensitive drum 228 is sent by the resistration roller 216. During the time when the paper 203 which enters the drum housing 276 from the first passing port 284 passes the transfer position between the photosensitive drum 228 and the transfer roller 231, the toner image is transferred to the paper 203 by the transfer bias applied to the transfer roller 231.

The paper 203 is turned forward around the separation roller 210 in a generally U-shape and then is moved above the toner cartridge 240. After passing through the space formed between the upper surface of the projecting guide 244 and the upper surface of the first top wall 315 of the developing unit 230, and the lower surface of the flat bed unit 206, the paper 203 reaches the transfer position through the first passing port 284 of the drum portion 227.

Then, the paper 203 onto which the toner image was transferred is ejected from the second passing port 285 to the exterior of the drum housing 276 and thereafter is sent to the fixation unit 222. The paper 203 is carried generally horizontally from the transfer position to the fixation unit 22.

The remaining toner left on the photosensitive drum 228 after transfer is collected by the developer roller 304.

(c) Fixation Unit

As shown in FIG. 12, the fixation unit 222 is arranged to be adjacent to and above the scanner 220 and also arranged in front of the process cartridge 221. The fixation unit 222 comprises a fixation frame 258, a heating roller 259, a pressing roller 260, and a paper ejection roller 296.

The heating roller 259 includes a metal pipe whose surface is coated with a fluorine resin, and a halogen lamp, inserted in the metal pipe, for heating. The heating roller 259 is rotationally driven by a driving force input from a motor (not shown).

The pressing roller 260 is disposed opposite to and above the heating roller 259 to press it. The pressing roller 260 includes a metal roller shaft, and a rubber roller formed of rubber material and covering the roller shaft. The pressing roller 260 is driven following the rotational drive of the pressing roller 259.

The paper ejection rollers 296 comprises a pair of rollers and are disposed on the downstream side of the paper transporting direction with respect to the heating roller 259 and the pressing roller 260.

The toner image transferred on the paper 203 at the transfer position is thermally fixated at the fixation unit 222 during the time when the paper 203 passes through between the heating roller 259 and the pressing roller 260. The paper 203 on which the toner image was fixated is carried toward the paper ejection tray 295 by the paper ejection rollers 296 through an ejection port 348. The paper 203 is sent horizontally from the fixation unit 222 to the ejection port 248.

(4) Ejection Section

Figure 17:
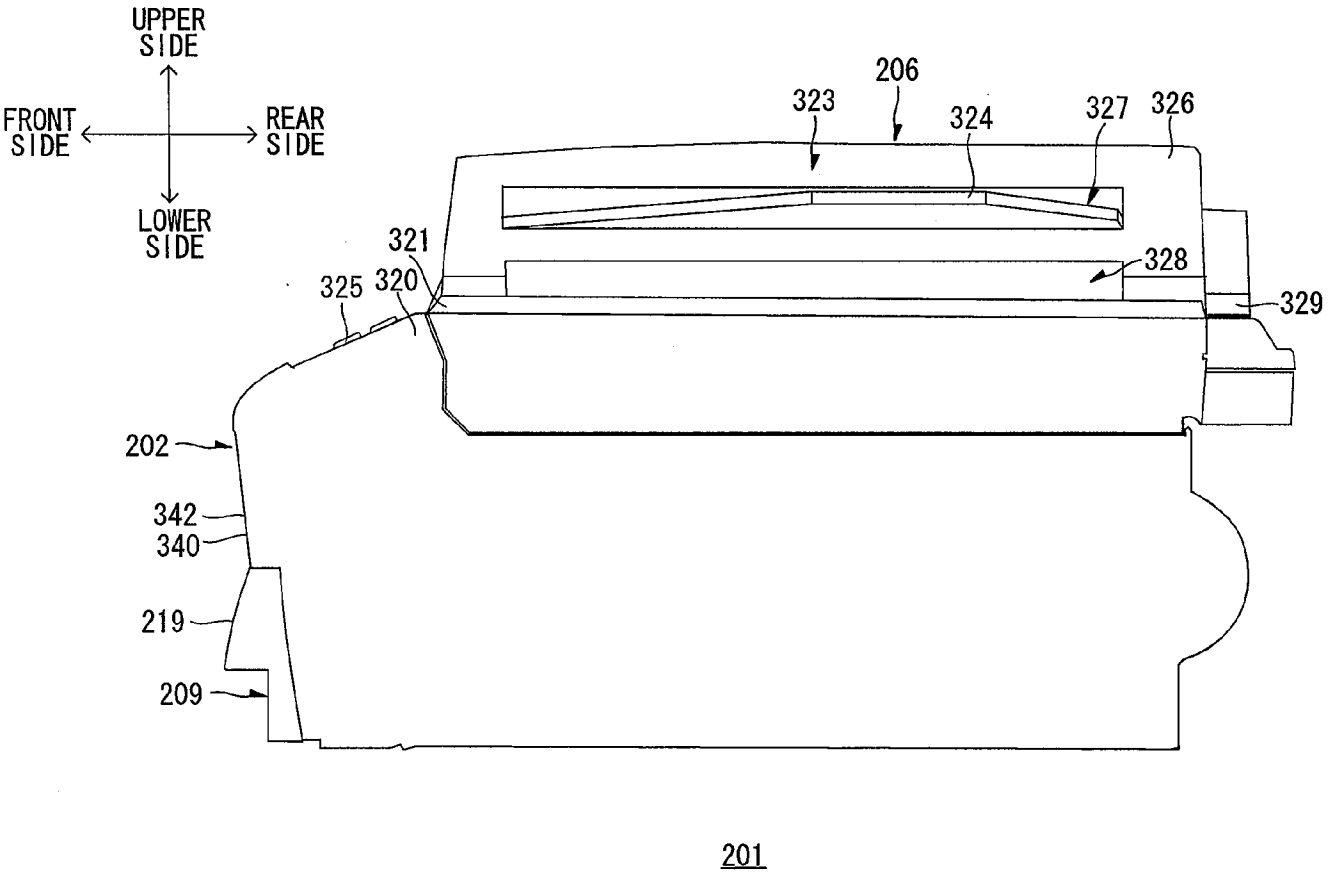
FIG. 17 is a right side view of the laser printer shown in FIG. 12.
Figure 18:
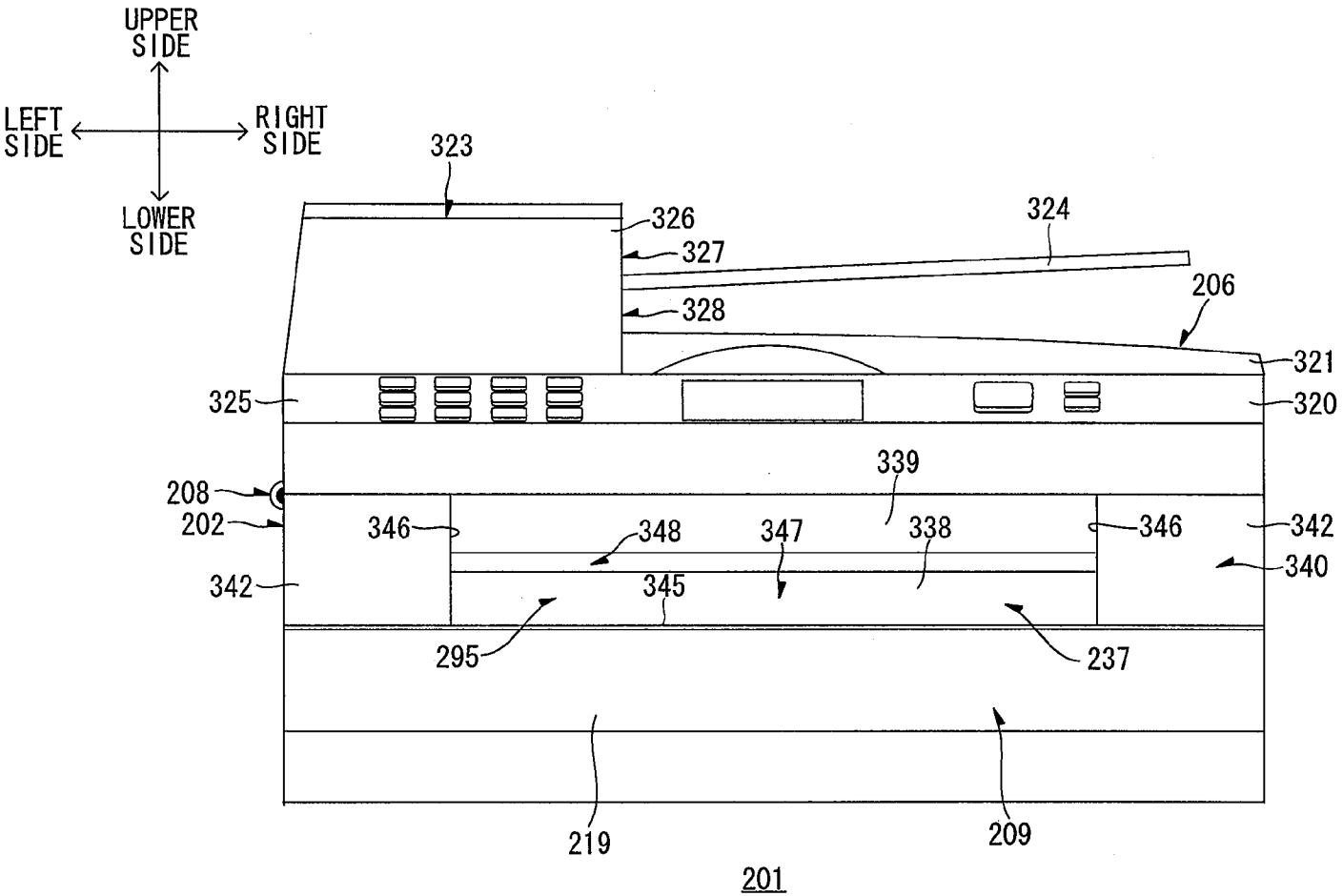
FIG. 18 is a front view of the laser printer shown in FIG. 12.

FIG. 17 is a right side view of the laser printer shown in FIG. 12, and FIG. 18 is a front view of the laser printer shown in FIG. 12.

The ejection section 237 includes the paper ejection tray 295 and the ejection port 348 on the front side of the main body casing 202.

As shown in FIG. 18, the front side wall 340 of the main body casing 202 is provided on both ends thereof with a pair of front end walls 342. The front side wall 240 has the paper ejection tray 295 concaved rearwards thereof in a region thereof sandwiched widthwise between the pair of front end walls 342, as shown in FIG. 18. The paper ejection tray 295 is disposed to overlap upwardly with a front half portion of the paper feed tray 209 and the scanner 220.

In detail, as shown in FIG. 18, the paper ejection tray 295 has an ejection bottom wall 345, a pair of ejection side walls 346, and an ejection rear wall 347 (ejection wall). The ejection bottom wall 345 is formed in a generally rectangular plate form, as viewed from top, extending rearwards continuously from a lower edge of the front side wall 340 at the portion thereof which is widthwise sandwiched between the pair of front end walls 342.

The pair of ejection sidewalls 346 are extended upwards from both widthwise edge of the ejection bottom wall 345 to oppose to each other. Upper edge of the ejection side walls 346 are flush with upper edge of the front side walls 340.

The ejection rear wall 347 is formed in a rectangular plate, as viewed from front, extending upwards continuously from a rear edge of the ejection bottom wall 345 and extended between the ejection side walls 346. The ejection rear wall 347 comprises a first ejection rear wall 338 forming a lower half part thereof and a second ejection rear wall 339 forming an upper half thereof. The ejection rear wall 347 is placed adjacent to and in front of the fixation unit 222, as shown in FIG. 12.

An upper edge of the ejection rear wall 338 is disposed opposite to the lower edge of the second paper rear wall 339 at a vertically spaced relation. The space is larger than the thickness of the paper 203, and serves as a paper ejection port 348 for allowing the fixation unit 222 and the paper ejection tray 295 to communicate with each other.

The paper 203 thermally fixated in the fixation unit 222 is ejected onto the ejection bottom wall 345 of the paper ejection tray 295 through the paper ejection port 348.

When the flat bed unit 206 is closed and the mounting port 207 in the main body casing 202 is closed, the paper ejection tray 295 is opened on the front side. When the flat bed unit 206 is opened and the mounting port 207 is opened, the paper ejection tray 295 is opened on the top side as well, as shown in FIG. 13.

(5) Flat Bed Unit (a) Overall Structure of the Flat Bed Unit

Figure 19:
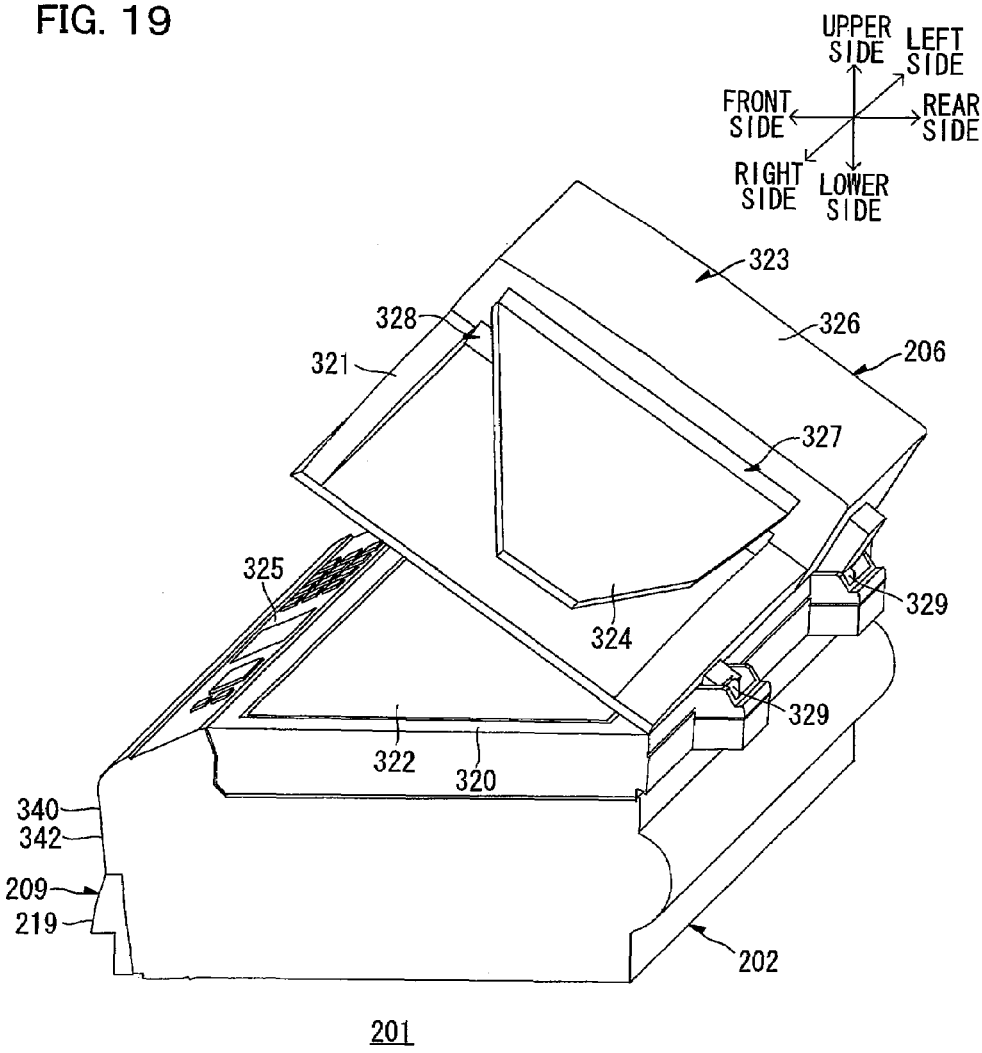
FIG. 19 is a right-side perspective view of the laser printer shown in FIG. 12, as viewed from above and behind, showing the state of a front end portion of a document holding cover being lifted up to open a glass surface of a document mounting table.

FIG. 19 is a right-side perspective view of the laser printer shown in FIG. 12, as viewed from above and behind, and shows the state where a front end portion of a document holding cover , described later, is lifted up to open a glass surface of the document mounting table.

The flat bed unit 206 is in a generally square form, as viewed from top, and includes the document mounting table 320, and the document holding cover 321 supported on the document mounting table 320 in a freely open/close manner, as shown in FIG. 19.

The document mounting table 320 is formed in a thick plate of a generally rectangular form as viewed from top and includes a glass surface 322 formed on an upper surface thereof for putting a document thereon, and a paper carrier guide 330 (see FIG. 13) formed on a lower surface thereof.

The glass surface 322 is formed by embedding a sheet of glass in the document mounting table 320 so that the upper surface of the document mounting table 320 is flat. The glass surface 322 is in a rectangular form, as viewed from top, whose anteroposterior dimension extends along the anteroposterior direction of the document mounting table 320.

The document mounting table 320 has a CCD sensor (not shown) for scanning the document and a scan motor (not shown) for moving the CCD sensor for scanning the document in the state of facing the glass surface 322.

The CCD sensor (not shown) is supported to be movable in a transverse direction on the inner side (under side) of the glass surface 322 and is normally on standby at the left end of the glass surface 322. In the usual scanning of the document, the CCD sensor is moved for the scanning from the left side to the right side in the state of facing the glass surface 322 by the scan motor (not shown).

The paper carrier guide 330 is formed to be elongated in the transverse direction and is also formed to be gently concaved upward so that when the flat bed unit 206 is closed and the mounting port 207 at the top of the main body casing 202 is closed, the paper carrier guide 330 can extend the upper surface of the first top wall 315 and the projecting guide 244 in a spaced relations, as shown in FIG. 12.

One of the pair of resistration rollers 216 (above-mentioned) is freely rotatably supported by the paper carrier guide 330 at the rear and lower end portion thereof.

The document holding cover 321 is formed in a thin rectangular plate having the same shape as the document mounting table 320, as shown in FIG. 19. The document holding cover 321 is provided on the left end portion of its upper surface, with an ADF (automatic document feeder) 223 (feed unit) for automatically reading the document. The ADF 323 includes a casing 326, a document feed roller (not shown), a document feed motor (not shown), and a document detection sensor (not shown). The casing 326 is formed in a box elongated in the anteroposterior direction and has the document feed roller (not shown) and the document feed motor (not shown) built therein and a standby document tray 324 arranged on the right side wall at a vertical center portion thereof, as shown in FIG. 18. The standby document tray 324 is in the form of a thin plate of a generally trapezoidal form as viewed from top (see FIG. 19). The standby document tray 324 is supported by the ADF 323 with its bottom portion of the general trapezoid as a base end portion, and its distal end portion is extended rightwards in a generally horizontal direction. The standby document tray 324 can permit documents to be set in a stacked relation.

The right side wall of the casing 326 has a document intake port 327 formed on an upper side of the standby document tray 324 for taking the document in an interior of the casing 326, and a document ejection port 328 formed on a lower side of the standby document tray 324 for ejecting the document from the casing 326, as shown in FIG. 17. The document intake port 327 and the document ejection port 328 are both formed in a rectangular shape elongated in the anteroposterior direction.

The document holding cover 321 is swingably supported at a rear end portion thereof by a rear end portion of the document mounting table 320 via hinges 329, as shown in FIG. 19.

A front end portion of the document holding cover 321 is swung vertically around the hinges 329 at the rear end portion thereof. When a front end portion of the document holding cover 321 is lifted up, the glass surface 322 of the document mounting table 320 is exposed. On the other hand, when the front end portion of the document holding cover 321 is lifted down, the glass surface 322 of the document mounting table 320 is covered. Thus, the glass surface 322 of the document mounting table 320 is covered by the document holding cover 321 in a freely opened and closed manner.

(b) Normal Scanning of the Document by the Flat Bed Unit

In the flat bed unit 206, the front end portion of the document holding cover 321 is lifted up and the document is set on the glass surface 322. Then, the front end portion of the document holding cover 321 is lifted down and the command is entered with the buttons on the operation panel 325. Then, the CCD sensor (not shown) is moved from the left side toward the right side, in the state of facing the document put on the glass surface 322, to scan the image data of the document.

After completion of the scanning of the document, the front end portion of the document holding cover 321 is lifted up again and the document is taken away from the glass surface 322. After the completion of the scanning, the CCD sensor (not shown) is automatically moved back to the left end of the glass surface 322 by the scan motor (not shown) and is held in a standby state there.

(c) Automatic Scanning of the Document by the Flat Bed Unit

In the automatic scanning of the document by the ADF 223, when the document put on the standby document tray 324 is detected by the document detection sensor (not shown), the CCD sensor (not shown) is fixed at an automatic document scanning position, not shown, differently from the normal scanning of the document described above. Then, when a user enters a command with the buttons on the operation panel 325, the document feed motor (not shown) is driven to rotate the document feed roller (not shown) by the driving force from the motor. Following the rotation of the document feed roller (not shown), the document is moved leftwards and is taken in the interior of the casing 326 via the document intake port 327. When the document taken in passes through the document carrying path (not shown), and is brought into a position opposing to the CCD sensor (not shown), image data of the document is scanned by the scanning of the CCD sensor (not shown). Thereafter, the document is moved rightwards from the document ejection port 328 and ejected onto an upper surface of the document holding cover 321.

(d) Image Formation based on Image Data of the Scanned Document

As shown in FIG. 12, in the image forming section 205, the image data is created based on the above-mentioned image data of the document scanned by the CCD sensor (not shown) and the image is formed on the paper 203, as described above.

2. Operation and Effect

As described above, in this laser printer 201, the flat bed unit 206 is swingably supported by the pivot shaft 208 inserted therethrough along the anteroposterior direction at the left end portion thereof. When the toner cartridge 240 is replaced with the new one by a user, the flat bed in it 206 is opened by being pivoted about the pivot shaft 208 to its spaced position, first. Then, the mounting port 207 formed in the upper wall 261 of the main body casing 202 is opened to the diagonally rightward and upward direction.

Then, a space is formed between a right end portion of the upper wall 261 in which the mounting port 207 opening to the obliquely rightward and upward is formed and a right end portion of the flat bed unit 206 which is in the spaced position, and the toner cartridge 240 can be mounted in and dismounted from the main body casing 202 via the space. Hence, the opening angle of the flat bed unit 206 from the closed position to the spaced position can be minimized, thereby minimizing the user's energy required for opening and closing flat bed unit 206.

When the mounting port 207 is opened to the obliquely rightward and upward, the toner cartridge 240 placed on the rear side of the main body casing 202 is located at a position anteroposteriorly away from the user standing on the front side of the main body casing 202. However, since the mounting grip 317 at the right end portion of the toner cartridge 240 is exposed at a relatively close position to the user, the user can easily find the mounting grip 317 and can easily handle it.

In addition, the toner cartridge 240 can be mounted and dismounted in and from the toner cartridge accommodation chamber 271 in the developing unit 230 of the process cartridge 221.

Therefore, the toner cartridge 240 can be separated from the process cartridge 221 and replaced with ease by shifting the flat bed unit 206 to the spaced position and manipulating the mounting grip 317 exposed from the mounting port 207. As a result, the toner cartridge 241 can be easily replaced.

Also, since the paper feed tray 209 is provided below the process cartridge 221 and the paper ejection tray 295 of the ejection section 237 is formed in front of the fixation unit 232 located in front of the process cartridge 221, the transport path of the paper 203 can be formed so as to sandwich vertically the toner cartridge 240 which is removably mounted in the process cartridge 221.

This can allow the transport path to be increased in radius of curvature at the U-turn point, and allow a reliable transport of the paper 203 with a reduced risk of paper jam.

Further, the paper 203 is reliably ejected onto the ejection bottom wall 345 of the paper ejection tray 295 through the ejection port 348 formed in the ejection rear wall 347 disposed in front of and adjacent to the fixation unit 222. This can achieve a reliable transport of the paper 203 to the paper ejection tray 295. Further, when a user's hand is inserted in the paper ejection tray 295, the user's hand can be blocked by the ejection rear wall 347 to prevent a possible burn injury that may take place by direct contact with the fixation unit 222 heated.

Also, since the ejection rear wall 347 is disposed in front of and adjacent to the fixation unit 222 or is located anteroposteriorly in the midway of the paper feed tray 209, the paper ejection tray 295 formed by the ejection rear wall 347, the ejection bottom wall 345 forwardly continuous from the ejection rear wall 347, and the pair of ejection side walls 346, can be arranged to overlap upwardly with the paper feed tray 209, thus reduction in size of the laser printer 1 can be achieved.

Further, since the internal ejection of the paper 203 is possible by arranging the paper ejection tray 295 to overlap upwardly with the paper feed tray 209, the anteroposteriorly dimension of the laser printer 201 can be reduced, thereby reduction in size of the laser printer 201 can be achieved.

Also, as described above, the paper ejection tray 295 formed by the ejection rear wall 347, the ejection bottom wall 345, and the pair of ejection side walls 346, can allow the paper 203 to be stacked up on the paper ejection tray 295.

Accordingly, the convenience of the laser printer 201 can be enhanced.

When the toner cartridge 240 is mounted in the toner cartridge accommodation chamber 271 of the developing unit 230 of the process cartridge 221 mounted in the main body casing 202, the projecting guide 244 is put in the state where its distal edge faces to the rear edge of the first top wall 315 of the development top wall 267 of the developing unit 230 anteroposteriorly, and continues to the first top wall 315 with slightly upward at the abutment position with each other, as viewed in section from side elevation. Then, a space is formed between the upper surfaces of the first top wall 315 and projecting guide 244 which are continuous with each other, and the lower surface of the paper carrier guide 330 of the flat bed unit 206 which is in the close position. This space forms a part of the transport path of the paper 203, therefore, the transport path is completed.

On the other hand, when the toner cartridge 240 is dismounted from the main body casing 202, the upper surface of the first top wall 315 and the upper surface of the projecting guide 244 come to be discontinuous with each other, so that a part of the transport path is not formed and the transport path is brought into incompletion.

This can permit the paper 203 to be transported along the transport path reliably and smoothly in response to the mounting and dismounting of the toner cartridge 240 in and from the main body casing 202.

As a result of this, a reliable carriage of the paper 203 can be achieved.

In addition, since the developing guide 244 forms a part of the transport path, as described above, the developing guide 244 can also serves as a part of the components forming the transport path. Thus, as compared with a transport path formed by separate components, the number of components forming the transport path can be reduced, and this can allow reduction in size of the laser printer 201.

The mounting grip 317 can be freely pivoted around the central axis of the cylindrical portion 243 or around the agitator rotating shaft 253. When the mounting grip 317 is pivoted around the agitator rotating shaft 253 to be shifted to the toner close position, the mounting grip 317 takes the above-mentioned second position to intersect with the transport path. In detail, in this second position, the distal end portion of the mounting grip 317 is positioned above the toner cartridge 240 and intersects with the projecting guide 244 forming a part of the transport path, as viewed from side elevation.

Hence, when the mounting grip 317 is in the second position, the user can operate the mounting grip 317 to facilitate the replacement of the toner cartridge 240.

On the other hand, when the toner cartridge 240 is mounted in the toner cartridge accommodation chamber 271 and thereafter the mounting grip 317 is shifted to the toner open position, the mounting grip 317 takes the above-mentioned first position to be along the transport path. In detail, the base end portion of the mounting grip 317 and the base end portion of the projecting guide 244 are at the same position, as viewed from side elevation, and the projecting directions from base end portion thereof are the same.

Therefore, since the mounting grip 317 is extended along the transport path, it is not obstructive in the main body casing 202, an interior space of the main body casing 202 can be utilized effectively, that is, reduction in size of the laser printer 201 can be achieved.

Further, the upper wall 261 of the main body casing 202 has the notch 318 formed on the right side thereof opposing to the mounting grip 317 in the toner open position. The notch 318 is formed by concaving rightwards an inside surface on the right side position of the upper wall 261 in such a manner as to be continuous with the mounting port 207. This notch 318 forms a space with respect to the mounting grip 317 of the toner cartridge 240 in the toner open position, and is formed in a generally semicircular shape as viewed from top corresponding to a ring shaped mounting grip 317.

Therefore, the mounting grip 317 can be operated easily by inserting the user's hand in the space formed between the notch 318 and the mounting grip 317. Hence, the toner cartridge 240 can be replaced with further ease.

The paper 203 fed from the paper feed tray 209 is turned forward around the separation roller 210 in a generally U-shape and then moved over the toner cartridge 240. Then, after passing the space, which is formed between the upper surface of the first top wall 315 and the upper surface of the projecting guide 244 in the toner open position, and the lower surface of the flat bed unit 206, the paper 203 is ejected on to the paper ejection tray 295.

This can allow the transport path to increase in radius of curvature at the U-turn point, as compared with the transport path passing under the toner cartridge 240. This can allow the paper 203 to turn around in an increased radius of curvature at the U-turn point, and this can prevent the paper 203 passing over the U-turn pivot from being curled easily. Hence, the paper 203 can pass along the transport path smoothly.

As a result of this, a further reliable transport of the paper 203 with a reduced risk of paper jam can be provided. Conversely, the paper 203 can be transported reliably, while at the same time, the laser printer 201 of a very low thickness can be configured.

As is the case with the paper ejection tray 295 formed on the front side of the main body casing 202, the paper feed tray mounting port 341 is formed on the front side of the main body casing 202

Thus, the user can mount and dismount the paper feed tray 209 in and from the main body casing 202 through the paper feed tray mounting port 341 in the anteroposterior direction without changing standing position from the front side of the main body casing 202.

Further, since the paper feed tray 209 is in the shape of a box opening at the top, the paper 203 can be stacked up on it.

Hence, an enhanced convenience of the laser printer 201 can be provided.

The scanner 220 is placed to adjacent to the process cartridge 221 so that it overlaps downwardly with the anteroposterior front half position of the process cartridge 221.

Therefore, a space below the process cartridge 221 can be utilized effectively.

Further, since the scanner 220 is placed adjacent to the paper feed tray 209 so that it overlaps upwardly with an area of the paper feed tray 209 extending from a front end portion thereof to a portion on a slightly rear side from a anteroposterior center thereof, and also is placed adjacent to the paper ejection tray 295 so that its front half portion overlaps downwardly with the paper ejection tray 295, the laser printer 201 can be reduced in anteroposterior size. Further, the scanner 220 can be configured so that the scanner 220 cannot overlap with the toner cartridge 240 in a perpendicular (vertical) direction by extending the scanner 220 toward the paper ejection tray 295 (forwards). This can provide an increased volume of the toner cartridge 240, while achieving reduction in thickness of the laser printer 201.

As a result of this, the laser printer 201 can be downsized.

As described above, the paper 203 is turned forward around the separation roller 210 in a generally U-shape, followed by the image formation, and then is ejected to the paper ejection tray 295 formed on the front side of the main body casing 202. On the other hand, in the flat bed unit 206, the document, after scanned by the ADF 223 to obtain the image data, is carried rightwards from the document ejection port 328 and ejected onto the upper surface of the document holding cover 321.

Thus, since the document carrying direction and the paper transporting direction are orthogonalized when vertically projected on the same plane, the laser printer 201 can be reduced in size with respect to the paper transporting direction of the paper 203, as compared with the case of both directions being oriented to the same direction.

As a result, the paper 203 used can be reduced in size.

Fourth Embodiment

Although the operation panel 325 is arranged on the upper wall 261 of the main body casing 202 in the third embodiment, it may be arranged on the document mounting table 320. In this variant, when the flat bed unit 206 is moved to the spaced position, the operation panel 325 is also moved to the spaced position. This enables the mounting port 207 to be opened widely, and can further facilitate the replacement of the toner cartridge 240.

In the third and fourth embodiments, the process cartridge 221 integrally includes the drum unit 227 and the developing unit 230, and the process cartridge 221 is removably mounted and dismounted in and from the main body casing 202. In addition to this, in the image forming apparatus of the present invention, for example, the drum unit 227 may be formed as a drum cartridge including the photosensitive drum 228, the scorotron charger 229, the transfer roller 231, and the cleaning brush 232 so that such a drum cartridge can be removably mounted and dismounted in and from the main body casing 202. Likewise, the developing unit 230 may be formed as a developing cartridge including the toner cartridge accommodation chamber 271, the developer roller 304, the feed roller 301, and the layer-thickness regulating blade 307 so that such a developing cartridge can be removably mounted and dismounted in and from the drum portion 227.

Although the paper feed tray 209 is removably mounted in the main body casing 202 in the third and fourth embodiments, the paper feed tray 209 may be integrally formed with the main body casing 202. In this variant, the front side wall is not formed in the paper feed tray 209, and the paper 203 is received in the paper feed tray 209 through the paper feed tray mounting port 341.

Although the paper ejection tray 295 is integrally formed with the main body casing 202, the paper ejection tray 295 may take the removable form, as is the case with the paper feed tray 209.

While the four independent embodiments, i.e., the first, second, third and fourth embodiment, of the present invention have thus been described in detail, those skilled in the art may utilize the features of these four embodiments in combination to provide an image forming apparatus having the advantages of four embodiments. For example, applying a LED-device to the exposure unit, can be easily taken. In this case, a LED-device is arranged below the photosensitive drum (image carrier)

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

a housing;

an image scanning unit, arranged above the housing, for scanning image data of document;

a process unit arranged in the housing, comprising an image carrier on which an electrostatic latent image is formed, a developing agent carrier for carrying a developing agent used for developing the electrostatic latent image to form a developing agent image, a transfer unit for transferring the developing agent image formed on the image carrier to a recording medium, and a developing agent accommodating member for accommodating the developing agent;

an exposure unit, arranged below the image carrier in the housing, for forming the electrostatic latent image by exposing the image carrier;

a recording medium feed section, arranged below the process unit in the housing, for accommodating the recording medium;

a developing agent cartridge having at least the developing agent accommodating member, which is arranged above the recording medium feed section in the housing and is removably mounted in the housing;

a fixation unit, arranged above the recording medium feed section in the housing and disposed on a side horizontally opposite to the developing agent accommodating member with respect to the image carrier, for fixing the developing agent image which is transferred to the recording medium by the process unit, on the recording medium;

a recording medium ejection section arranged outside of the housing and on a side horizontally opposite to the process unit with respect to the fixation unit in such a manner as to overlap the recording medium feed section in an upward direction; and a transport path, formed in the housing, for allowing the recording medium fed from the recording medium feed section to pass over the developing agent cartridge.

2. The image forming apparatus according to claim 1, wherein the recording medium feed section is a feed tray, the housing has an ejection wall which is disposed horizontally opposite to the fixation unit and is disposed midway of the recording medium feed section in a horizontal direction, in which an ejection port is formed for ejecting the recording medium fixed with the developing agent image to the outside of the housing, and the recording medium ejection section is arranged outside of the housing on a side horizontally opposite to the fixation unit with respect to the ejection wall, and is provided with an ejection tray.

3. The image forming apparatus according to claim 2, wherein the ejection tray is closed in left, right, top, and bottom directions which are orthogonal to an ejection direction of the recording medium.

4. The image forming apparatus according to claim 1, wherein the exposure unit is arranged to partly overlap with the recording medium ejection section and the recording medium feed section vertically.

5. The image forming apparatus according to claim 1, wherein the image scanning unit is configured to freely open and close toward the housing, and the developing agent cartridge is configured to be mounted in and dismounted from above the housing.

6. The image forming apparatus according to claim 1, wherein the recording medium feed section is configured to be mounted in and dismounted from the housing from a side of a downstream end portion of the recording medium ejection section with respect to an ejecting direction of the recording medium.

7. The image forming apparatus according to claim 1, wherein the developing agent cartridge has, on an upper portion thereof, a guide member that forms a part of the transport path of the recording medium and guides the recording medium passing over the developing agent cartridge when the developing agent cartridge is mounted in the housing.

8. The image forming apparatus according to claim 7, wherein the guide member takes a first position along the transport path of the recording medium and a second position intersecting with the transport path, and forms a part of the transport path when taking the first position.

9. The image forming apparatus according to claim 8, wherein the guide member is provided, at the position to form a part of the transport path, with space keeping members projecting from both ends thereof in a direction which is orthogonal to a transporting direction of the recording medium, to a thickness direction of the recording medium carried.

10. The image forming apparatus according to claim 9, wherein the guide member is provided with a plurality of ribs extending in a transporting direction of the recording medium between the respective space keeping members and projecting in a thickness direction of the carried recording medium to a smaller extent than the space keeping members.

11. The image forming apparatus according to claim 1, wherein the image scanning unit has, on a lower portion thereof, a guide member for guiding the recording medium.

12. The image forming apparatus according to claim 1, wherein only the transport path is provided between the developing agent cartridge and the image scanning unit.

13. The image forming apparatus according to claim 1, wherein the image scanning unit comprises a document mounting table for mounting and scanning the document and a feed unit for feeding the document to the document mounting table, and a direction for the document to be carried to the document mounting table by the feed unit and a transporting direction of the recording medium are orthogonalized when vertically projected on a same plane.

14. The image forming apparatus according to claim 13, wherein a dimension of the image forming apparatus in the transporting direction of the recording medium, and a dimension of the image forming apparatus in the direction for the document to be carried to the document mounting table by the feed unit are substantially equal to each other.

15. An image forming apparatus comprising:

a housing;

a process unit arranged in the housing, comprising an image carrier and on which an electrostatic latent image is formed, a developing agent carrier for carrying a developing agent used for developing the electrostatic latent image to form a developing agent image, and a transfer unit for transferring the developing agent image formed on the image carrier to a recording medium while carrying the recording medium between the image carrier and the transfer unit itself;

an image scanning unit, provided on an upper portion of the housing, for scanning an image data of a document, the image scanning unit being swung around one end portion side in a direction which is orthogonal to a transporting direction of the recording medium, of an upper end portion of the housing, and the image scanning unit being swung in a freely open and close manner toward the housing so that the other end portion side of the image scanning unit is configured to be moved between a close position close to the upper end portion of the housing and a spaced position away from the upper end portion of the housing;

a recording medium feed section, arranged below the process unit in the housing, for accommodating the recording medium;

a developing agent cartridge, arranged above the recording medium feed section in the housing, for accommodating the developing agent, the developing agent cartridge being removably mounted in the process unit and having, on the other end portion side, a mounting operation member to be operated in mounting and dismounting the developing agent cartridge;

a fixation unit, arranged above the recording medium feed section in the housing and disposed on a side horizontally opposite to the developing agent cartridge with respect to the process unit, for fixing the developing agent image which is transferred to the recording medium by the process unit, on the recording medium;

a recording medium ejection section, arranged outside of the housing on a side horizontally opposite to the process unit with respect to the fixation unit, ejecting the recording medium on the recording medium ejection section;

an exposure unit, arranged in the housing, for forming the electrostatic latent image by exposing the image carrier; and a transport path for allowing transport of the recording medium from the recording medium feed section to the recording medium ejection section, wherein the recording medium ejection section is provided with an ejection tray which is arranged to partly overlap the recording medium feed section in an upward direction.

16. The image forming apparatus according to claim 15, wherein the housing has an ejection wall which is disposed horizontally opposite to the fixation unit is disposed midway of the recording medium feed section in a horizontal direction, in which an ejection port is formed for ejecting the recording medium fixed with the developing agent image to the outside of the housing, and the recording medium ejection section is arranged outside of the housing on a side horizontally opposite to the fixation unit with respect to the ejection wall.

17. The image forming apparatus according to claim 15, wherein the exposure unit is arranged below the image carrier so that a part of the exposure unit is vertically overlapped with the recording medium ejection section and the recording medium feed section.

18. An image forming apparatus comprising:

a housing;

a process unit arranged in the housing, comprising an image carrier and on which an electrostatic latent image is formed, a developing agent carrier for carrying a developing agent used for developing the electrostatic latent image to form a developing agent image, and a transfer unit for transferring the developing agent image formed on the image carrier to a recording medium while carrying the recording medium between the image carrier and the transfer unit itself carrier;

an image scanning unit, provided on an upper portion of the housing, for scanning an image data of a document, the image scanning unit being swung around one end portion side in a direction which is orthogonal to a transporting direction of the recording medium, of an upper end portion of the housing, and the image scanning unit being swung in a freely open and close manner toward the housing so that the other end portion side of the image scanning unit is configured to be moved between a close position close to the upper end portion of the housing and a spaced position away from the upper end portion of the housing;

a recording medium feed section, arranged below the process unit in the housing, for accommodating the recording medium;

a developing agent cartridge, arranged above the recording medium feed section in the housing, for accommodating the developing agent, the developing agent cartridge being removably mounted in the process unit and having, on the other end portion side, a mounting operation member to be operated in mounting and dismounting the developing agent cartridge;

a fixation unit, arranged above the recording medium feed section in the housing and disposed on a side horizontally opposite to the developing agent cartridge with respect to the process unit, for fixing the developing agent image which is transferred to the recording medium by the process unit, on the recording medium;

a recording medium ejection section, arranged outside of the housing on a side horizontally opposite to the process unit with respect to the fixation unit, ejecting the recording medium on the recording medium ejection section;

an exposure unit, arranged in the housing, for forming the electrostatic latent image by exposing the image carrier; and a transport path for allowing transport of the recording medium from the recording medium feed section to the recording medium ejection section, wherein the developing agent cartridge comprises a cylindrical case for accommodating the developing agent, a projecting member formed on an outer periphery of the case, and the mounting operation member, the projecting member forms a part of the transport path of the recording medium when the developing agent cartridge is mounted in the image forming apparatus, and the mounting operation member is freely pivotable around a central axis of the case, and when the mounting operation member is pivoted around the central axis, the mounting operation member takes a first position along the transport path and a second position intersecting with the transport path.

19. An image forming apparatus comprising:

a housing:

a process unit arranged in the housing, comprising an image carrier and on which an electrostatic latent image is formed, a developing agent carrier for carrying a developing agent used for developing the electrostatic latent image to form a developing agent image, and a transfer unit for transferring the developing agent image formed on the image carrier to a recording medium while carrying the recording medium between the image carrier and the transfer unit itself carrier;

an image scanning unit, provided on an upper portion of the housing, for scanning an image data of a document, the image scanning unit being swung around one end portion side in a direction which is orthogonal to a transporting direction of the recording medium, of an upper end portion of the housing, and the image scanning unit being swung in a freely open and close manner toward the housing so that the other end portion side of the image scanning unit is configured to be moved between a close position close to the upper end portion of the housing and a spaced position away from the upper end portion of the housing;

a recording medium feed section, arranged below the process unit in the housing, for accommodating the recording medium;

a developing agent cartridge, arranged above the recording medium feed section in the housing, for accommodating the developing agent, the developing agent cartridge being removably mounted in the process unit and having, on the other end portion side, a mounting operation member to be operated in mounting and dismounting the developing agent cartridge;

a fixation unit, arranged above the recording medium feed section in the housing and disposed on a side horizontally opposite to the developing agent cartridge with respect to the process unit, for fixing the developing agent image which is transferred to the recording medium by the process unit, on the recording medium;

a recording medium ejection section, arranged outside of the housing on a side horizontally opposite to the process unit with respect to the fixation unit, ejecting the recording medium on the recording medium ejection section;

an exposure unit, arranged in the housing, for forming the electrostatic latent image by exposing the image carrier; and a transport path for allowing transport of the recording medium from the recording medium feed section to the recording medium ejection section, wherein the housing has a notch, formed on the other end portion at a position opposite to the mounting operation member of the developing agent cartridge, for forming a space between the housing and the mounting operation member.

20. An image forming apparatus comprising:

a housing;

a process unit arranged in the housing, comprising an image carrier and on which an electrostatic latent image is formed, a developing agent carrier for carrying a developing agent used for developing the electrostatic latent image to form a developing agent image, and a transfer unit for transferring the developing agent image formed on the image carrier to a recording medium while carrying the recording medium between the image carrier and the transfer unit itself carrier;

an image scanning unit, provided on an upper portion of the housing, for scanning an image data of a document, the image scanning unit being swung around one end portion side in a direction which is orthogonal to a transporting direction of the recording medium, of an upper end portion of the housing, and the image scanning unit being swung in a freely open and close manner toward the housing so that the other end portion side of the image scanning unit is configured to be moved between a close position close to the upper end portion of the housing and a spaced position away from the upper end portion of the housing;

a recording medium feed section, arranged below the process unit in the housing, for accommodating the recording medium;

a developing agent cartridge, arranged above the recording medium feed section in the housing, for accommodating the developing agent, the developing agent cartridge being removably mounted in the process unit and having, on the other end portion side, a mounting operation member to be operated in mounting and dismounting the developing agent cartridge;

a fixation unit, arranged above the recording medium feed section in the housing and disposed on a side horizontally opposite to the developing agent cartridge with respect to the process unit, for fixing the developing agent image which is transferred to the recording medium by the process unit, on the recording medium;

a recording medium ejection section, arranged outside of the housing on a side horizontally opposite to the process unit with respect to the fixation unit, ejecting the recording medium on the recording medium ejection section;

an exposure unit, arranged in the housing, for forming the electrostatic latent image by exposing the image carrier; and a transport path for allowing transport of the recording medium from the recording medium feed section to the recording medium ejection section, wherein the transport path of the recording medium is formed so as to allow the recording medium fed from the recording medium feed section to pass over the developing agent cartridge.

21. An image forming apparatus comprising:

a housing;

a process unit arranged in the housing, comprising an image carrier and on which an electrostatic latent image is formed, a developing agent carrier for carrying a developing agent used for developing the electrostatic latent image to form a developing agent image, and a transfer unit for transferring the developing agent image formed on the image carrier to a recording medium while carrying the recording medium between the image carrier and the transfer unit itself carrier;

an image scanning unit, provided on an upper portion of the housing, for scanning an image data of a document, the image scanning unit being swung around one end portion side in a direction which is orthogonal to a transporting direction of the recording medium, of an upper end portion of the housing, and the image scanning unit being swung in a freely open and close manner toward the housing so that the other end portion side of the image scanning unit is configured to be moved between a close position close to the upper end portion of the housing and a spaced position away from the upper end portion of the housing;

a recording medium feed section, arranged below the process unit in the housing, for accommodating the recording medium;

a developing agent cartridge, arranged above the recording medium feed section in the housing, for accommodating the developing agent, the developing agent cartridge being removably mounted in the process unit and having, on the other end portion side, a mounting operation member to be operated in mounting and dismounting the developing agent cartridge;

a fixation unit, arranged above the recording medium feed section in the housing and disposed on a side horizontally opposite to the developing agent cartridge with respect to the process unit, for fixing the developing agent image which is transferred to the recording medium by the process unit, on the recording medium;

a recording medium ejection section, arranged outside of the housing on a side horizontally opposite to the process unit with respect to the fixation unit, ejecting the recording medium on the recording medium ejection section;

an exposure unit, arranged in the housing, for forming the electrostatic latent image by exposing the image carrier; and a transport path for allowing transport of the recording medium from the recording medium feed section to the recording medium ejection section, wherein the recording medium feed section is a feed tray which is configured to be mounted in and dismounted from the housing, from a downstream side of the recording medium ejection section with respect to an ejecting direction of the recording medium.

22. An image forming apparatus comprising:

a housing;

a process unit arranged in the housing, comprising an image carrier and on which an electrostatic latent image is formed, a developing agent carrier for carrying a developing agent used for developing the electrostatic latent image to form a developing agent image, and a transfer unit for transferring the developing agent image formed on the image carrier to a recording medium while carrying the recording medium between the image carrier and the transfer unit itself carrier;

an image scanning unit, provided on an upper portion of the housing, for scanning an image data of a document, the image scanning unit being swung around one end portion side in a direction which is orthogonal to a transporting direction of the recording medium, of an upper end portion of the housing, and the image scanning unit being swung in a freely open and close manner toward the housing so that the other end portion side of the image scanning unit is configured to be moved between a close position close to the upper end portion of the housing and a spaced position away from the upper end portion of the housing;

a recording medium feed section, arranged below the process unit in the housing, for accommodating the recording medium;

a developing agent cartridge, arranged above the recording medium feed section in the housing, for accommodating the developing agent, the developing agent cartridge being removably mounted in the process unit and having, on the other end portion side, a mounting operation member to be operated in mounting and dismounting the developing agent cartridge;

a fixation unit, arranged above the recording medium feed section in the housing and disposed on a side horizontally opposite to the developing agent cartridge with respect to the process unit, for fixing the developing agent image which is transferred to the recording medium by the process unit, on the recording medium;

a recording medium ejection section, arranged outside of the housing on a side horizontally opposite to the process unit with respect to the fixation unit, ejecting the recording medium on the recording medium ejection section;

an exposure unit, arranged in the housing, for forming the electrostatic latent image by exposing the image carrier; and a transport path for allowing transport of the recording medium from the recording medium feed section to the recording medium ejection section, wherein the image scanning unit comprises a document mounting table for mounting and scanning the document and a feed unit for feeding the document to the document mounting table, and a direction for the document to be carried to the document mounting table by the feed unit and a transporting direction of the recording medium are orthogonalized when vertically projected on a same plane.

* * * * *

UNITED STATES PATENT AND TRADEMARK OFFICE

CERTIFICATE OF CORRECTION

PATENT NO. : 7,639,966 B2
APPLICATION NO. : 11/563925
DATED : December 29, 2009
INVENTOR(S) : Sato et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 257 days.

Signed and Sealed this

Ninth Day of November, 2010

David J. Kappos

David J. Kappos
*Director of the United States Patent and Trademark Office*